US007344269B2

(12) United States Patent
Maglica

(10) Patent No.: US 7,344,269 B2
(45) Date of Patent: Mar. 18, 2008

(54) LIGHTING DEVICE WITH VARIABLE LENGTH CONDUCTOR

(75) Inventor: Anthony Maglica, Ontario, CA (US)

(73) Assignee: MAG Instrument, Inc., Ontario, CA (US)

( * ) Notice: Subject to any disclaimer, the term of this patent is extended or adjusted under 35 U.S.C. 154(b) by 0 days.

(21) Appl. No.: 11/378,803

(22) Filed: Mar. 16, 2006

(65) Prior Publication Data

US 2006/0158876 A1 Jul. 20, 2006

Related U.S. Application Data

(62) Division of application No. 10/802,265, filed on Mar. 16, 2004, now Pat. No. 7,264,372.

(51) Int. Cl.
*F21L 4/04* (2006.01)

(52) U.S. Cl. ..... 362/202; 362/188; 362/197; 362/269; 362/419

(58) Field of Classification Search ..... 362/194–195, 362/202–203, 208
See application file for complete search history.

(56) References Cited

U.S. PATENT DOCUMENTS

| | | | | |
|---|---|---|---|---|
| 1,513,211 | A | 10/1924 | Barany | |
| 1,610,289 | A | 3/1926 | Jones | |
| 1,584,539 | A | 5/1926 | Hopkins | 362/188 |
| 1,603,272 | A | 10/1926 | Eaton | |
| 1,608,195 | A | 11/1926 | Barany | |
| 1,638,716 | A | 8/1927 | Surles | |
| 1,644,126 | A | 10/1927 | Harris | |
| 1,680,169 | A | 3/1928 | Osean | 362/188 |
| 1,674,650 | A | 6/1928 | Leser | |
| 1,758,835 | A | 5/1930 | Hime | |
| 1,851,503 | A | 3/1932 | Flamm | |
| 1,932,102 | A | 10/1933 | Eaton | 240/10.69 |
| 2,016,819 | A | 10/1935 | Meginniss | 362/188 |
| 2,097,222 | A | 10/1937 | Tompkins | 362/187 |
| 2,107,599 | A | 2/1938 | Chan | 240/10.69 |
| 2,173,650 | A | 9/1939 | Fullmer | 240/10.69 |
| 2,176,301 | A | 10/1939 | Haas | 123/187 |
| 2,212,103 | A | 8/1940 | Rothenberg et al. | 240/10.69 |
| 2,264,284 | A | 12/1941 | Bassett | 240/10.6 |
| 2,272,907 | A | 2/1942 | Deibel | 240/10.61 |
| 2,339,356 | A | 1/1944 | Sachs | 362/187 |
| 2,490,830 | A | 2/1949 | Norton | 362/184 |
| 2,530,913 | A | 11/1950 | Shackel | 123/187 |

(Continued)

FOREIGN PATENT DOCUMENTS

| | | |
|---|---|---|
| AU | 114558 | 1/1942 |

(Continued)

*Primary Examiner*—Sandra O'Shea
*Assistant Examiner*—Jason Moon Han
(74) *Attorney, Agent, or Firm*—Jones Day

(57) ABSTRACT

An improved flashlight includes a barrel, a light source and a variable length conductor. The barrel contains a plurality of batteries which may be arranged end-to-end. The light source is held in a holder. The variable length conductor is interposed between the plurality of batteries and the light source. The variable length conductor is configured to selectively electrically couple or de-couple the light source and the batteries. The holder of the light source may further be configured to move the light source substantially laterally relative to an axis of the reflector.

19 Claims, 27 Drawing Sheets

U.S. PATENT DOCUMENTS

| | | | | | |
|---|---|---|---|---|---|
| 2,599,295 | A | | 6/1952 | Thomas | 362/205 |
| 2,915,621 | A | | 12/1959 | Garland | 362/205 |
| 2,931,005 | A | | 3/1960 | Saurwein | 362/205 |
| 2,945,944 | A | | 7/1960 | Gillespie | 362/188 |
| 3,014,125 | A | | 12/1961 | Draudt | 240/10.68 |
| 3,076,891 | A | | 2/1963 | Moore | 362/202 |
| 3,314,331 | A | | 4/1967 | Wiley | 313/318.08 |
| 3,469,140 | A | | 9/1969 | Bottone et al. | 313/318.08 |
| 3,622,832 | A | | 11/1971 | Schlessel et al. | 313/315 |
| 3,652,846 | A | | 3/1972 | Starck, II | 240/10.63 |
| 3,997,808 | A | | 12/1976 | Wojtowicz | 313/315 |
| 4,114,187 | A | | 9/1978 | Uke | 362/158 |
| 4,151,583 | A | | 4/1979 | Miller | 362/207 |
| 4,156,271 | A | | 5/1979 | Vercellotti | 362/202 |
| 4,171,534 | A | | 10/1979 | Strowe | 362/183 |
| 4,203,150 | A | | 5/1980 | Shamlian | 362/183 |
| 4,234,913 | A | | 11/1980 | Ramme | 362/158 |
| 4,261,026 | A | | 4/1981 | Bolha | 362/101 |
| 4,286,311 | A | | 8/1981 | Maglica | 362/205 |
| 4,287,448 | A | | 9/1981 | Bradley | 313/318.11 |
| 4,329,740 | A | | 5/1982 | Colvin | 362/184 |
| 4,388,673 | A | | 6/1983 | Maglica | 362/205 |
| 4,398,232 | A | | 8/1983 | Elmore | 362/187 |
| 4,398,238 | A | | 8/1983 | Nelson | 362/184 |
| 4,429,351 | A | | 1/1984 | Petzl | 362/187 |
| 4,464,600 | A | | 8/1984 | Kosmatka et al. | 313/315 |
| 4,472,766 | A | | 9/1984 | Hung | 362/205 |
| 4,495,551 | A | | 1/1985 | Foltz | 362/205 |
| 4,527,223 | A | * | 7/1985 | Maglica | 362/187 |
| 4,531,178 | A | | 7/1985 | Uke | 362/202 |
| 4,570,208 | A | | 2/1986 | Sassmannshausen | 362/188 |
| 4,577,263 | A | | 3/1986 | Maglica | 362/187 |
| 4,581,686 | A | | 4/1986 | Nelson | 362/204 |
| 4,644,220 | A | | 2/1987 | Carley | 313/318 |
| 4,656,565 | A | | 4/1987 | Maglica | 362/187 |
| 4,658,336 | A | | 4/1987 | Maglica | 362/187 |
| 4,695,551 | A | | 9/1987 | Samhaber et al. | 435/292 |
| 4,725,932 | A | | 2/1988 | Gammache | 362/202 |
| 4,733,337 | A | | 3/1988 | Bieberstein | 362/206 |
| 4,777,582 | A | | 10/1988 | Sharrah | 362/202 |
| 4,819,141 | A | | 4/1989 | Maglica et al. | 362/207 |
| 4,841,417 | A | | 6/1989 | Maglica et al. | 362/206 |
| 4,843,526 | A | | 6/1989 | Price, III | 362/187 |
| 4,864,474 | A | | 9/1989 | Maglica | 362/203 |
| 4,888,670 | A | | 12/1989 | Sharrah | 362/205 |
| 4,899,265 | A | | 2/1990 | Maglica | 362/203 |
| 4,942,505 | A | | 7/1990 | Maglica | 362/203 |
| 4,951,183 | A | | 8/1990 | Wang | 362/187 |
| 4,967,325 | A | | 10/1990 | Shiau | 362/188 |
| 5,003,440 | A | | 3/1991 | Maglica | 362/158 |
| 5,113,326 | A | | 5/1992 | Maglica | 362/158 |
| 5,121,308 | A | | 6/1992 | Maglica et al. | 362/187 |
| 5,122,935 | A | | 6/1992 | Peterson | 362/66 |
| 5,126,927 | A | | 6/1992 | Reeves et al. | 362/187 |
| 5,126,972 | A | | 6/1992 | Reeves et al. | 362/187 |
| 5,138,537 | A | | 8/1992 | Wang | 362/187 |
| 5,158,358 | A | | 10/1992 | Maglica et al. | 362/206 |
| 5,207,502 | A | | 5/1993 | Maglica | 362/158 |
| 5,260,858 | A | | 11/1993 | Maglica | 362/205 |
| 5,293,307 | A | | 3/1994 | Maglica | 362/203 |
| 5,349,506 | A | | 9/1994 | Maglica | 362/158 |
| 5,459,649 | A | | 10/1995 | Ellion | 362/187 |
| 5,461,552 | A | * | 10/1995 | Tillery | 362/188 |
| 5,535,107 | A | | 7/1996 | Prok | 362/158 |
| 5,560,705 | A | | 10/1996 | Shiau | 362/188 |
| 5,593,222 | A | | 1/1997 | Maglica | 362/157 |
| 5,601,359 | A | | 2/1997 | Sharrah et al. | 362/204 |
| 5,806,964 | A | | 9/1998 | Maglica | 326/203 |
| 5,826,971 | A | | 10/1998 | Kibler | 362/203 |
| 5,826,972 | A | | 10/1998 | Chiu | 362/205 |
| 5,865,525 | A | | 2/1999 | Kibler et al. | 362/205 |
| 5,959,306 | A | | 9/1999 | Kalley et al. | 250/504 R |
| 5,999,749 | A | * | 12/1999 | Kobayashi et al. | 396/106 |
| 6,074,072 | A | | 6/2000 | Parsons et al. | 362/202 |
| 6,170,960 | B1 | | 1/2001 | Maglica | 362/205 |
| 6,183,106 | B1 | | 2/2001 | Thummel et al. | 362/208 |
| 6,193,389 | B1 | | 2/2001 | Maglica | 362/207 |
| 6,206,539 | B1 | | 3/2001 | Ko | 362/157 |
| 6,347,878 | B1 | | 2/2002 | Shiao | 362/157 |
| 6,386,732 | B1 | | 5/2002 | Shiau | 363/202 |
| 6,722,772 | B2 | | 4/2004 | Maglica | 362/197 |
| 6,726,342 | B1 | | 4/2004 | Lai | 362/188 |

FOREIGN PATENT DOCUMENTS

| | | |
|---|---|---|
| AU | 138873 | 4/1948 |
| FR | 2372382 | 11/1976 |
| GB | 292836 | 6/1928 |
| GB | 411218 | 6/1934 |
| GB | 549104 | 11/1942 |
| GB | 752619 | 7/1956 |
| GB | 812980 | 5/1959 |
| GB | 2107038 | 4/1983 |
| JP | 5-14620 | 11/1930 |
| JP | 14-19704 | 12/1939 |
| WO | WO 93/16323 | 9/1993 |

* cited by examiner

LIGHTING DEVICE WITH VARIABLE LENGTH CONDUCTOR

This is a divisional application of application Ser. No. 10/802,265, filed Mar. 16, 2004 now U.S. Pat. No. 7,264,372 which is incorporated herein by reference.

BACKGROUND

The field of the present invention relates to hand held or portable lighting devices, including flashlights and flashlight components.

Various hand held or portable lighting devices, including flashlight designs, are known in the art. Flashlights typically include one or more dry cell batteries having positive and negative electrodes. In certain designs, the batteries are arranged in series in a battery compartment of a barrel or housing that can be used to hold the flashlight. An electrical circuit is frequently established from a battery electrode through conductive means which are in electrical contact with an electrode of a lamp bulb. After passing through the lamp bulb, the electric circuit continues through a second electrode of the lamp bulb in electrical contact with conductive means, which in turn are in electrical contact with the other electrode of a battery. Incandescent lamp bulbs include a bulb filament. Typically, the circuit includes a switch to open or close the circuit. Actuation of the switch to close the electric circuit enables electricity to pass through the lamp bulb and though the filament, in the case of an incandescent lamp bulb, thereby generating light.

The light generated by a filament is typically reflected by a reflector to produce a beam of light. The filament typically includes a substantial point source of light which is the hottest portion of the filament and generates the most light. The position of the substantial point source of light of the filament relative to the reflector determines the type of beam that emanates from the flashlight.

The production of light from flashlights, which include headlamps, can be degraded by the quality of the reflector used and the optical characteristics of the lens interposed in the beam path. As a result, efforts at improving flashlights have often attempted to address the quality of the optical characteristics of the reflector or the lens. For example, more highly reflective, well-defined reflectors have been found to provide a better-defined focus thereby enhancing the quality of the light beam produced. Additionally, certain advances have been achieved with respect to the lens materials. Another significant factor in-the quality of light produced by a flashlight is the lamp bulb used in the flashlight. Several improvements have been made in the light emitting qualities of lamp bulbs.

Despite such efforts, there is still a need to improve the quality and intensity of the light produced by known hand held or portable lighting devices, including flashlights. The light pattern formed by the beam emanating from such light devices is frequently asymmetrical or elongated in shape which adversely impacts on the quality and intensity of the beam. These beam aberrations generally result from the fact that the flashlight lamp bulb is not properly aligned with the reflector of the assembled flashlight.

In various designs, the lamp bulb is supported within the lighting device by a holder or spacer within a battery compartment or barrel and extends into a reflector. Due to manufacturing and assembly operations and tolerances, however, after manufacture of the lighting device is fully completed, the lamp is typically misaligned with the reflector, resulting in degraded performance.

One attempt at addressing the misalignment of the lamp bulb is described in U.S. Pat. No. 5,260,858, by A. Maglica, which is hereby incorporated by reference. This patent describes a flashlight that includes a switch housing that partially floats within the barrel thereby helping to center the lamp bulb relative to the reflector. Although this patent's attempt to avoid a misalignment of the lamp bulb to the reflector is an improvement over the prior art, simply aligning the lamp bulb relative to the reflector does not ensure that aberrations in the projected light beam will be eliminated. This is because light is mostly emitted from the substantial point source of light of the lamp bulb. Accordingly, the critical component of the lamp that must be aligned relative to the reflector is the substantial point source of light of the lamp bulb.

An attempt at aligning the substantial point source of light of a lamp bulb to the reflector is described in the co-pending application Ser. No. 09/932,443, which is hereby incorporated by reference. This application describes a combination that includes a lamp base that secures a lamp bulb in such a way that the lamp bulb filament is aligned to a predetermined axis extending through the lamp base. The lamp base is then seated in a base receiver mounted adjacent to the reflector in a way that the predetermined axis of the lamp base is aligned to the axis of an axisymmetrical reflector. Although alignment of a lamp bulb filament to the reflector axis is significantly improved in this manner, alternate means to align the lamp bulb filament to the reflector axis are desirable.

Manually maneuvering the lamp bulb to address the misalignment problem is impractical. During operation, the temperature of an illuminating lamp bulb is too high to allow for manual adjustment. Also, the alignment of the substantial point source of light with the reflector is verified by assessing the quality of the light beam emanating from the light device. Accordingly, any attempt to maneuver the lamp bulb from the forward end of the light device will block the light beam and prevent the user from performing a contemporaneous visual assessment of the beam.

The present invention provides an apparatus and method for adjusting and maintaining alignment of the substantial point source of light with a characteristic feature of the reflector. The present invention further provides an apparatus and method for the user to perform a contemporaneous visual assessment of the light beam as the substantial point source of light adjustment is being performed.

Another feature of the present invention relates to the switch design. Switch designs that are adapted to close an electrical path between the lamp bulb and battery, or batteries, in response to axial movement of the head along the barrel and to open the electrical path in response to axial movement in the opposite direction along the barrel are known. While such switches have generally worked well for flashlights that employ smaller batteries of the AA or AAA type, known designs are less suitable for flashlights that employ larger battery sizes, such as C or D size batteries. One reason such designs are not well suited for flashlights employing larger batteries is that the positive electrode of the battery closest to the head end of the flashlight is urged against a conductor mounted flush against the bottom of the switch. As a result, the battery or batteries or the conductor may become damaged in the event that the flashlight is shaken or dropped. The problem also becomes more acute as the number of batteries connected in series increases due to the added weight, and hence momentum, of the multiple batteries.

One attempt at addressing the problem of damage that may occur to the battery or batteries due to physical impact to a flashlight is described in U.S. Pat. No. 5,804,331, by A. Maglica, which is hereby incorporated by reference. Although a protection to the battery electrodes is improved in the manner described in U.S. Pat. No. 5,804,331, alternate means to protect the batteries and other components of a portable lighting device, such as a flashlight, are desirable.

The development of lighting devices having a variable focus, which produces a beam of light having variable dispersion, has also been accomplished. In flashlights, the head assembly is typically rotatably connected to the barrel of the flashlight at the end where the bulb is retained. In addition, the head assembly is adapted to be controllably translatable along the barrel such that the relative positional relationship between the reflector and the lamp bulb may be varied, thereby varying the dispersion of the light beam emanating through the lens from the lamb bulb. While variable focus flashlights have also employed switches that are adapted to open and close in response to the axial movement of the head assembly, such flashlights have generally been limited to flashlights employing AA and AAA batteries for a variety of reasons, including some of those described above.

SUMMARY OF THE INVENTION

The present invention provides a combination for use in positioning a substantial point source of light with a reflector. The substantial point source of light may be along a filament of a lamp bulb. In one embodiment, the combination includes a reflector, lamp bulb, a movable lamp bulb holder and an actuating member. The reflector has a first open end adapted to emit a light beam, a second end, and an axis extending therebetween. A movable lamp bulb holder holds the lamp bulb which extends through the second end of the reflector. The actuating member is operatively coupled to the movable lamp bulb holder for moving the point source of light relative to the axis of the reflector. A holder axis is defined about which the movable lamp bulb holder moves. The actuating member moves the lamp bulb and the substantial point source of light by rotating the lamp bulb holder about the holder axis. The actuating member may be a lever or cam.

The combination may also includes a lock mechanism that is coupled to the actuating member to maintain the position of the substantial point source of light with the reflector axis after the point source of light of the filament has been aligned with the reflector axis. As a result, the combination advantageously maintains the position of the point source of light once it has been moved to a desired position.

In a flashlight, the invention includes a means for adjusting the position of a substantial point source of light relative to a reflector. In one embodiment, the substantial point source of light is along a filament of a lamp bulb. The flashlight includes a barrel, a head assembly, a lamp bulb, a movable lamp holder, an actuating member and an electrical circuit. The barrel retains one or more batteries. The head assembly is adjacent to a first end of the barrel. The head assembly includes a reflector and lens in a mutually fixed relationship. The reflector includes a first open end to emit a light beam, a second end and an axis extending therebetween. The lamp bulb can comprise an incandescent lamp bulb including a filament and the filament typically includes a substantial point source of light. The movable lamp holder holds the lamp bulb extending through the second end of the reflector. The actuating member is operatively coupled to the movable lamp bulb holder for moving the substantial point source of the lamp bulb relative to the reflector axis. The electrical circuit couples the lamp bulb to the battery.

The substantial point source of light of the lamp bulb may be moved in a non-linear path. Further, the flashlight may include means to maintain the position of the point source of light after it is properly aligned with the reflector axis. The flashlight may include an adaptable conductor means in the electrical circuit. As a result, the electrical circuit may be maintained while the point source of light is being moved.

An adjustable focusing means varies the position of the point source of light with respect to the focal point in a direction parallel to the axis of the reflector. The movable lamp holder holds the lamp bulb and maintains the operable connection with the battery. The actuating member is operatively coupled to the movable lamp bulb holder for moving the point source of light of the lamp bulb to a position coaxial with the reflector axis.

The flashlight may also include a curved conductor that is interposed in the electrical circuit and operably connected to an electrode of the lamp bulb. The curved conductor advantageously maintains the operable connection between the lamp bulb electrodes and the battery when the point source of light of the lamp bulb is moved relative to the reflector axis.

In another aspect of the invention, the flashlight includes an improved switch design. A tail cap is removably mounted to the second end of the housing of the flashlight. The tail cap includes a tail cap spring that urges the battery or batteries towards the first end of the housing. The electrical circuit couples the lamp bulb to the battery or batteries. The switch includes a spring biased conductor that is interposed in the electrical circuit between the battery and the lamp bulb. The spring biased conductor advantageously absorbs stresses that might otherwise damage the center electrode of the battery or other flashlight components. As a result, the flashlight is more durable and the components contained in the flashlight and the battery electrode are better protected.

In another aspect of the present invention, a method is provided to align the substantial point source of light of a lamp bulb with the axis of a flashlight reflector. The method includes positioning the point source of light of the lamp bulb relative to a reflector and moving the point source of light from a first position relative to the reflector axis to a second position aligned with the reflector axis, and confirming alignment of the point source of light by visually observing the quality of the light beam and maintaining the aligned position.

The above and other features and advantages of the present invention will become apparent from the following detailed description of a preferred embodiments.

DETAILED DESCRIPTION OF A PREFERRED EMBODIMENTS

Figure 1:
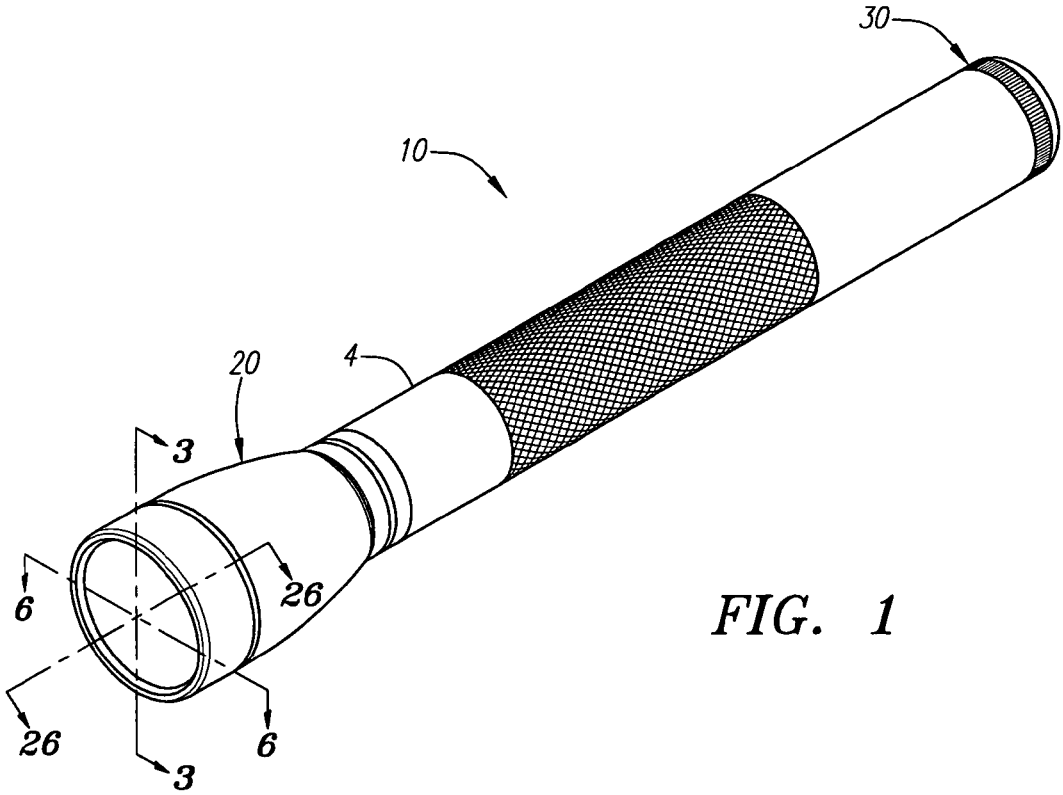
FIG. 1 is a perspective view of a flashlight in accordance with the present invention.

Embodiments of the present invention will now be described with reference to the drawings. To facilitate description, any reference numeral representing an element in one figure will represent the same element in any other figure. Further, in the description of the present invention that is to follow, upper, front, forward or forward facing side of a component shall generally mean the orientation or the side of the component facing the direction toward the front end of the flashlight where the light source is disposed. Similarly, lower, aft, back, rearward or rearward facing side of a component shall generally mean the orientation or the side of the component facing the direction toward the rear of the flashlight where the tail cap is located.

Figure 28:
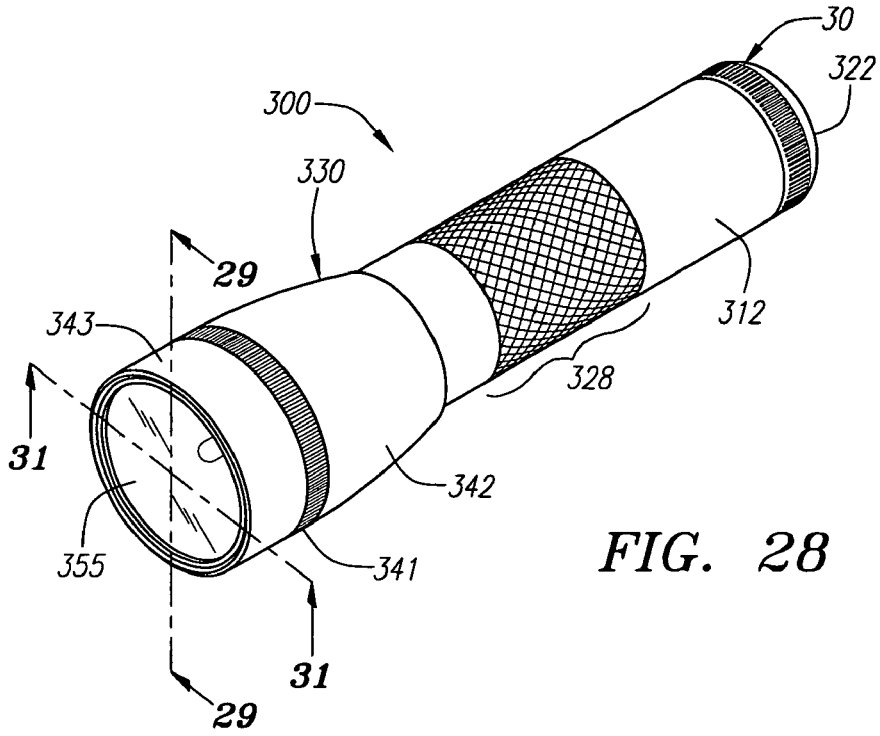
FIG. 28 is a perspective view of another version of a flashlight in accordance with the present invention.

Referring to FIGS. 1 and 28, lighting devices in the form of flashlights 10 and 300, each an embodiment of the present invention, are illustrated in perspective, respectively. Each of flashlight 10 and flashlight 300 incorporates various features of the present invention. These features are described in detail below and illustrated in the accompanying figures for the purpose of illustrating preferred embodiments of the invention. It is to be expressly understood, however, that the present invention is not restricted to the flashlights described herein. Rather, the present invention includes hand held or portable lighting devices that incorporate one or more of the various features of the invention. It is also to be understood that the present invention is directed to each of the inventive features of the lighting devices described below.

Figure 2:
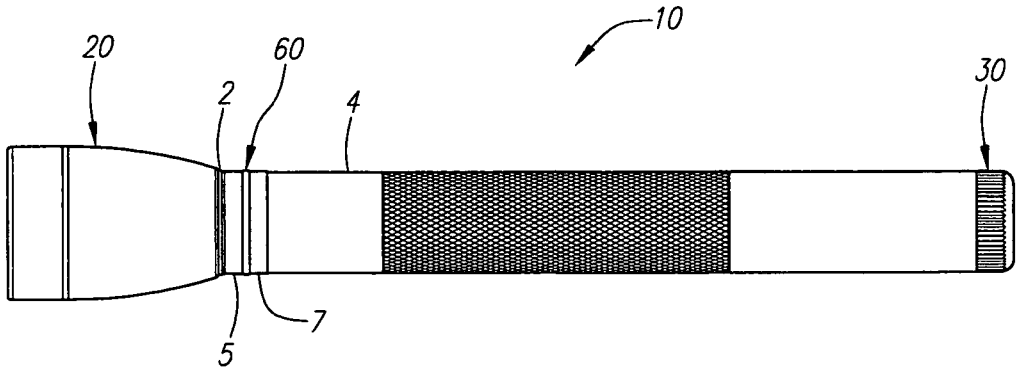
FIG. 2 is a side view of the flashlight of FIG. 1.
Figure 3:
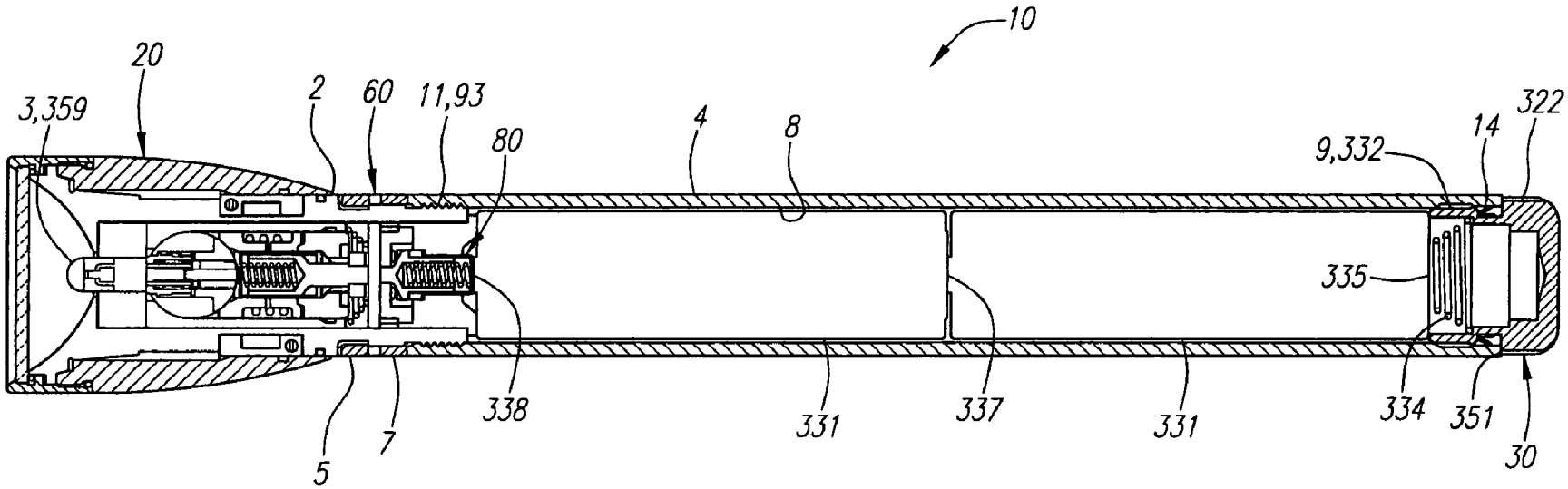
FIG. 3 is a cross-sectional view of the flashlight of FIG. 1 as taken through the plane indicated by 3-3.

Referring to FIGS. 1, 2 and 3, the flashlight 10 includes a head assembly 20, a reflector module 2, a substantial point source of light 3, a barrel 4, and a tail cap assembly 30. The head assembly 20, the reflector module 2, and the substantial point source of light 3 are disposed about the forward end of the barrel 4. The tail cap assembly 30 encloses the aft end of barrel 4. Optionally, a first conducting member 5, a second conducting member 7 and a circuit assembly 60 may be disposed between the reflector module 2 and the barrel 4.

The substantial point source of light 3 may be any suitable device that generates light. For example, the substantial point source of light 3 may be a light emitting diode (LED), an arc lamp or a filament-based incandescent lamp. The substantial point source of light 3 may also be a bi-pin or potted type lamp, or other types as known in the art.

Figure 4:
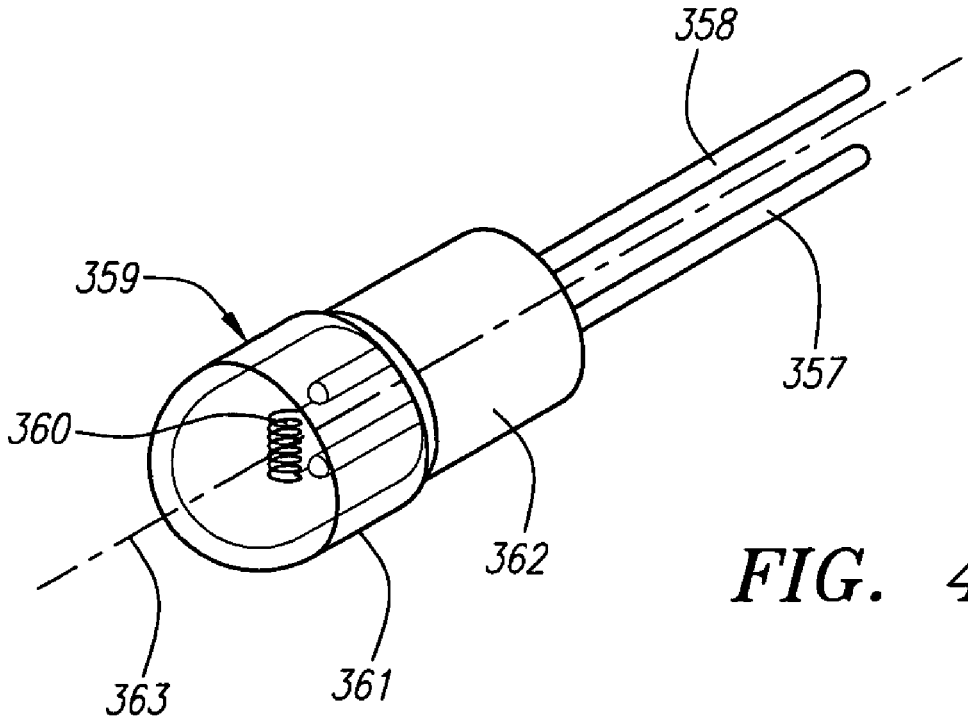
FIG. 4 is a perspective view of an embodiment of an incandescent lamp bulb as viewed from the forward direction.
Figure 5:
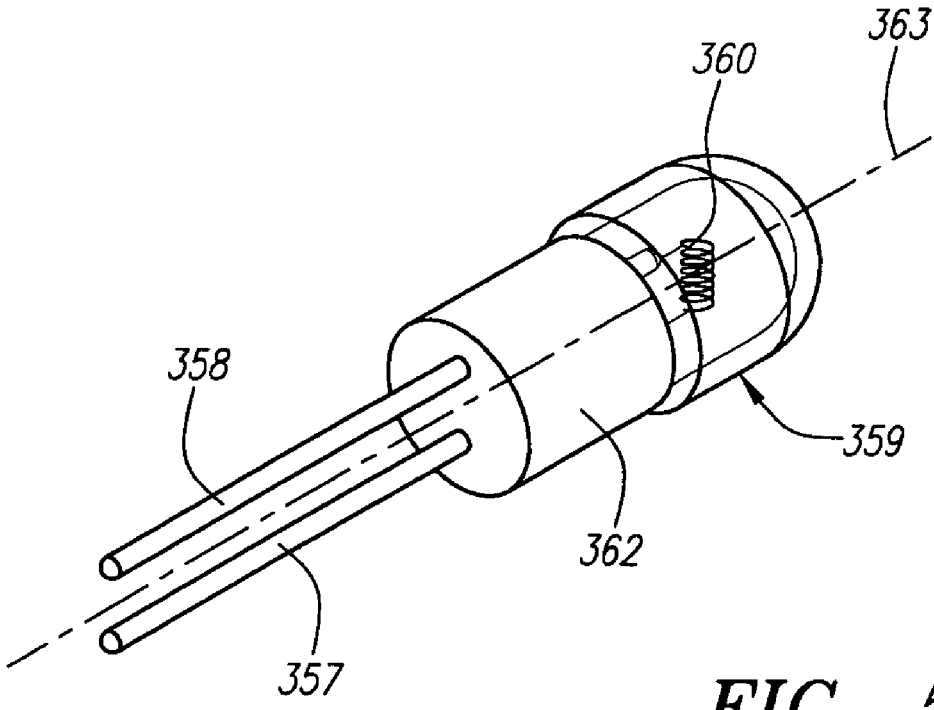
FIG. 5 is a perspective view of the incandescent lamp bulb shown in FIG. 4 as viewed from the rearward direction.

Referring to FIGS. 3, 4 and 5, in an illustrative embodiment, the substantial point source of light 3 is a lamp 359. The lamp 359 includes a bulb portion 361 at one end that contains a light emitting filament 360. The other end of the lamp includes a glass bead 362 for sealing the bulb end. The first and second terminal electrodes 357 and 358 extend through the glass bead and into the bulb portion. In the bulb portion 361, the opposing ends of filament 360 are attached to the ends of electrodes 357 and 358. Preferably, the electrodes extend into the bulb portion substantially parallel and equidistant from the lamp axis 363.

Generally during operation of the lamp 359, there exists a substantial point source of light along the filament that emits a substantial amount of light relative to other points along filament 360. This point is the hottest portion of the filament and is intended to be located at the middle of the overall length of the wire filament extending between the ends of the electrodes. However, this substantial point source of light on the filament is oftentimes not located on the center axis of the lamp or mid-way between electrodes 357 and 358. This may be due to a number of factors. For example, the filament may be more tightly wound at one end versus the other end, thus shifting the point source of the filament closer to the end of one electrode than the end of the other electrode and closer to one side of the lamp.

Even if the filament is uniformly wound, the filament may be attached to electrodes 357, 358 so that the substantial point source is not aligned with the axis of the lamp. Furthermore, even if the substantial point source of the filament 360 is properly positioned equidistant between the ends of the electrodes 357, 358, misalignment may occur if the ends of the electrodes themselves are not exactly equally spaced from the axis 363 of the lamp or if the ends of the electrodes are not properly positioned on a common plane with the central axis 363 of the lamp. These misalignment problems are not unique to filament type lamps and also apply to other substantial point source of light devices, such as, among others, LED's and arc lamps.

Flashlight 10, among other things, includes a movable holder that facilitates moving and aligning the substantial point source of light 3 with characteristic features of a reflector to improve the performance of a flashlight. In particular, in an illustrative embodiment, the movable holder holds the substantial point source of light relative to a reflector's axis and is rotatable about an axis that is not coincident with the reflector's axis. Preferably, the movable holder is rotatable about at least two axes of rotation. Those skilled in the art will appreciate that a movable holder that is rotatable about two axes, wherein the second axis is oriented perpendicular to the first axis, will result in a substantial point source of light displacement range that is generally two-dimensional. Flashlight 10, therefore, includes a feature of aligning the point source of light with a characteristic axis of a flashlight reflector. Flashlight 10 also includes a feature for moving the substantial point source of light along the axis of the reflector and aligning it to the focal point of the reflector. It should be noted that the present invention is not limited by the specific manner in which the substantial point source of light is moved or displaced.

Referring to FIG. 3, the housing or barrel 4 houses at least one source of energy, such as for example a battery. In the illustrative embodiment, two batteries 331 are disposed in the barrel 4 in a series arrangement. It will be appreciated by those skilled in the art, however, that barrel 4 may also be configured to include a single battery, a plurality of two or more batteries, or other suitable portable source of energy in either a series or a side-by-side parallel arrangement. Furthermore, while batteries 331 may comprise any of the known battery sizes, flashlight 10 according to the illustrative embodiment is particularly suited for C or D sized batteries. Moreover, although the present invention is not limited to the type of batteries, the batteries housed in flashlight 10 are preferably rechargeable type batteries, such as Lithium Ion, Nickel Metal Hydride or Nickel Cadmium cells.

Referring to FIG. 3, the barrel 4 includes an inner surface 8, a back threaded portion 9, and a front threaded portion 11. The back threaded portion 9 releasably engages the barrel 4 with the tail cap assembly 30. The front threaded portion 11 releasably engages with the reflector module 2. The forward face of the barrel 4 is disposed adjacent to the second conducting member 7.

The tail cap assembly 30 of the illustrative embodiment includes a tail cap 322 and conductive spring member 334. Tail cap assembly 30 may include a removable spare lamp holder disposed in a cavity that opens to the end of the tail cap that engages barrel 4. Removable spare lamp holder may include an inner hub that frictionally retains a spare lamp. Spokes from the hub may extend to an outer hub in frictional contact with the inner surface of the cavity formed in the tail cap 322 to prevent damage to the spare lamp.

Tail cap 322 preferably includes a region of external threading 332 for engaging matching back threaded portion 9 formed on the interior of the barrel 4. However, other suitable means may also be employed for attaching tail cap 322 to barrel 4 such as, for example, spring clips. A sealing element 14 may be provided at the interface between the tail cap 322 and the barrel 4 to provide a watertight seal. In a preferred embodiment, the sealing element 14 is a one-way valve that is oriented so as to prevent flow from outside into the interior of the flashlight 10, while simultaneously allowing overpressure within the flashlight to escape or vent to the atmosphere. However, as those skilled in the art will appreciate, the sealing element 14 may be other suitable sealing devices such as an O-ring.

The external threading 332 of the tail cap 322 that mates with the barrel 4 may be provided with a flattened top so as to create a spiral passage through the mating threads between the barrel 4 and the tail cap 322. Additionally, radial spines may be formed in a mating face 351 of the tail cap 322 to ensure that the end of barrel 4 does not provide a gas tight seal against the adjacent flange, thereby impeding the flow of overpressure gases from the interior of the flashlight.

The design and use of one-way valves in flashlights is more fully described in U.S. Pat. No. 5,113,326 to Anthony Maglica, which is hereby incorporated by reference.

Referring to FIG. 3, when the tail cap assembly 30 is installed onto the barrel 4, the spring member 334 forms an electrical path between the case electrode 335 of the rear battery 331 and the tail cap 322. An electrical path is further formed between the tail cap 322 and the barrel 4 through, for example, the face 351 and/or the mating threads.

The spring member 334 also urges the batteries 331 forward towards the front of the flashlight 10. As a result, the center electrode 337 of the rear battery 331 is in electrical contact with the case electrode of the forward battery 331, and the center electrode 338 of the forward battery 331 is urged into contact with a spring biased lower contact assembly 80 disposed about the forward end of the flashlight 10.

Figure 6:
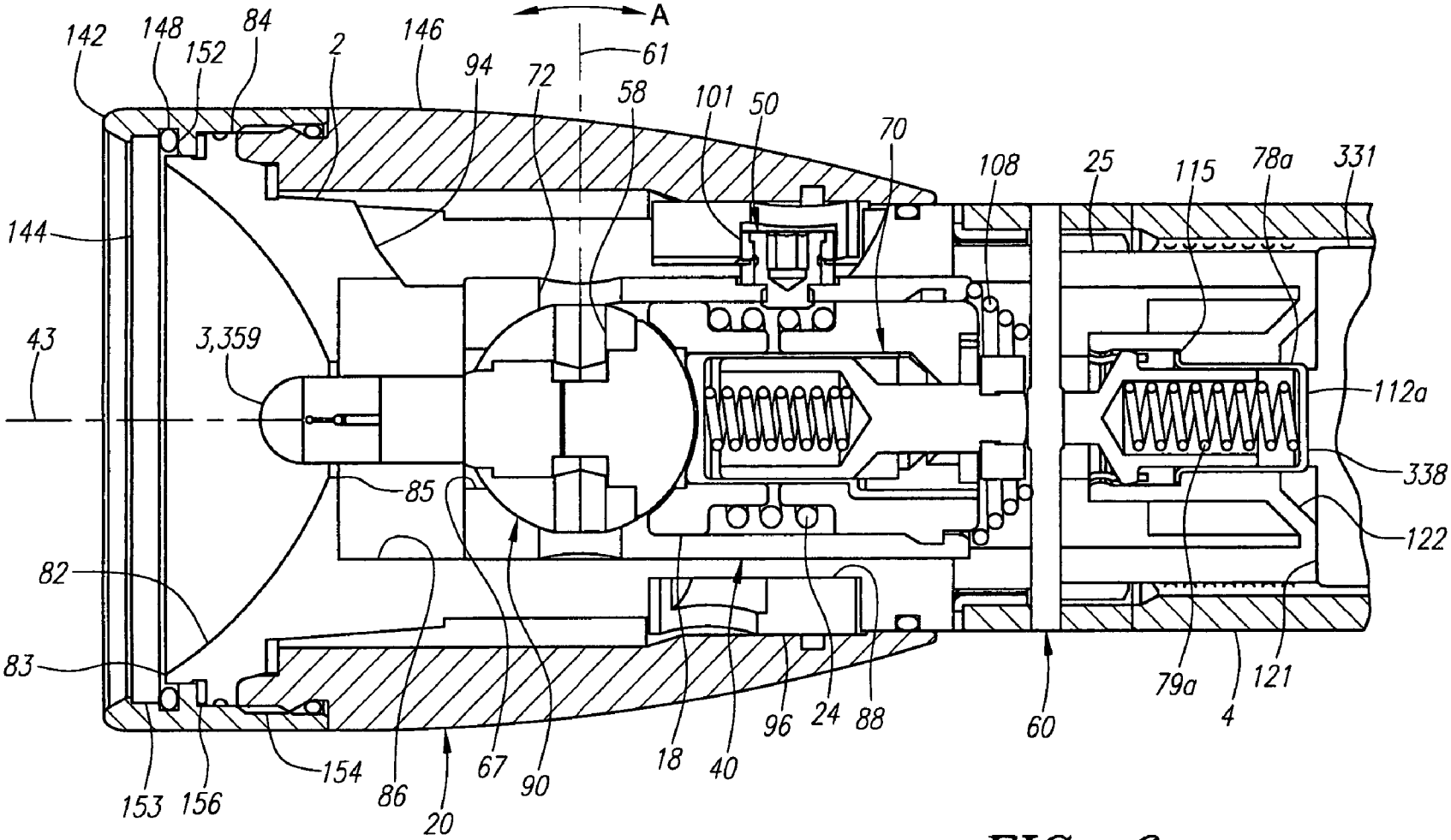
FIG. 6 is an enlarged cross-sectional view of the front end of the flashlight of FIG. 1 as taken through the plane indicated by 6-6.

As shown in FIG. 6, the reflector module 2 is mounted in a fixed relationship to the forward end of the barrel 4. The reflector module 2 generally contains a movable assembly 40, a lower insulator 25 and the circuit assembly 60.

Figure 7:
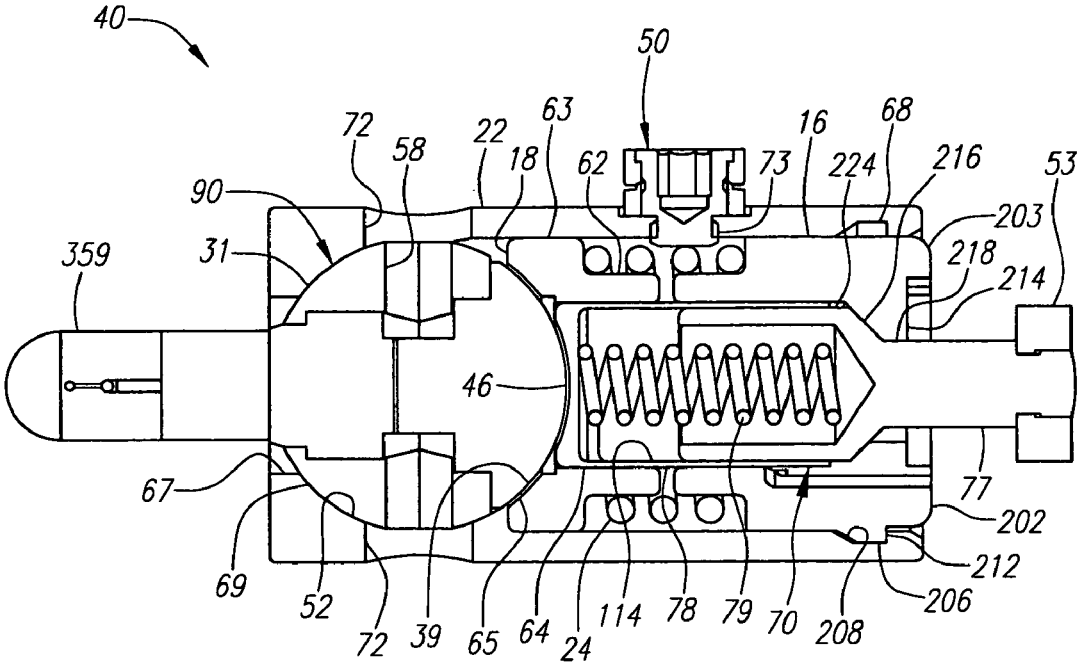
FIG. 7 is a cross-sectional view of a movable assembly of the flashlight of FIG. 1.

FIG. 7 illustrates the movable assembly 40 in isolation. The movable assembly 40 embodies several aspects of the present invention. Among other things, the movable assembly 40 facilitates aligning the substantial point source of light 3 with the axis or the focal point of the reflector. The movable assembly 40 also includes features that facilitate the point source of light to displace while maintaining electrical contact with a source of energy to allow the user to visually critique the quality of the light beam emanating from the flashlight during the filament alignment process.

The movable assembly 40 includes an end cap 16, sleeve retainer 18, a holder housing 22, an upper spring member 24, a cam follower assembly 50, an upper contact assembly 70, and a movable holder assembly 90.

Figure 8:
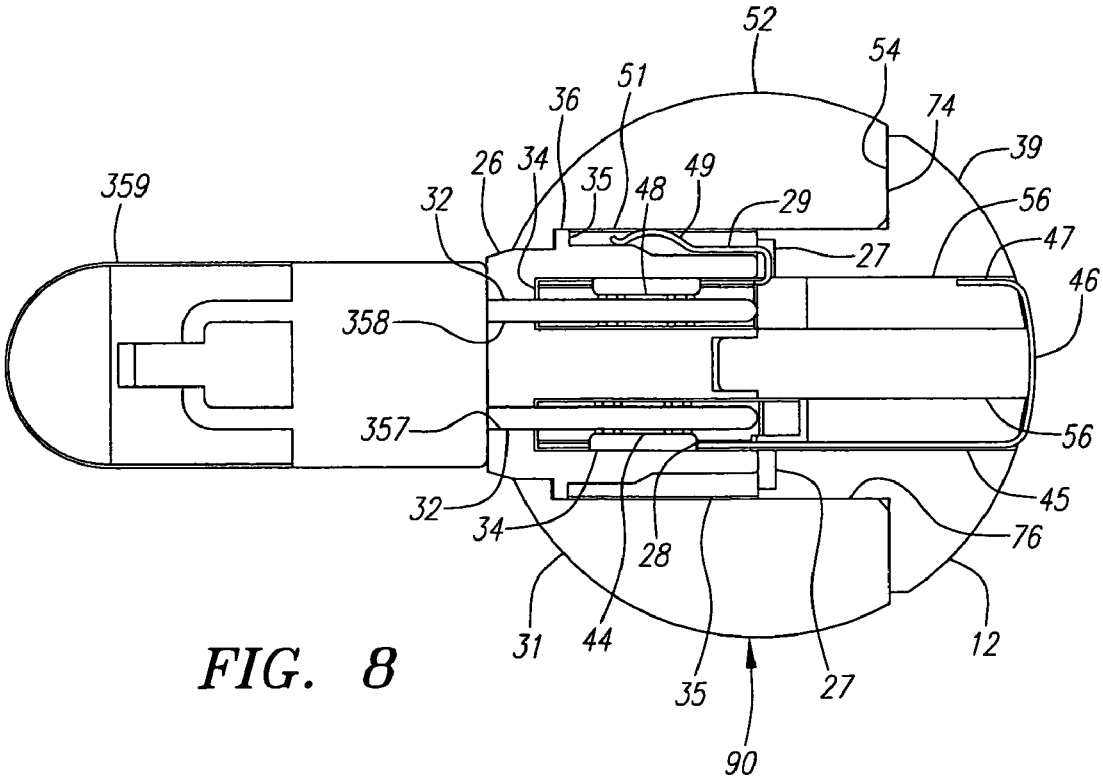
FIG. 8 is a cross-sectional view of a movable holder assembly of the flashlight of FIG. 1.

Referring to FIG. 8, the movable holder assembly 90, among other things, holds the lamp 359 and is movable relative to a flashlight reflector. The movable holder assembly 90 may take the form of other configurations that may receive a light source and move in response to actuating pressure. Also, although the illustrative embodiment shown in FIG. 8 is an assembly, the movable holder assembly 90 may be an integral structure having the necessary features. In the illustrative embodiment, the movable holder assembly 90 includes a forward contact holder 26, an aft contact holder 12, a positive electrode contact 28, a negative electrode contact 29, and a ball housing 31.

Figure 9:
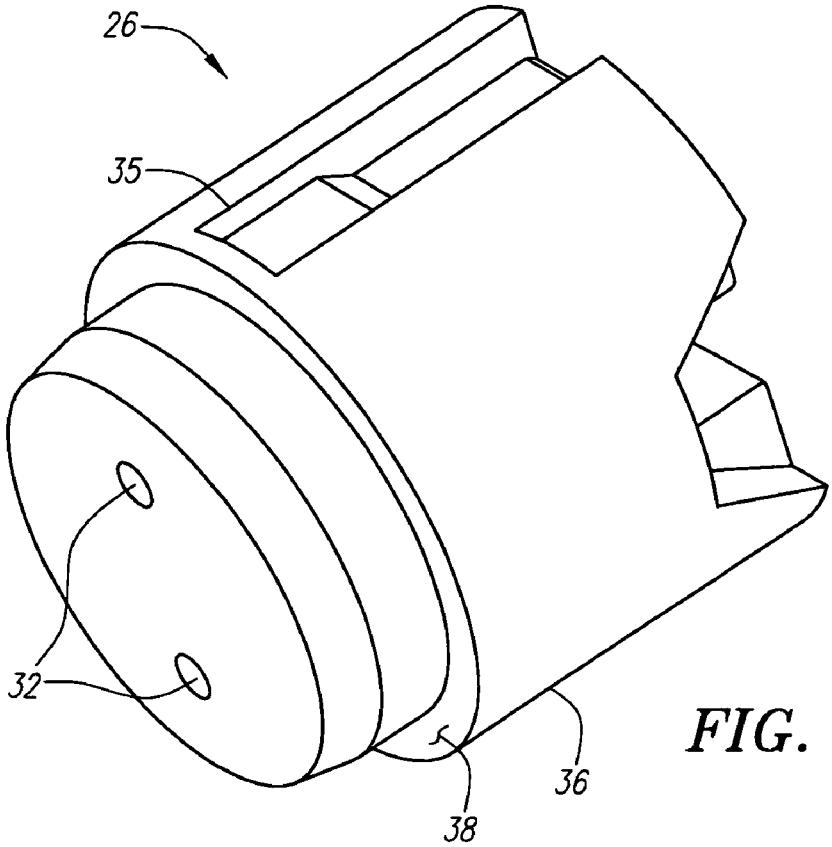
FIG. 9 is a perspective view of a front contact holder.
Figure 10:
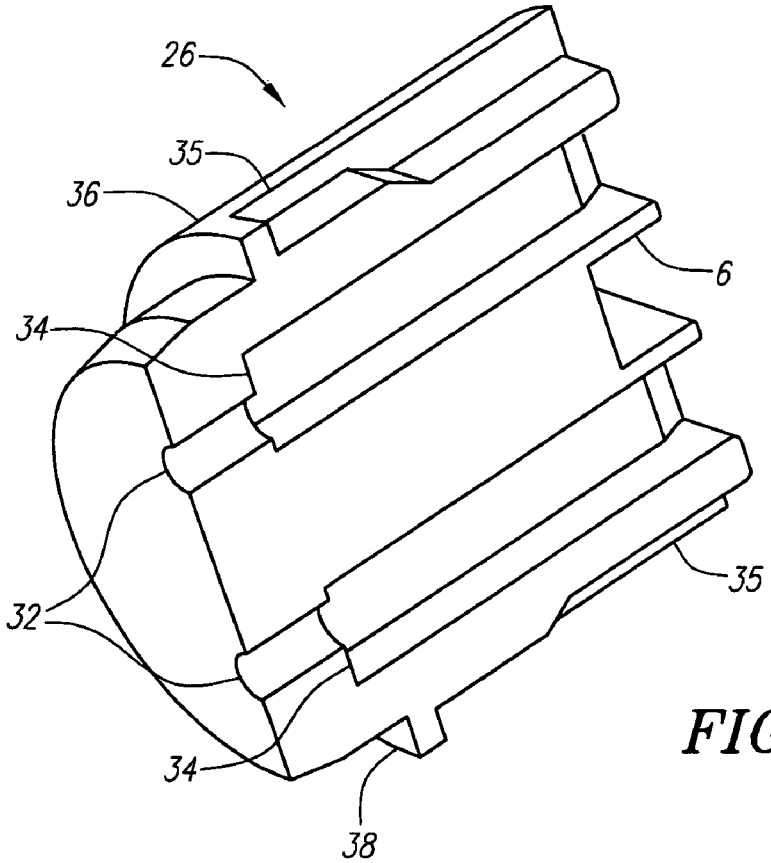
FIG. 10 is a perspective view of a sectioned front contact holder of FIG. 9.

FIG. 9 illustrates a perspective view of the forward contact holder 26. FIG. 10 illustrates a perspective view of a cross section of the forward contact holder 26. The forward contact holder 26 includes a set of cavities that are sized to contain a portion of the positive electrode contact 28 and the negative electrode contact 29. The forward contact holder 26 includes a pair of apertures 32, a pair of contact cavities 34, a pair of contact slots 35, an alignment groove 6, an outer diameter 36, and a shoulder 38. The apertures 32 are through holes that extend from the front of the forward contact holder 26 and each communicates with one of the pair of contact cavities 34. In the illustrative embodiment, the contact cavities 34 are rectangular cavities that extend to the aft end of the forward contact holder 26. In a preferred embodiment, the forward contact holder 26 is made from a non-conductor, such as plastic.

Figure 11:
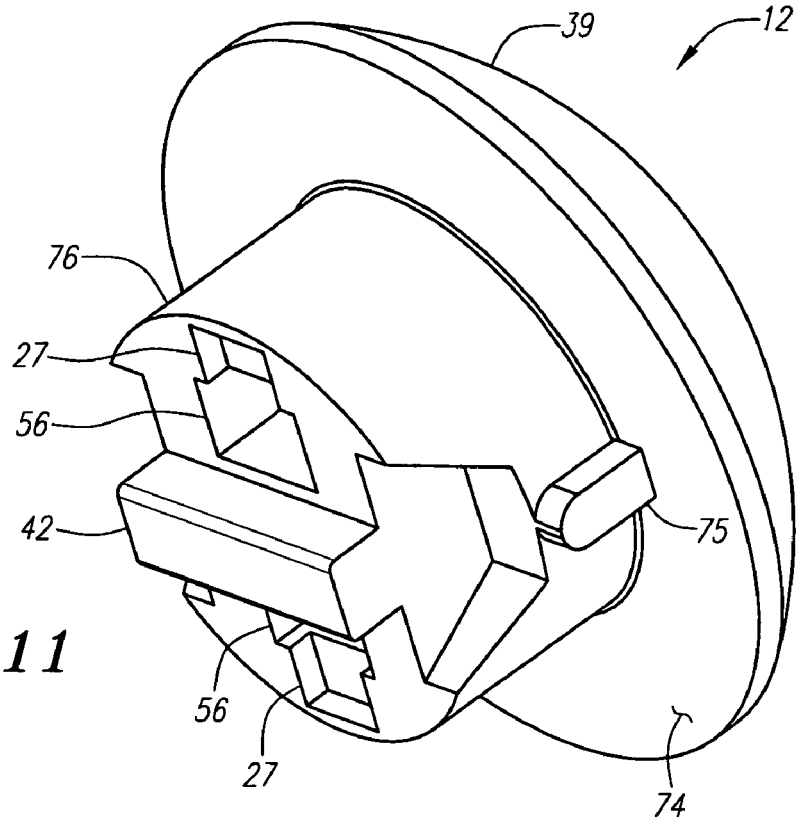
FIG. 11 is a perspective view of an aft contact holder.
Figure 12:
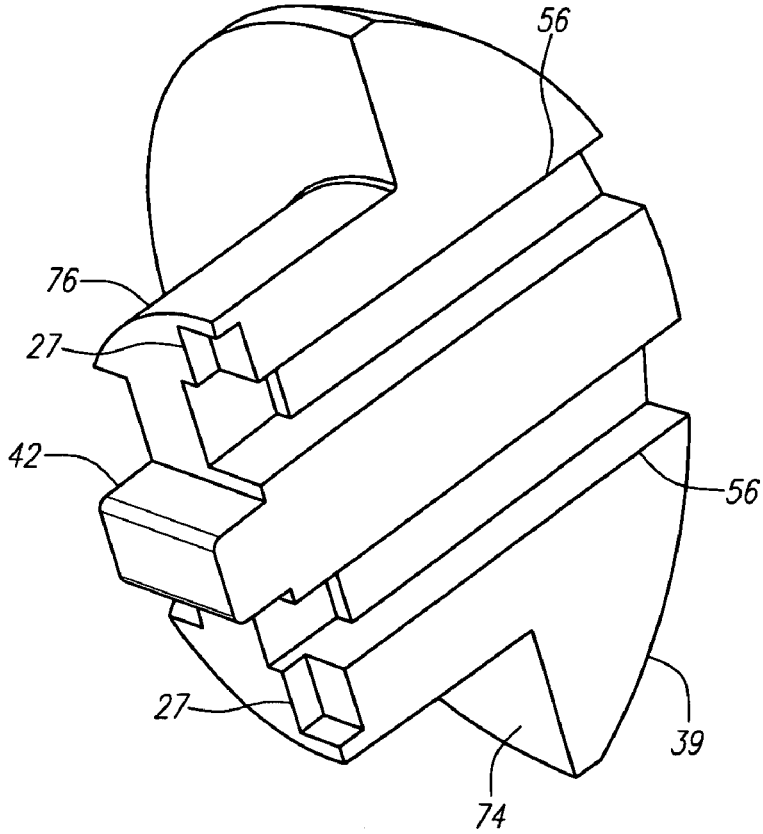
FIG. 12 is a perspective view of a sectioned aft contact holder of FIG. 11.

Referring to FIG. 8, the aft contact holder 12 is disposed adjacent to the aft end of the forward contact holder 26. FIG. 11 illustrates a perspective view of the aft contact holder 12. FIG. 12 illustrates a perspective view of a cross section of the aft contact holder 12. The aft contact holder 12 includes a pair of aft contact cavities 56, a pair of relief slots 27, a back profile 39, an alignment tab 42, an aft shoulder 74, and an aft outer diameter 76. The alignment tab 42 is sized to correspond with the alignment groove 6 of the forward contact holder 26 and align the respective cavities of the forward and aft contact holders. The back contour 39 is preferably a segment of a sphere. The aft contact cavities 56 are sized and arranged to extend the contact cavities 34 of the forward contact holder 26. The aft outer diameter 76 corresponds to the outer diameter 36 of the forward contact holder 26. In a preferred embodiment, the aft contact holder 12 is made from a non-conductor, such as plastic.

Figure 13:
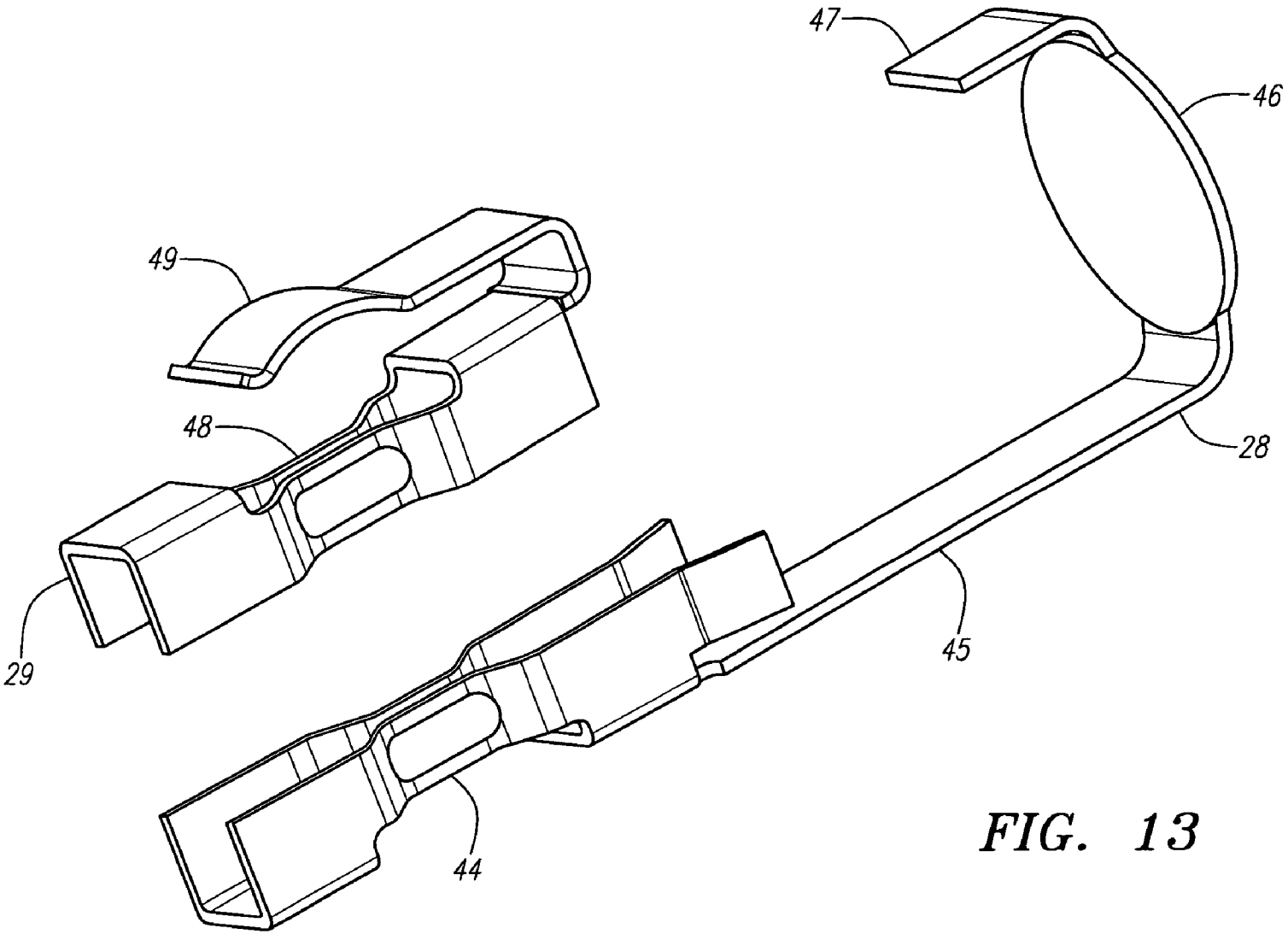
FIG. 13 is a perspective view of a positive electrode contact and a negative electrode contact.

Referring to FIGS. 8 and 13 the positive electrode contact 28 is disposed in a cavity defined by one of the contact cavities 34 and aft contact cavity 56 of the forward and aft contact holders 26, 12, respectively. The positive electrode contact 28 includes a neck 44, a contact extension 45, a contact base 46 and a tab 47. The neck 44 is configured to frictionally receive the electrode 357 of the lamp 359. The contact extension 45 is sized to extend the positive electrode contact 28 to the aft of the aft contact holder 12. The contact base 46 is generally circular and is configured to conform to the back contour 39 of the contact holder 26. The tab 47 of the positive electrode contact 28 is folded into the other aft contact cavity 56.

Still referring to FIGS. 8 and 13, the negative electrode contact 29 is disposed in a second cavity defined by one of the contact cavities 34 and relief slot 27 of the forward contact holder 26, and the aft contact cavity 56 of the aft contact holder 12. The negative electrode contact 29 includes a neck 48 and a curved arm 49. The neck 48 is configured to frictionally receive the lamp electrode 358. The negative electrode contact 29 is formed to extend out of the contact cavity 34, through the relief slot 27, and into the cavity slot 35 wherein the curved arm 49 may project beyond the outer diameter 36 of the forward contact holder 26.

In a preferred embodiment, the positive electrode contact 28 and the negative electrode contact 29 are made from a sheet of a conductor material that is formed to an hour glass shape having a neck 44, 48 as illustrated in FIG. 13. The neck 44, 48 of the electrode contacts illustrates one way of frictionally receiving an electrode to establish an electrical connection thereto, other suitable methods of establishing an electrical connection is well known to those skilled in the art. To facilitate the shaping/forming of the sheet of conductor material, relief cuts in the conductor sheet may be employed. In a preferred embodiment, the electrode contacts are made from a sheet of copper.

Referring to FIG. 8, the extended outer diameter defined by outer diameter 36 and aft outer diameter 76 of the forward contact holder 26 and the aft contact holder 12, respectively, interfaces with a bore 51 of the ball housing 31.

Figure 14:
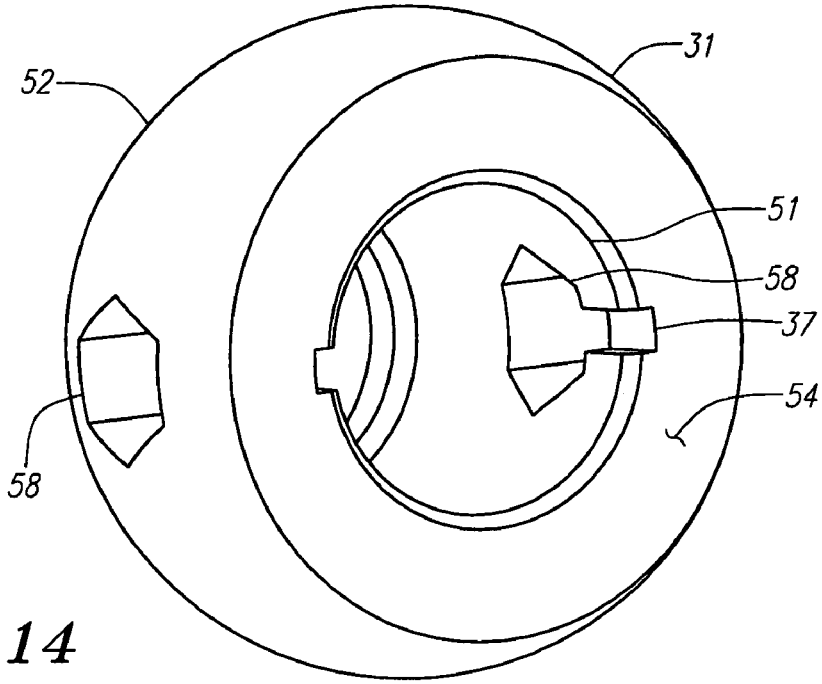
FIG. 14 is a perspective view of a ball housing.

Referring to FIG. 14, the ball housing 31 includes the bore 51, an outer profile 52, a back face 54, and a pair of sockets 58. In the illustrative embodiment, the bore 51 is substantially perpendicular to the back face 54. The outer profile 52 is spherical and extends from the back face 54 symmetrically relative to the bore 51. Each of the pair of sockets 58 extend substantially perpendicular from the axis of the bore 51 and through the spherical outer profile 52. In a preferred embodiment, the ball housing 31 is a conductor such as, for example, aluminum.

The socket 58 of the ball housing 31 is an actuation interface that is adapted to receive an actuating member to move the movable holder assembly 90. In the illustrative embodiment, the socket 58 has a hexagonal form.

Referring to FIG. 8, the extended outer diameter defined by the outer diameters 36, 76 of the forward and aft contact holders 26, 12 is secured in the bore 51 of the ball housing 31 by an interference fit. To enhance the interference fit a key 75 disposed about the outer diameter 76 of the aft contact holder 12 may be included, as shown in FIG. 11. The ball housing 31 may have a corresponding mating slot 37 as shown in FIG. 14. It should be appreciated by those ordinarily skilled in the art that other suitable fastening methods, such as use of adhesives, pins, screws, clips, or bands may also be employed.

Also, as shown in FIG. 8, because the curved arm 49 of the negative electrode contact 29 is configured to project beyond the outer diameter 36 of the front contact holder 26 in the radial direction, the curved arm 49 frictionally engages with the bore 51 of the ball housing 31 when the ball housing 31 is assembled with the contact holders 26, 12. In this way, the illustrative embodiment discloses one way of providing an electrical connection between the negative electrode contact 29 and the ball housing 31.

Still referring to FIG. 8, the back face 54 of the ball housing 31 bears against the shoulder 74 of the aft contact holder 12. Preferably, the ball housing 31 and the aft contact holder 12 are configured such that when assembled, the spherical segment outer profile 52 of the ball housing 31 and the spherical segment back profile 39 of the aft contact holder 12 substantially form a common and continuous spherical surface.

The lamp 359 is received by the movable lamp holder assembly 90 through apertures 32. The lamp electrodes 357, 358 extend through the apertures 32 and frictionally engage with the necks 44, 48 of the positive electrode contact 28 and the negative electrode contact 29, respectively. This illustrative embodiment discloses one way of holding and making electrical connections to a lamp 359. It should be evident to those skilled in the art that other configurations may be employed to receive the lamp 359 and make electrical connections to the lamp electrodes 357, 358.

Referring to FIG. 7, the movable holder assembly 90 is shown in the holder housing 22 of the movable assembly 40 in relation to the end cap 16, the sleeve retainer 18, the upper spring member 24 and the upper contact assembly 70. In the illustrative embodiment, a profiled contour of the holder housing 22, the sleeve retainer 18 and the upper contact assembly 70 together define an envelope in which the movable holder assembly 90 moves.

Referring to FIG. 7, the holder housing 22 is generally a hollow cylindrical structure that includes a clearance hole 67, a profiled contour 69, a pair of access holes 72, a cam follower receiver 73 and a snap-in groove 68. The clearance hole 67 is disposed on the forward end of the holder housing 22 and extends to the profiled contour 69. The clearance hole 67 is sized to provide clearance for the outer diameter 36 of the movable holder assembly 90 and the lamp 359 and to accommodate the range of motion of the movable holder assembly 90. The profiled contour 69 generally blends with the inside diameter of the holder housing 22 and corresponds to the outer profile 52 of the ball housing.

In the illustrative embodiment, the cam follower receiver 73 of the holder housing 22 is a threaded port. The pair of access holes 72 are generally disposed 180° apart and each extends through the wall of the holder housing 22. The snap-in groove 68 is disposed towards the aft of the holder housing 22 and includes a forward side that is tapered and a back side that is generally perpendicular to the axis of the holder housing 22. In a preferred embodiment, the holder housing 22 is a conductor such as, for example, aluminum.

Still referring to FIG. 7, the sleeve retainer 18 includes a cylindrical aft section 62, a flange 63 and a through hole 64. The forward side of the flange 63 includes a mating profile 65 that generally conforms to the back contour 39 of the movable holder assembly 90. In the illustrative embodiment, the mating profile 65 is a spherical segment. In a preferred embodiment, the sleeve retainer 18 is a non-conductor such as, for example, plastic.

Figure 15:
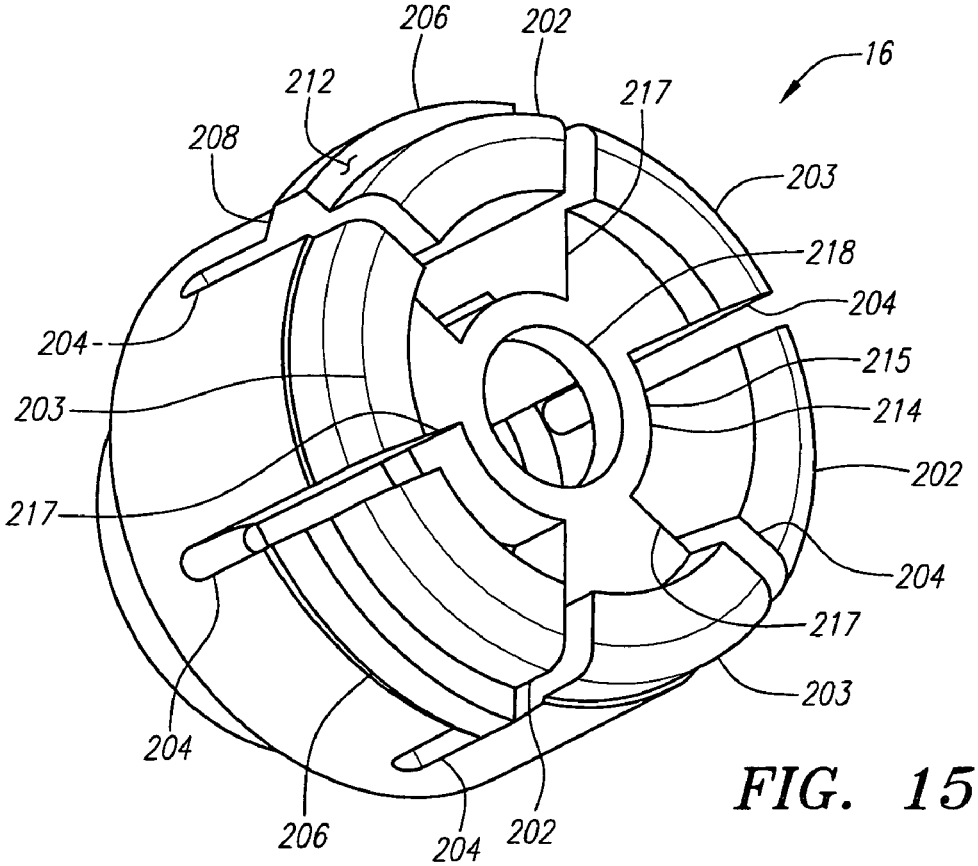
FIG. 15 is a perspective view of an end cap.

Referring to FIGS. 7 and 15, the end cap 16 is generally a hollow cylindrical structure that includes three flexible segments 202 and three stiffened segments 203 alternately arranged about its aft end. In the embodiment illustrated, each of the segments 202, 203 are defined by six relief slots 204 equally spaced in the circumferential direction. On each of the three flexible segments 202 is an outer tab 206. Each outer tab 206 includes a forward end taper 208 and a back face 212. The back face 212 is generally perpendicular to the axis of the end cap 16. Connected to each of the stiffened segments 203 is an inner support 214. The inner support 214 includes a hub 215 with three spokes 217. Each spoke extends to one of the three stiffened segments 203. The hub 215 includes a support taper 216 on the forward facing side and an inner diameter 218.

The end cap 16 has an outer diameter that corresponds to the inner diameter of the holder housing 22. Because of the relief slots 204, the flexible segment 202 may flex sufficiently inward when the end cap 16 is assembled with the holder housing 22. Each outer tab 206 fits into the snap-in groove 68 of the holder housing 22 and is sized such that the back face 212 bears against the aft face of the snap-in groove 68. In a preferred embodiment, the end cap is a non-conductor such as, for example, plastic.

Referring to FIG. 7, the upper contact assembly 70 is a spring biased conductor that provides an energy path to the movable holder assembly 90. The upper contact assembly 70 includes a contact post 77, a contact receptacle 78 and a contact spring 79.

Figure 16:
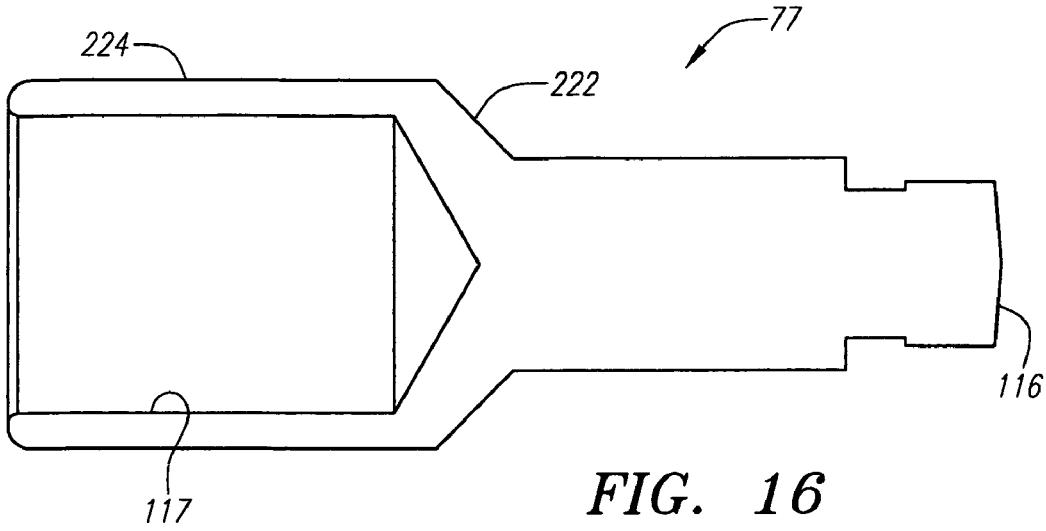
FIG. 16 is a cross-sectional view of a post contact.

Referring to FIG. 16, the contact post 77 includes a contact end 116, a blind hole 117, an outer taper 222 and a front outer diameter 224. In having a blind hole 117, the contact post 77 is similar to a receptacle. The blind hole 117 is sized to receive the contact spring member 79. In a preferred embodiment, the contact spring member 79 extends out of the blind hole 117 and bears against the contact receptacle 78.

Figure 17:
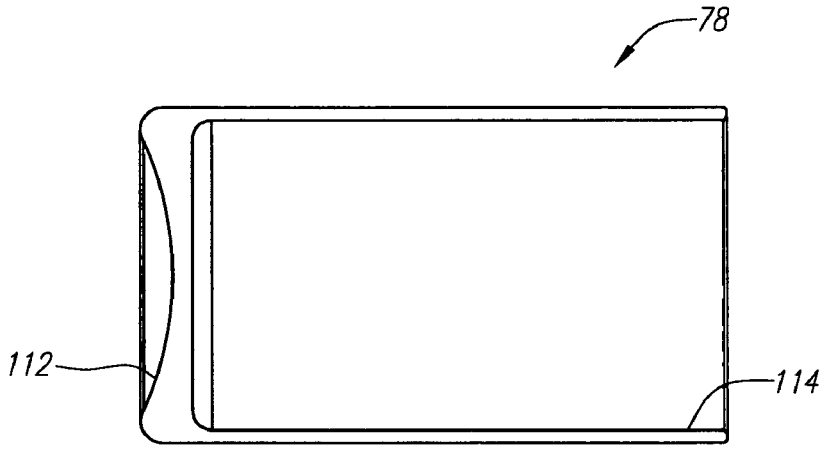
FIG. 17 is a perspective view of a receptacle contact.

Referring to FIG. 17, the contact receptacle 78 is an open-ended receptacle including an end contact 112 and an inside diameter 114. In the preferred embodiment, the end contact 112 has a spherical profile to match the contour of the contact base 46 that conforms to the back contour 39 of the movable holder assembly 90.

Referring to FIG. 7, to assemble the upper contact assembly 70, the contact receptacle 78 is fitted over the contact post 77 with the contact spring member 79 contained therebetween. The front outer diameter 224 of the contact post 77 and the inside diameter 114 of the contact receptacle 78 are sized so that the components may relatively slide axially without significant side-to-side movement. Because the upper contact assembly 70 provides an electrical path to the movable holder assembly 90 and to the substantial point source of light in the form of a lamp 359, the contact post 77, contact receptacle 78 and the contact spring member 79 are preferably a conductor, such as for example aluminum or copper.

To assemble the movable assembly 40, the movable holder assembly 90 is installed such that its outer profile 52 of the ball housing 31 bears against the profiled contour 69 of the holder housing 22. The movable holder assembly sockets 58 are aligned with the holder housing access holes 72. The sleeve retainer 18 is installed to have its mating profile 65 bear against the back contour 39 of the movable holder assembly 90. The upper spring member 24 is disposed over the sleeve retainer's cylindrical aft section 62 and against the aft side of the sleeve retainer flange 63. The upper contact assembly 70 is slidably positioned in the sleeve retainer's through hole 64 to make an electrical connection with the contact base 46 of the positive electrode contact 28. The end cap 16 is installed to secure and contain the components. The cam follower assembly 50 may be secured to the cam follower receiver 73 on the holder housing 22. An insulator ring 53 may also be secured to the aft end of the contact post 77.

Arranged this way, the upper spring member 24 is contained between the sleeve retainer 18 and the end cap 16. The housing holder snap-in groove 68 prevents the end cap 16 from moving aft once the outer tabs 206 have snapped into the snap-in groove 68. The aft travel of the contact post 77 is limited because the contact post's taper 222 bears against the support taper 216 of the end cap 16. The upper spring member 24 and the contact spring 70 serve to maintain the desired component relationship. Accordingly, the movable assembly 40 is described wherein the assembly of its internal components is accomplished by snap-fit.

The inventive features of the embodiment described herein are not limited by the specific mode of assembly, and other suitable fastening schemes may be utilized. For example, press-fitting, crimping, or using adhesives may be employed to secure or assemble the end cap 16 to the holder housing 22. However, among other things, the combination of components assembled by snap-fitting as described above provides component assembly that eases manufacturing and reduces cost because assemblies may be completed without the need for holding tight tolerances as demanded by press fit or interference fit, and without the need for special tooling as demanded by a crimping operation.

Figure 18:
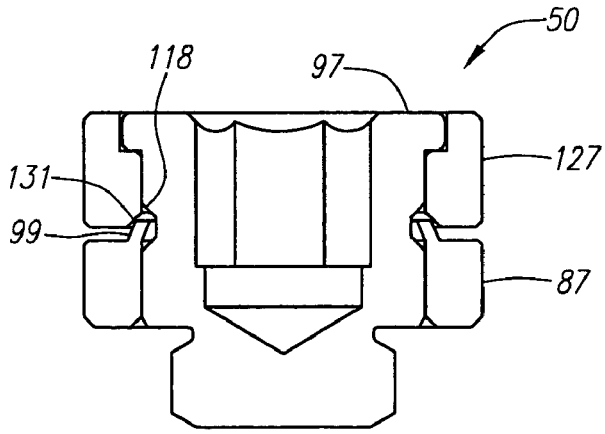
FIG. 18 is a cross-sectional view of a cam follower assembly.

Referring to FIG. 18, the cam follower assembly 50 includes a shoulder screw 97, a cam follower 127 and a bushing 87. The shoulder screw 97 includes a circumferential groove 118 disposed on its head. The cam follower 127 is generally a sleeve with a counterbore on one end and a chamfer 131 on the second end. The bushing 87 is generally a hollow cylinder with an upper lip 99 having a reduced wall thickness at one end of the cylinder. To assemble, the counterbore of the cam follower 127 is positioned adjacent to the flange of the head of the shoulder screw 97. With-the cam follower 127 in place, the bushing 87 is secured to the shoulder screw 97 by crimping the upper lip 99 into the circumferential groove 118. The chamfer 131 of the cam follower 127 facilitates in the crimping step by guiding the upper lip 99 into the groove 118. By properly sizing the height of the cam follower 127, the cam follower 127 and the bushing 87 are free to rotate about the shoulder screw 97 after the bushing 87 is installed. The free rotation of the details advantageously facilitates smooth advancement of the cam follower 127 and/or the busing 87 against a cam or a guide and reduces wear to the adjacent parts. Also, because the bushing 87 retains the cam follower in place, the handling and installation of the cam follower assembly 50 is simplified. Other suitable cam follower configuration may also be utilized in conjunction with the various inventive aspects as described herein. For example, the cam follower assembly 50 may be a simple shoulder screw.

Referring to FIG. 6, the movable assembly 40 is shown installed in the flashlight 10 and disposed in the reflector module 2. The reflector module 2 includes many features. Generally, the reflector module 2 includes a reflector on its forward end, a housing portion to contain the movable assembly 40 about its mid-section, and a support structure to contain optional electronics on its aft end.

Figure 19:
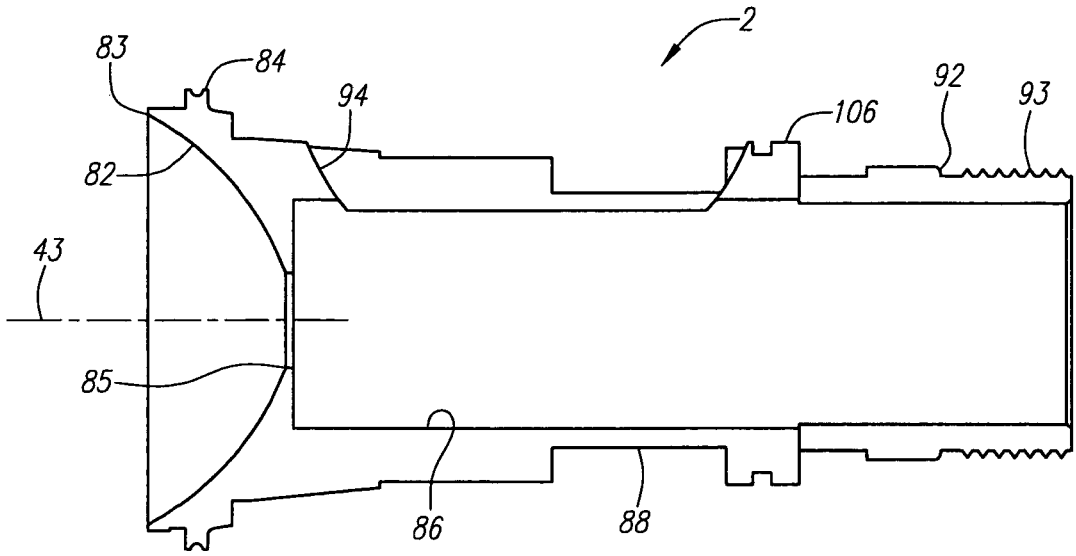
FIG. 19 is a cross-sectional view of a reflector module.
Figure 20:
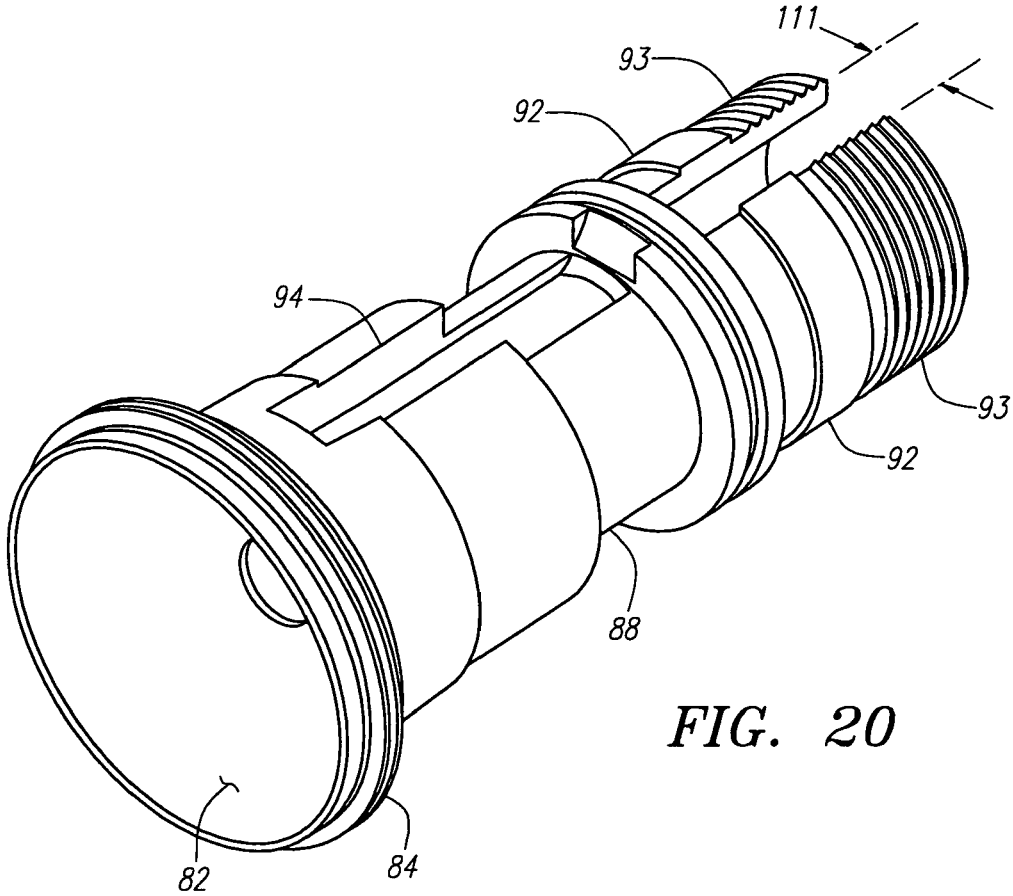
FIG. 20 is a perspective view of the reflector module of FIG. 19.

Referring to FIGS. 19 and 20, the reflector module 2 includes a reflector 82 on its forward end. The reflector 82 has a reflective surface that is axisymmetrical about an axis 43 and includes a first open end 83 for emitting a beam of light at one end and a second end 85. The axis 43 may be defined by the first open end 83 and the second end 85. A flange 84 is also disposed on the forward end of the reflector module 2. In the illustrative embodiment, the second end 85 is an opening that facilitates a light source to be disposed within the reflector 82. Preferably, the reflector 82 has a reflective surface that is substantially parabolic. A parabolic configuration includes a focal property wherein light emanating from the focus or the focal point is redirected into a collimated light beam. Other suitable reflector configurations, for example elliptical, may also be employed.

Figure 27:
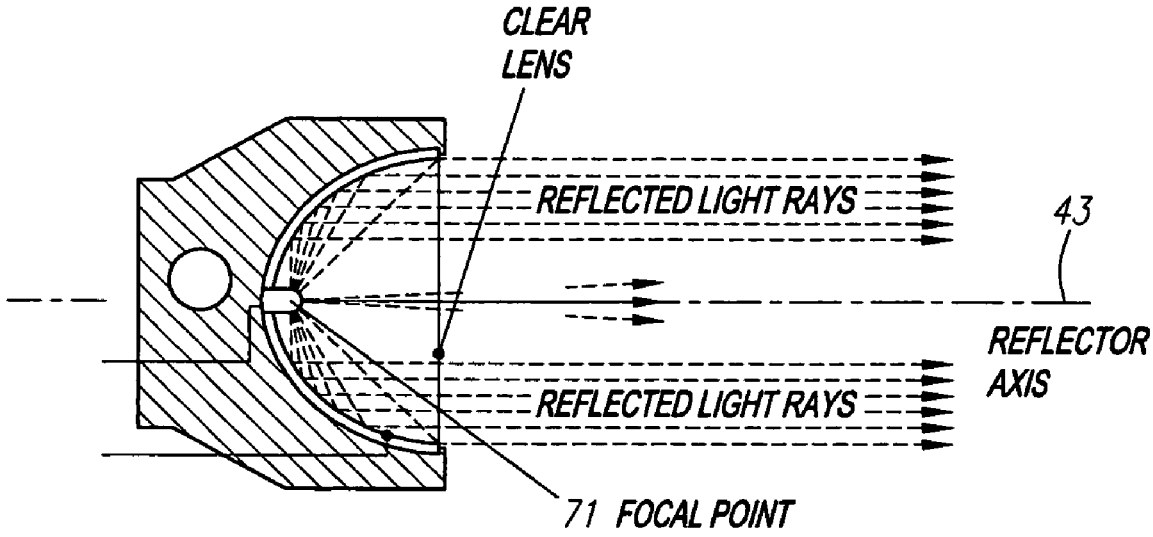
FIG. 27 is a schematic cross-sectional view of a typical reflector illustrating the reflector focal point, reflector axis and the light beam emerging from the reflector.

Referring to FIG. 27, some features of an axisymmetrical reflector are shown. The reflector axis 43, is the axis of the reflector. The focus or the focal point 71 of the reflector lies on the reflector axis 43.

FIG. 27 also illustrates the action of the light being redirected by a reflector to generate a collimated light beam. When the substantial point source of light is aligned to the focal point of a reflector, the most collimated light beam the reflector is able to produce will be generated. When the substantial point source of light is not aligned with the axis of the reflector, unwanted light dispersion occurs resulting in a light beam that is asymmetrical or elongated in shape. To substantially reduce this unwanted light dispersion and minimize the asymmetrical or comet-tail effect on the shape of the light beam, aligning the substantial point source of light-with the reflector axis and the focal point is desired.

Referring to FIGS. 19 and 20, the mid-section of the reflector module 2 includes an inside diameter 86, an outer diameter undercut 88, and an axial slot 94. The inside diameter 86 and the outer diameter undercut 88 are substantially co-axial with each other and with the axis 43 of the reflector 82. The inside diameter 86 of the reflector module 2 corresponds to the outer diameter of the holder housing 22 of the movable assembly 40 such that relative co-axial displacement movement may be realized without significant side-to-side movement. The axial slot 94 is a through slot that is disposed substantially parallel to the axis 43 of the reflector module 2. The width of the axial slot 94 is sized to receive the cam follower assembly 50 thereby limiting any significant relative displacement between the reflector module 2 and the movable assembly 40 in the circumferential direction.

Referring to FIG. 6, when the movable assembly 40 is positioned in the inside diameter 86 of the reflector module 2 and the cam follower assembly 50 is positioned in the axial slot 94, the socket 58 of the movable holder housing 90 is also aligned with and accessible through the slot 94. The reflector module 2 is also sized so that the lamp 359 held by the movable assembly 40 is positioned between the first open end 83 and the second end of the reflector 82.

Figure 21:
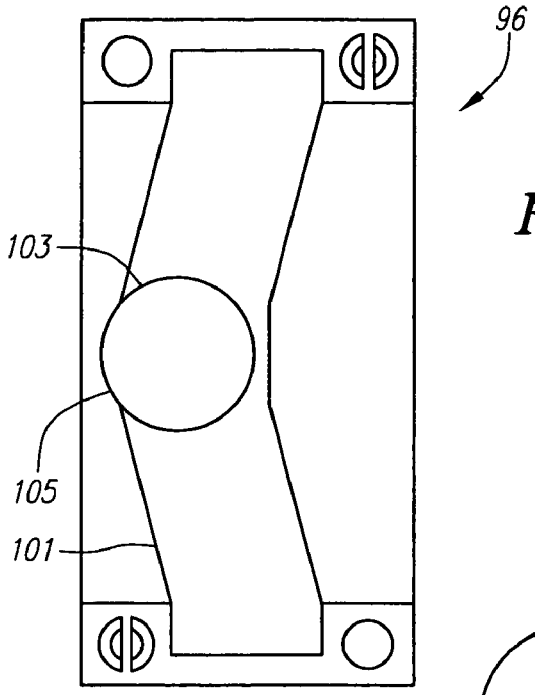
FIG. 21 is a side view of a movable cam.
Figure 22:
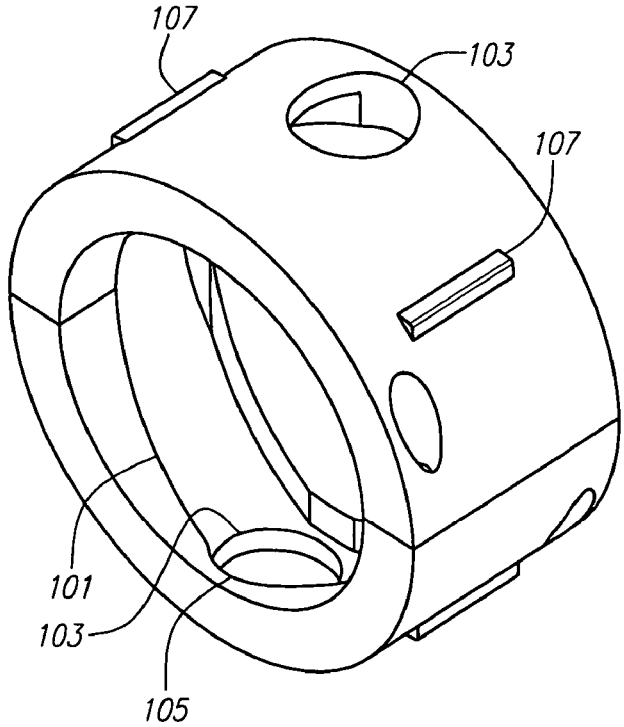
FIG. 22 is a perspective view of an assembled movable cam.

Still referring to FIG. 6, the outer diameter undercut 88 of the reflector module 2 is sized to receive a movable cam 96. Referring to FIGS. 6, 21 and 22, the movable cam 96 includes a cam 101, an access hole 103, a detent 105, and lock tabs 107. The cam 101 is generally a barrel cam in the form of a parallel slot that extends circumferentially around the movable cam 96. The movable cam 96 is sized such that when installed, the cam follower 127 of the cam follower assembly 50 engages with the cam 101. The movable cam 96 is also sized such that it is confined within the forward and aft ends of the outer diameter undercut 88 while being free to rotate thereabout. Accordingly, the cam 101 is able to define the axial rise, fall and dwell of the movable assembly 40. The access hole 103 facilitates installing or removing the cam follower assembly 50.

Referring to FIG. 21, the detent 105 is disposed about the forwardmost side of the cam 101. As will be described in more detail below, the detent 105 in cooperation with other features of the present invention facilitates providing a tactile response feature to the user to indicate that, for example, that the flashlight 10 is in the OFF position.

Figure 23:
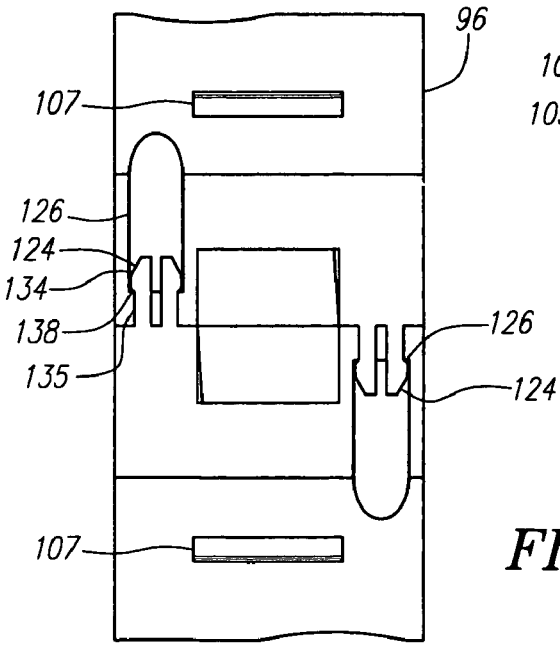
FIG. 23 is a side view of a cross sectioned movable cam.

Preferably, the movable cam 96 is a two-piece construction that may be fitted over the outer diameter undercut 88 of the reflector module 2 and the cam follower assembly 50. The two pieces of the movable cam 96 may be secured by suitable methods known in the art. Referring to FIG. 23, in a preferred embodiment, the two pieces of the movable cam 96 are held together by snap-in plugs 124 and mating holes 126. The snap-in plug 124 includes a flexible tab with a head 134 that is sized greater than the split shaft 135. Each mating hole 126 has a counterbore shoulder 138. Configured this way, when the snap-in plug 124 is inserted into the mating hole 96, the head snaps and secures the movable cam together against the counterbore shoulder of the mating hole 126.

Referring to FIG. 22, the lock tabs 107 are disposed on the outer diameter of the movable cam 96 and extend in a direction parallel to the axis of the flashlight 10. In a preferred embodiment, four lock tabs 107 are equally spaced on the outer diameter of the movable cam 96.

Arranging the movable assembly 40, the reflector module 2 and the movable cam 96 as described, rotating the movable cam 96 relative to the movable assembly 40 will cause the movable assembly 40 to axially displace along the inside diameter 86 of the reflector module 2. In this way, the lamp 359 may be caused to translate along the reflector axis 43.

Figure 24:
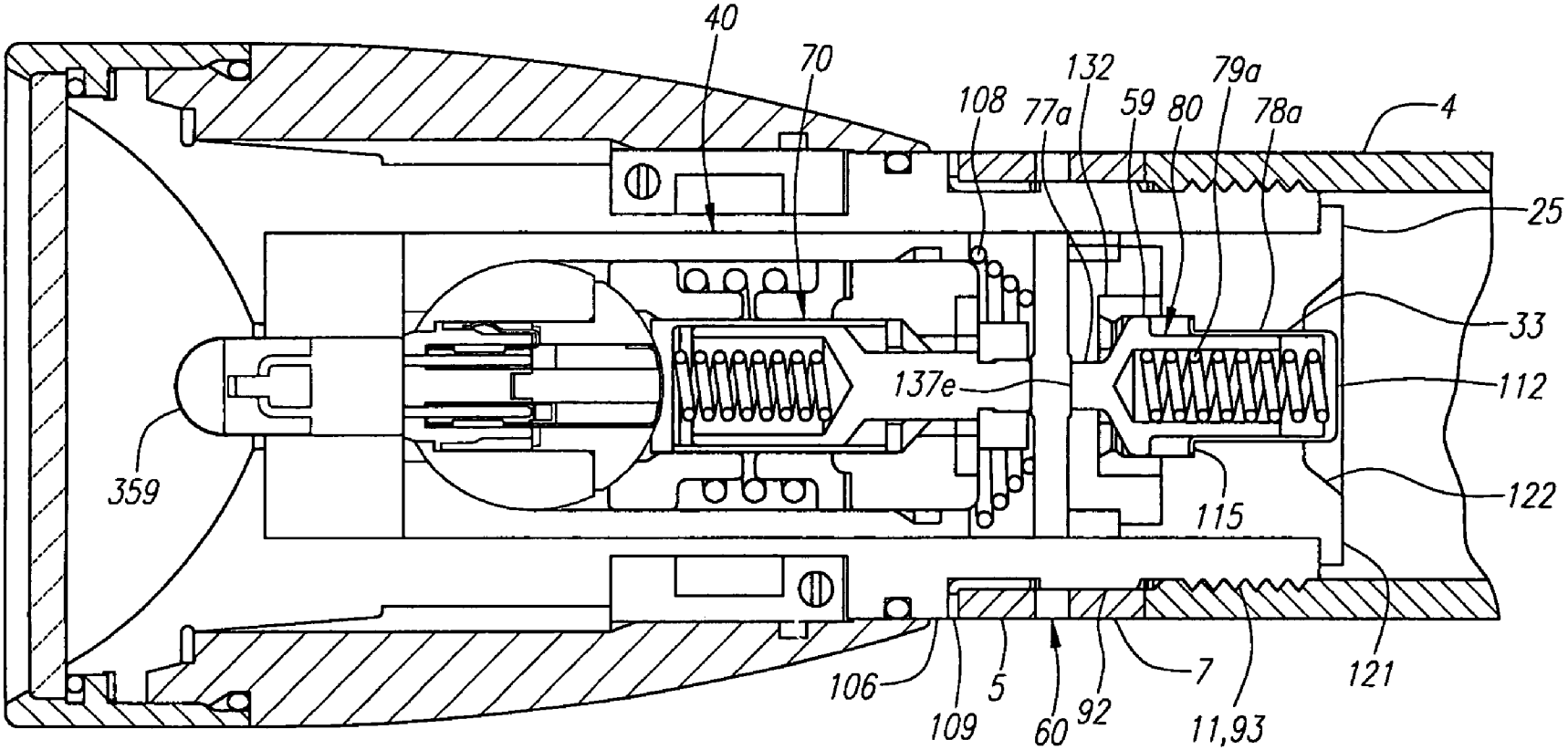
FIG. 24 is an enlarged cross-sectional view of the front end of the flashlight of FIG. 1 as taken through the plane indicated by 3-3.

Referring to FIGS. 19 and 20, the aft end of the reflector module 2 includes a mid-flange 106 and aft curved segments 92. In the illustrative embodiment, two aft curved segments 92 define the inside diameter 86 towards the aft end of the reflector module 2. Each aft curved segment 92 includes threads 93 on the free end. The aft curved segments 92 also define gaps 111 therebetween. The threads 93 are configured to engage with the front threaded portion 11 of the barrel 4 to fix the reflector module 2 thereto as shown in FIG. 24. While the embodiment shown illustrates external threads on the reflector module 2 and internal threads on the barrel 4, this arrangement could be reversed.

Referring to FIG. 24, an insulator 109, the first recharging member 5, the circuit assembly 60 and the second recharging member 7 are interposed between the mid-flange 106 and the front face of the barrel 4. A spring 108 is interposed between the movable assembly 40 and the circuit assembly 60. In the illustrative embodiment, the insulator 109 is generally a ring having an L-shaped cross section that bears against the mid-flange 106. The first recharging member 5 is also a ring and is positioned adjacent to the insulator 109.

Figure 25:
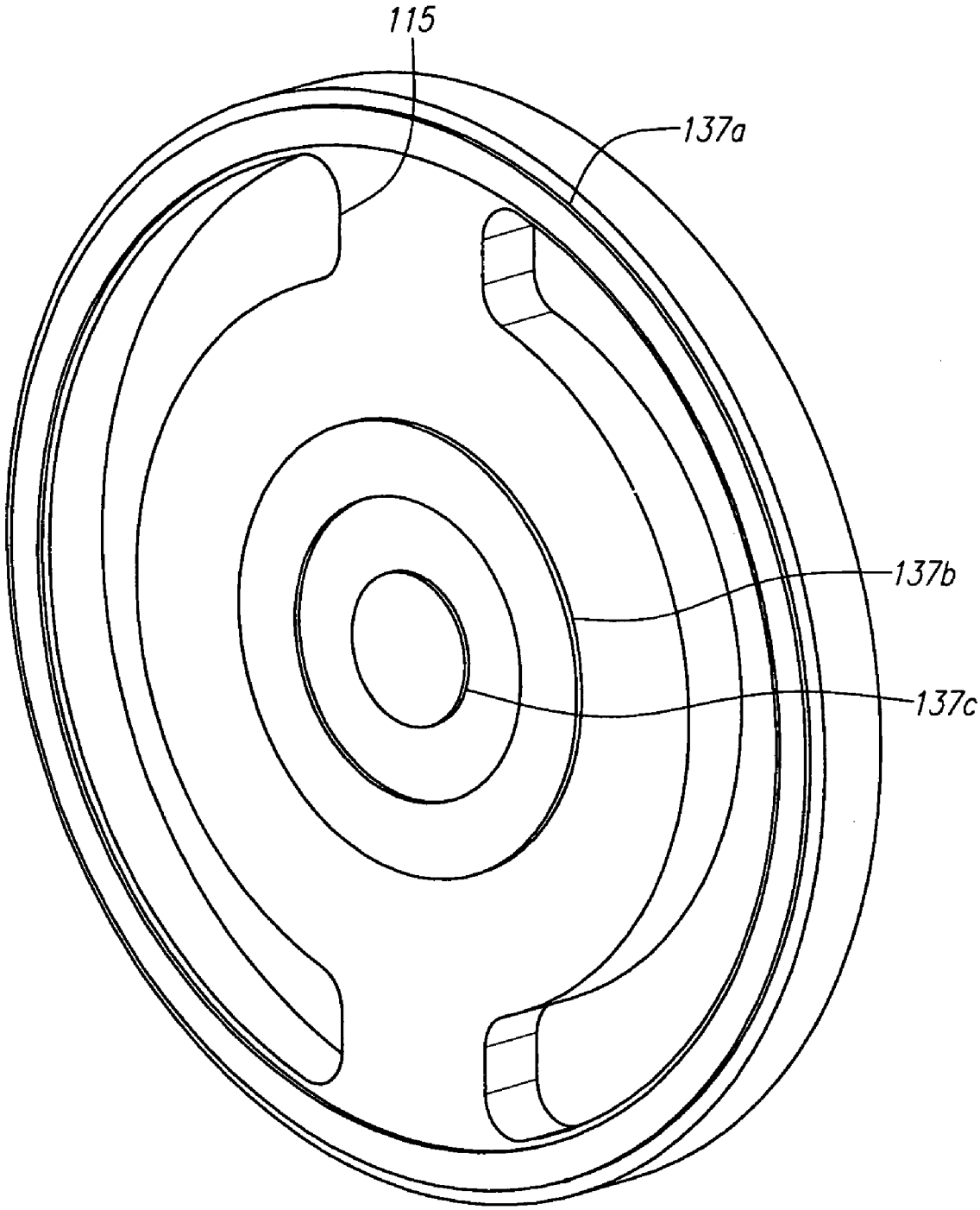
FIG. 25 is a perspective view of a circuit assembly.

The circuit assembly 60 preferably contains electronics to, among other things, control the energy flowing to the lamp 359 or regulate the recharging of the rechargeable batteries 331. The circuit assembly 60 may include a processor for performing the desired operations and functions. The circuit assembly 60 is interposed between the first and second recharging members 5, 7. The circuit assembly 60 includes a plurality of contact areas to selectively and electrically couple to the first recharging member 5, the second recharging member 7, the upper contact assembly 70, the lower contact assembly 80 and the spring 108. Referring to FIG. 25, contact areas 137*a*-137*c* disposed on the forward side of the circuit assembly 60 are shown. Contact area 137*a* is sized and positioned to couple with the first recharging member 5, contact area 137*b* is sized and positioned to couple with the spring 108, and contact area 137*c* is sized and positioned to couple with the upper contact assembly 70. On the aft side of the circuit assembly 60 (not shown), are contact area 137*d* sized and positioned to couple with the second recharging member 7, and contact area 137*e* sized and positioned to couple with the lower contact assembly 80. Clearance slots 115 allow the circuit assembly 60 to fit through the aft curved segments 92 of the reflector module 2.

Referring to FIG. 24, also disposed about the aft end of the reflector module 2 is the spring biased lower contact assembly 80 and the lower insulator 25. Similar to the upper contact assembly 70, the lower contact assembly 80 includes a contact post 77*a*, a contact receptacle 78*a*, and a contact spring member 79*a*; wherein each component is appropriately sized to fit into the lower insulator 25. In addition, the contact post 77*a* includes a flange 59 that extend beyond the outer diameter of the generally cylindrical portion of the contact post 77*a*. The contact receptacle 78*a* also includes a flange depending from the open end of the receptacle.

Referring to FIG. 24, the lower insulator 25 is configured to receive the lower contact assembly 80 and to be secured about the aft end of the reflector module 2. The lower insulator 25 includes a central bore 33, a counterbore shoulder 115, a back face 121, a recess 122 and flexible arms 132. The lower insulator 25 also includes outer features that facilitate its assembly and installation to the aft end of the reflector module 2.

The contact receptacle 78*a* is slidably disposed in the central bore 33 of the lower insulator 25. The lower insulator's flexible arms 132 allow the contact post's flange 59 to be contained within the counterbore of the lower insulator 25. The flange of the contact receptacle 78*a*, disposed adjacent to the counterbore shoulder 115, limits the axial displacement of the contact receptacle 78*a* in the aft direction. The contact post 77*a*, being biased forward by the contact spring member 79*a*, couples with the contact area 137*e* of the circuit assembly 60.

Preferably, the axial length of the contact receptacle 78*a* is sized so that the end contact 112*a* is adjacent to or slightly forward of the back face 121 and remains within the envelope defined by the recess 122 of the lower housing 25. In the illustrated embodiment, the recess 122 is a frusto-conical cavity with the base facing to the back of the flashlight 10. The recess 122 is dimensioned to be deeper than the height of the battery's center electrode 338 that extends beyond the battery casing.

Arranged this way, when the battery is urged forward against the back face 121 of the lower housing 25, the center electrode 338 of the battery engages with the end contact 112*a* of the contact receptacle and lifts its flange off the lower insulator's counterbore shoulder 115. Concurrently, the contact spring member 79*a* urges the contact receptacle 78*a* in the rearward direction against the battery's center electrode to achieve a spring biased electrical connection with the battery 331. In this way, the lower contact assembly 80 provides a simple configuration that enhances the electrical coupling between components even when the flashlight is jarred or dropped, which may cause the battery or batteries 331 to suddenly displace axially within the barrel 4. Further, because the contact spring member 79*a* may absorb impact stresses due to, for example mishandling, the battery's center electrode and the flashlight components, for example the circuit assembly 60, are better protected.

Also, because the depth of the recess 122 is greater than the distance the center electrode 338 extends beyond the end of the battery case, if a battery or batteries 331 are inserted backwards into the barrel 4 so that their case electrodes are directed forward, no coupling with the lower contact assembly 80 is formed. When the batteries are inserted correctly, the center electrode of the fowardmost battery is urged into contact with and compresses the lower contact assembly 80. Such an arrangement immediately notifies the user of improper battery installation.

Referring to FIG. 6, the head assembly 20 is disposed on the forward end of the flashlight 10, and is rotationally mounted to the flange 84 of the reflector module 2. The head assembly 20 comprises of a face cap 142, lens 144, a sleeve 146 and a sealing ring 148.

The face cap includes a flange 152, which extends radially towards the axis of the face cap, a groove 153 and aft threads 154. In the illustrative embodiment, the lens 144 is disposed in the groove 153 of the face cap and is positioned against the sealing ring 148. Preferably, the lens 144 is fitted into the groove 153 by snap-fit, as commonly known in the art. The flange 152 of the face cap is positioned forward of the flange 84 of the reflector module 2. The aft threads 154 is adapted to engage with corresponding threads of the sleeve 146.

The sleeve 146 protects the inner components of the flashlight from contamination by covering the axial slot 94 and the socket 58 of the ball housing 31. The sleeve 146 is generally a hollow cylinder with a tapered outer surface. The sleeve 146 includes threads about its forward end to engage with the face cap threads 154. The forward end of the sleeve 146 is positioned on the aft side of the flange 84 of the reflector module 2. The corresponding diameters between the face cap 142 and the flange 84 of the reflector module 2 are also sized and controlled for a clearance fit. Configured and arranged this way, the face cap 142 and the sleeve 146 define a clearance envelope surrounding the reflector module flange 84 and the head assembly 20 may rotate about the axis of flashlight 10 relative to the reflector module 2. Optionally, a spacer 156 may be installed to fill any excess axial clearance. In a preferred embodiment, the spacer 156 is made of nylon.

Figure 26:
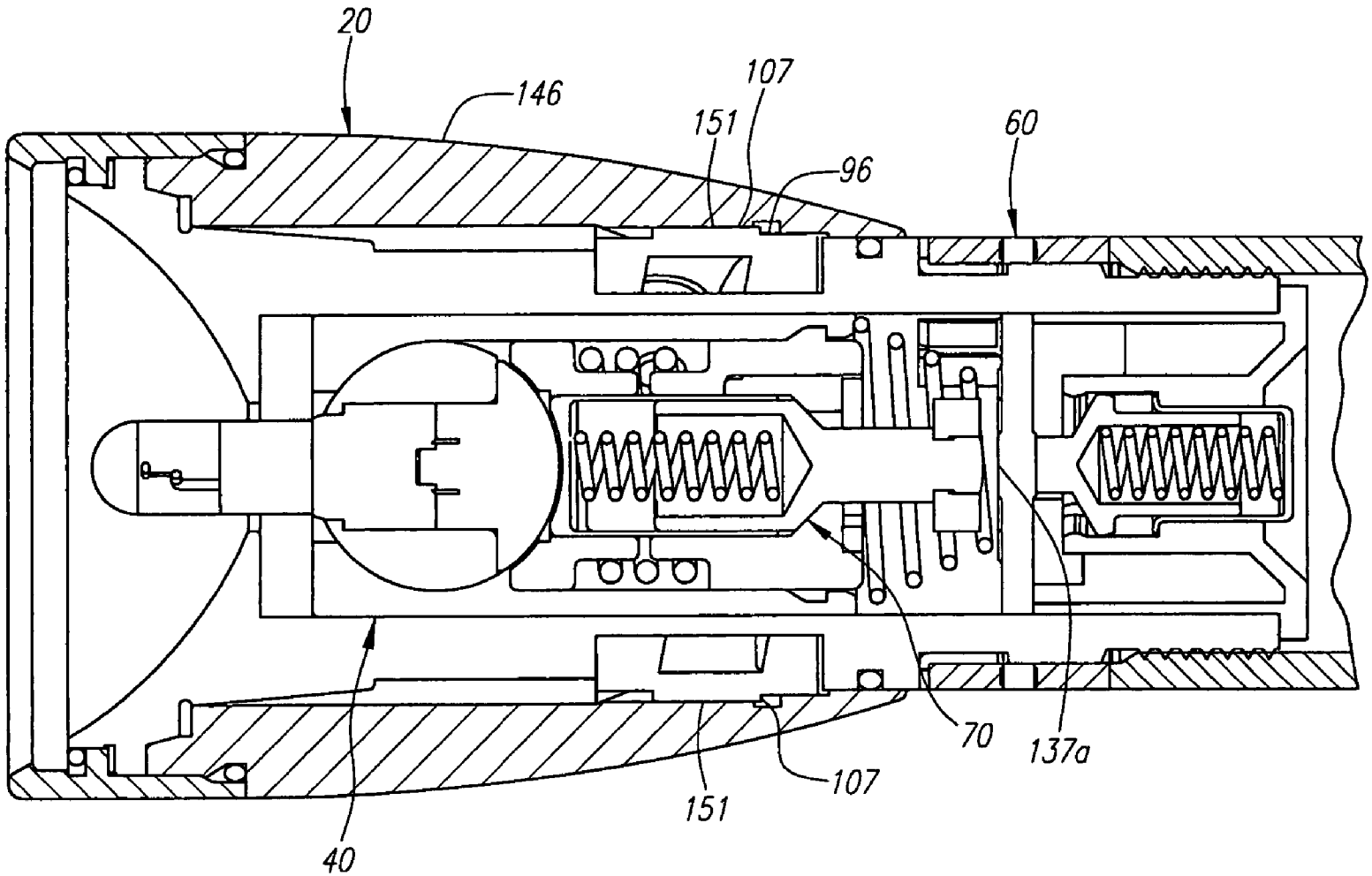
FIG. 26 is an enlarged cross-sectional view of the front end of the flashlight of FIG. 1 as taken through the plane indicated by 26-26.

Referring to FIG. 26, the sleeve 146 also includes a plurality of lock slots 151 that corresponds to the lock tabs 107 of the movable cam 96. By having the movable lock tabs 107 mate with the sleeve's lock slots 151, the movable cam 96 may be caused to rotate about the axis of the flashlight 10 when the head assembly 20 is rotated thereabout.

Referring to FIG. 6, because the movable assembly 40 is limited from rotating within the inside diameter 86 of the reflector module 2 by the cooperation of the cam follower assembly 50 and the axial slot 94, and because the movable cam 96 is free to rotate about its axis while being limited to displace axially by its cooperation with the outer diameter undercut 88, rotating the head assembly 20 causes the rotation of the movable cam 96, which in turn causes the movable assembly 40 to travel axially within the inside diameter 86 of the reflector module 2. Because the reflector axis 43 is substantially co-axial with the axis of the inside diameter 86 of the reflector module 2, the light source that is secured to the forward end of the movable assembly 40 is able to travel along the reflector axis 43 by the rotation of the head assembly 20. In this way, the position of the lamp 359 held in the movable holder assembly 90 can be adjusted along the axis 43 of the reflector 82. Varying the axial position of the lamp 359, and its substantial point source of light with respect to the reflector advantageously varies the dispersion of light produced by the flashlight 10.

The combination described above is one embodiment for moving the substantial point source of light along or parallel to the axis 43 of the reflector 82. Although other combinations may be suitable for this purpose, having the reflector 82 integral to the feature that controls the fidelity of the light source's axial displacement, i.e., the inside diameter 86, advantageously improves manufacturability and reduces cost. Also, having the reflector fixed to the barrel and to other features of the flashlight reduces the number of components needed and advantageously eases manufacturing.

Also, although the embodiment described above uses a cam that rotates with the head assembly to effectuate axial translation of the light source, the present invention is not limited by the configuration and arrangement of the cam. The light source may be axially translated by other suitable means, such as for example, having a cam fixed to the barrel and coupling the movable holder to the head assembly.

The flashlight 10 described above is also one embodiment that is suitable for moving the substantial point source of light in a direction other than parallel to or along the reflector axis 43. Referring to FIG. 6, the movable holder assembly 90 holds the lamp 359 within the reflector 82. To move the lamp 359 or the substantial point source of light 3, the user first disengages the sleeve 146 from the head assembly 20 and slides it in the rearward direction to expose the axial slot 94 and to gain access to the socket 58 of the ball housing. The user may then couple an actuating member (not shown) to the socket 58. In a preferred embodiment, the actuating member is a standard hex key that is coupled to the socket 58 having a hexagonal form. Preferably, the actuating member also includes a handle to ease the user's handling of the actuating member. Moreover, the actuating member is preferably configured so that it may be stowed in the flashlight 10.

As described above, the movable holder assembly 90 is secured in place by spring forces provided through the sleeve retainer 18 and the upper contact assembly 70. In the illustrative embodiment, the lamp 359 is moved by, for example, rotating the actuating member with sufficient pressure to overcome the spring forces and causing the movable holder assembly 90 to roll within the spherical envelope defined in part by the holder housing 22 and the sleeve retainer 18. Rotating the hex key causes the lamp bulb to rotate about a rotation axis 61 that is not coincident to the reflector axis 43, as defined by the socket 58. In this regard, the socket 58 is an actuation interface of the movable holder assembly 90 that facilitates the substantial point source of light to move relative to the reflector axis 43.

Also, the movable holder assembly 90 may move the lamp 359 and its filament 360 in a second direction when the actuating member in a lever motion as indicated by arrow A in FIG. 6. By moving the actuating member in this manner, the movable holder assembly 90 rolls within the spherical envelope about a second rotation axis substantially 90° from the first rotation axis 61. In this way, the lamp 359 held by the holder assembly 90 has two degrees of freedom and, accordingly, the substantial point source of light the lamp may be moved over a defined area, which in the illustrative embodiment, is a spherical contour substantially perpendicular or lateral to the reflector axis 43. In this way, the substantial point source of light may be aligned with the axis 43 of the reflector.

It should be noted that the movement of the movable holder assembly 90 is not limited by two axes of rotation as described above. The spherical form of the ball holder assembly 90 and the envelope containing the ball holder assembly 90 advantageously provides a full range of motion, similar to a ball joint, and the actuating member may be maneuvered in any direction.

The spring force(s) exerted by the upper spring member 24 through the sleeve retainer 18 and/or the upper contact assembly 70 serve as an alignment locking mechanism by providing sufficient forward force to maintain the position of the lamp 359 before and after the lamp is moved to align the substantial point source of light with the axis of the reflector. Although other methods to maintain the position of the lamp after alignment may be employed, spring force, preferably in a form of a coil spring, provides a simple and effective configuration to achieve the desired result.

In the embodiment described above, the substantial point source of light is caused to move by maneuvering the axis defined by the socket 58 of the movable holder assembly 90. While a removable actuating member is described herein, the actuating member may be integral to the movable holder assembly 90.

Therefore, one embodiment of a movable holder that is able to move a substantial point source of light in substantially the lateral direction relative to the reflector axis, and that is able to move the substantial point source of light along the axis of the reflector axis has been described. By having such an adjustment capability, the movable holder of the present invention facilitates aligning the substantial point source of light with the focal point of the reflector. Even after the substantial point source of light is aligned with the focal point along the reflector's axis, the movable holder of the present invention facilitates moving the point source away from the focal point along the reflector's axis and varying the dispersion of light emanating from the point source. Because of the alignment locking mechanism described above, the substantial point source's alignment to the reflector axis is maintained and the point source may be re-aligned with the focal point by translating it back along the reflector axis.

The movable assembly 40 and the movable cam 96 are one distinct combination for moving and aligning the substantial point source of light relative to the reflector axis or the focal point of the reflector. By providing such a combination, the performance of the flashlight is advantageously improved. However, it is expressly noted that the present invention is not limited to any specific combination or arrangement for moving a substantial point source of light relative to the reflector axis.

In another aspect of the present invention, the spring loaded upper contact assembly 70 engages with the contact base 46 that conforms to the spherical back contour 39 of the aft contact holder 12. Advantageously, such a relationship between the contacts provides an electrical connection between the two components even where there is movement or rotation of the movable holder assembly 90 because the spring loaded upper contact assembly 70 follows the curvature of the contact base 46.

In the illustrative embodiment in FIG. 6, the displacement range of the substantial point source of light may be limited by the size of the reflector module's axial slot 94, the holder housing's access holes 72 or clearance hole 67, or the reflector's second end 85. Preferably, the access features are sized so as to avoid the light source from contacting any component and causing damage while achieving the desired range of light source displacement. The present invention is not limited to any specific manner in which the substantial point source of light moves or the manner in which the displacement range of the point source is limited or controlled.

Also, the actuation interface of the movable holder assembly 90 may be any suitable combination that may facilitate the movable holder assembly (and the lamp held thereon) to move. For example, the movable holder assembly 90 may be configured without a socket 58 so that the spherical outer profile 52 of the ball housing 31 is made as the actuation interface. The access to the spherical outer profile 52 may be achieved by, for example, appropriately sizing the adjacent structures to facilitate the user's finger or thumb to access and engage with the outer profile 52. To enhance the engagement, the outer profile 52 may be knurled or roughened to increase the friction with the user's hand or finger. In this alternate movable holder configuration, the user can move the lamp by handling the spherical outer profile 52 to move the ball housing 31 within the spherical envelope defined in part by the holder housing 22 and sleeve retainer 18.

Further, the actuation interface of the movable holder may be an external feature. For example, an extension may protrude from the ball housing 31 that has an external hexagonal form. In such a configuration, the actuating member may be a socket or other female-type coupling to engage with the external feature of the extension. If the extension is sufficiently sized, the user may be able to maneuver the movable holder directly without the use of an actuating member.

There are other ways to move the point source of light. For example, the movable lamp holder may be configured with an aft extension that protrudes through two actuator rings. By arranging the two actuator rings to move in a direction perpendicular to the axis of the flashlight, and by arranging the first and second actuator rings to translate in a direction perpendicular to each other, a two-dimensional light source displacement range can be achieved. Similarly, a single actuating ring that is translatable in two directions will also yield a two-dimensional light source displacement range.

Moreover, the embodiment described above tend to move the substantial point source of light in an arcuate or non-linear path. The present invention is not limited to the displacement path of the substantial point source of light. Linear translation of the point source of light in a perpendicular direction relative to the reflector axis may also be employed to align the point source of light. Those skilled in the art will appreciate that coupling two actuating members, disposed 90° apart and perpendicular to the reflector axis, to a movable holder will allow the substantial point source of light to be translated in any direction along a plane perpendicular to the reflector axis.

The present invention also contemplates any suitable means to move the substantial point source of light to align the light source to the reflector axis. Although only mechanical means to move the substantial point source of light has been described herein, the present invention is not limited to moving the substantial point source of light relative to the reflector solely by mechanical means. For example, electrical or electro-mechanical devices may be used to move the lamp and its filament. The control of such devices may be provided by, for example, a microprocessor disposed on the circuit assembly 60. Accordingly, the present invention is not limited to a mechanical or a mechanically controlled means of moving the substantial point source of light.

Therefore, an apparatus for moving and aligning a substantial point source of light to a reflector axis has been disclosed. Combined with features that facilitates adjusting the position of the point source of light parallel or along the axis of the reflector as described above, the flashlight 10 discloses one configuration that can align the substantial point source of light of a light source to the focal point or the axis of a reflector.

Advantageously, the apparatus described herein moves the substantial point source of light while maintaining flow of electrical energy to the source of light. It is preferable to have the flashlight turned on while the alignment steps are performed so that the user is able to visually confirm the quality of the light beam while moving the movable holder.

Moreover, although the particular order is not essential, the user may: (1) turn on the flashlight; (2) actuate the movable holder and move the substantial point source of light to substantially reduce the asymmetrical or comet-tail effect of the light beam until a substantially symmetrical light beam is observed—which signifies that the substantial point source of light is substantially aligned with the axis of the reflector; and (3) rotate the head assembly to axially translate the point source of light along the reflector axis until the brightest beam is observed—which signifies that the substantial point source of light is substantially aligned with the focal point of the reflector.

With the configuration and the steps above described, a light beam that maximizes the focal properties of a reflector, such as a parabolic reflector, may be achieved. In doing so, unwanted dispersion of light caused by a misaligned point source of light may be substantially reduced. Also, efficient use of battery energy is realized because higher intensity light beam is generated using the same energy. Accordingly, the flashlight according to the present invention operates at a superior optical performance level than previously known flashlights.

In a preferred implementation of the illustrative embodiment, the tail cap 322, the barrel 4, the reflector module 2, the sleeve 146, and the face cap 144, generally forming the external surfaces of the flashlight 10 are manufactured from aircraft quality, heat treated aluminum, which are anodized for corrosion resistance. All interior electrical contact surfaces are preferably appropriately formed or machined to provide efficient electrical conduction. All insulating or non-conducting components are preferably made from polyester plastic or other suitable material for insulation and heat resistance. The reflector 82 is preferably provided with a computer-generated parabolic reflecting surface that is metallized to ensure high precision optics. Optionally, the reflector 82 may include a electroformed nickel substrate for heat resistance.

The electrical circuit of flashlight 10 will now be described. Referring to FIG. 6, the electrical circuit of flashlight 10 is shown in the closed or ON position. The electrical circuit closes when the movable assembly 40 is sufficiently translated in the aft direction so that the upper contact assembly 70 electrically couples with the circuit assembly 60. Referring to FIGS. 3, 6 and 24, when the electrical circuit is closed, electrical energy is conducted from the rear battery through its center contact which is in connection with the case electrode of the battery disposed forward thereof. Electrical energy is then conducted from the forward battery through its center electrode to the lower contact assembly 80 which is coupled to the circuit assembly 60. The electrical energy then selectively conducts through the electronics of the circuit assembly 60 and to the upper contact assembly 70, which in turn is coupled to the contact base 46 of the positive electrode contact 28. After passing through the filament of the lamp 359, the electrical energy emerges through the lamp electrode 358 which is coupled to the negative electrode contact 29. The curved arm 49 of the negative electrode contact 29 is electrically coupled to the bore 51 of the ball housing 31, which is coupled to the holder housing 22, which in turn is coupled to the spring 108 that is electrically coupled to the contact area 137*b* of the circuit assembly 60. The electrical energy is conducted to the second recharging ring 7 which is electrically coupled to the forward edge of the barrel 4. The barrel 4 is electrically coupled to the tail cap 322. Finally, the spring member 334 of the tail cap assembly 20 forms an electrical path between the tail cap 322 and the case electrode of the rear battery to complete the electrical circuit. In this manner, an electrical circuit is formed to provide electrical energy to illuminate a light source.

Referring to FIG. 26, to open the electrical circuit or turn OFF the flashlight 10, the user rotates the head assembly 20 to translate the movable assembly 40 sufficiently forward so that the upper contact assembly 70 separates from the contact area 137*a* of the circuit assembly 60.

The tactile response feature of the present invention will now be described. Referring to FIG. 6, the spring 108 interposed between the movable assembly 40 and the circuit assembly 60 serves, in part, to electrically couple the movable assembly 40 to the circuit assembly 60. The spring 108 also serves to forward bias the movable assembly 40 and, as a result, forward biases the cam follower assembly 50 against the front side of the cam 101. As shown in FIG. 21, the detent 105 is disposed about the forwardmost side of the cam 101. Accordingly, as the user rotates the head assembly 20 and translates the movable assembly away from the circuit assembly 60 to turn OFF the flashlight 10, the cam follower assembly 50 eventually moves into the detent at a point where the movable assembly 40 is farthest from the circuit assembly 60. Because the cam 101 is otherwise a smooth transitional surface, the user is able to sense the cam follower assembly 50 as it moves into the detent. In this way, a tactile response is provided to the user that the flashlight is held in the OFF position.

Similarly, a detent may be disposed on the cam 101 at a position wherein the electrical circuit is closed. In this instance, the tactile response will indicate to the user that the flashlight is held in the ON position.

Although a rotating type switch that opens and closes the electrical circuit by separating the circuit at the interface between the upper contact assembly 70 and the circuit assembly 60 has been described, the electrical circuit may be closed or opened at other locations.

Moreover, although a rotating type switch has been described, the various aspects of the invention as described herein is not limited by the type of switching scheme employed. Other suitable switch device, such as a push-button switch or an electronic switch may be employed.

The flashlight 10 is preferably a rechargeable flashlight. As described above, the flashlight 10 includes conducting members 5, 7 that are electrically coupled to the circuit assembly 60. Accordingly, a recharging device or a recharger electrically coupled to the conducting members 5, 7 would also be electrically coupled to the circuit assembly 60 and the rechargeable batteries. In this way, the portable source of light may be recharged without removing it from the barrel 4.

Figure 29:
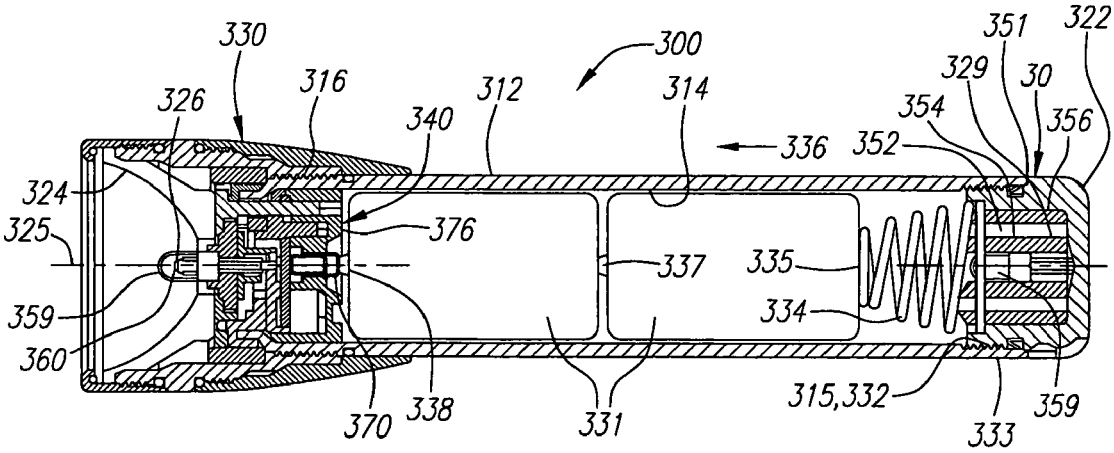
FIG. 29 is a cross-sectional view of the flashlight of FIG. 28 as taken through the plane indicated by 29-29 where the flashlight is shown in the "off" position.

Turning to FIG. 28, flashlight 300 will now be described. Flashlight 300 is yet another version of a flashlight embodying the various features of the present invention. The flashlight 300 includes a barrel 312, a tail cap assembly 20, and a head assembly 330. The tail cap assembly 20 encloses the rearward end of the barrel 312. As shown in FIG. 29, the head assembly 330 and a front end assembly 340 are disposed on the forward end of the barrel 312.

Referring to FIG. 29, the housing or barrel 312 houses two dry cell batteries 331 disposed in a series arrangement. It will be appreciated by those skilled in the art, however, that barrel 312 may also be configured to include a single battery or a plurality of more than two batteries, or other suitable portable source of energy in either a series or a side-by-side parallel arrangement. Furthermore, while batteries 331 may comprise any of the known battery sizes, flashlight 300 according to the illustrative embodiment is particularly well suited for C or D sized batteries. Battery 331 may also be a rechargeable type battery.

Figure 30:
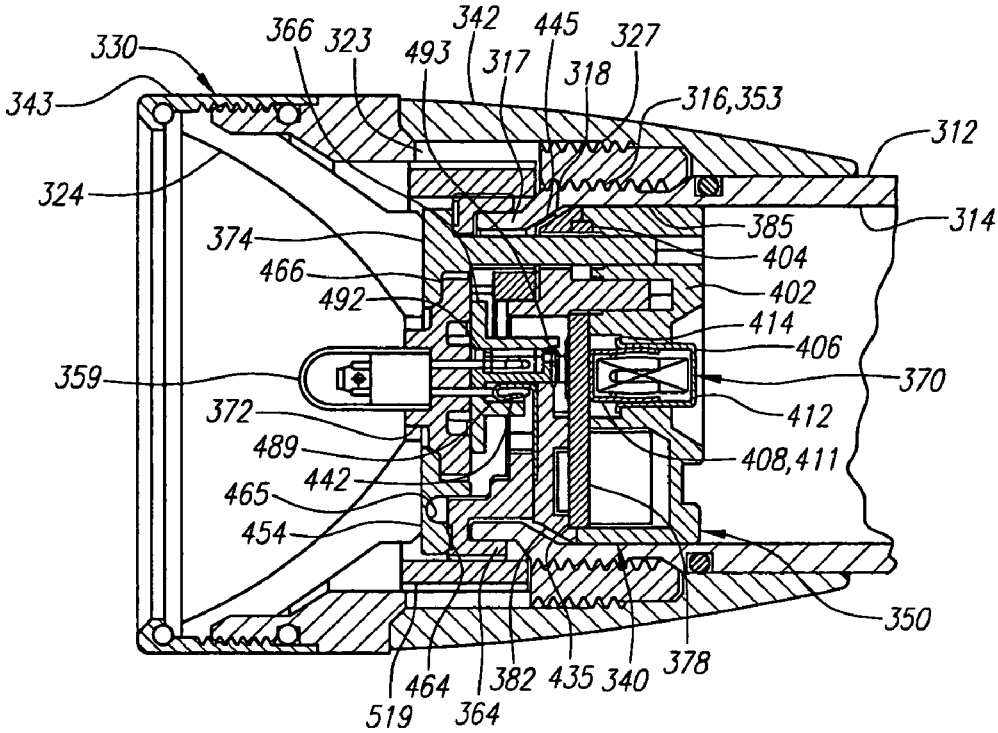
FIG. 30 is an enlarged cross-sectional view of the front end of the flashlight of FIG. 28 as taken through the plane indicated by 29-29.

Referring to FIGS. 29 and 30, the barrel 312 includes the inner surface 314, a back threaded portion 315, a front threaded portion 316, a lip 317, and a taper 318. The back threaded portion 315 releasably engages the barrel with the tail cap assembly 20. The front threaded portion 316 releasably engages the barrel with the head assembly 330. The lip 317 is defined by a reduction of the barrel diameter on the forwardmost end of the barrel 312. The taper 318 is the transition between the barrel's inside surface 314 and the lip 317. As will be described in more detail, the taper 318 interfaces with barrel contacts 445 of the front end assembly 340.

Referring to FIG. 29, the front end assembly 340 embodies several aspects of the present invention. Among other things, the front end assembly 340 is a switch that provides for the opening and closing of an electrical circuit to turn the lamp bulb off and on, respectively. The front end assembly 340 also facilitates moving the substantial point source of light relative to the axis 325 of a reflector assembly 324 for the purpose of aligning the substantial point source of light with the reflector axis 325 and improving the optical characteristics of the flashlight. The reflector assembly 324 includes a focal point 326 on the axis 325 of the reflector. The front end assembly 340 also includes means to position the point source of light with the focal point 326. The front end assembly 340 further includes features that facilitates source of light displacement while maintaining electrical contact to allow the user to visually critique the quality of the light beam emanating from the flashlight during the alignment process. The substantial point source of light may be positioned on the lamp bulb filament.

Figures 32, 33:
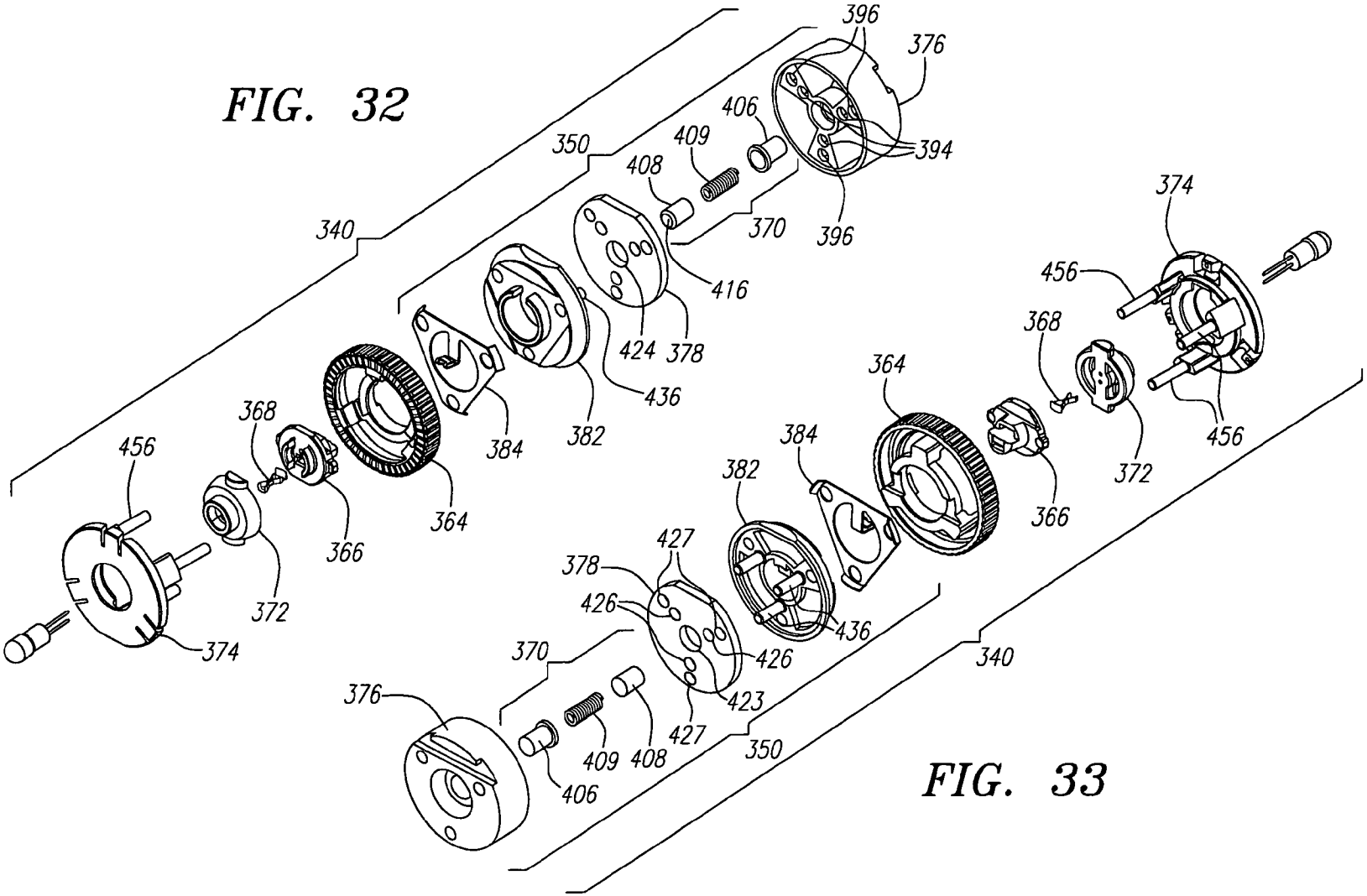
FIG. 32 is an exploded perspective view from the forward end of the flashlight of FIG. 28 illustrating the assembly of a front end assembly in accordance with separate aspects of the present invention.
FIG. 33 is an exploded perspective view from the rearward end of the flashlight of FIG. 28 illustrating the assembly of the front end assembly in accordance with separate aspects of the present invention.

Referring to FIGS. 30, 32, and 33, the front end assembly 340 includes a front subassembly 350, an actuator 364, a contact insulator 366, a first conductor 368, a movable lamp bulb holder 372, and an upper insulated retainer 374. The front subassembly 350 includes a lower insulator 376, a battery contact assembly 370, an optional PCB (printed circuit board) 378, a middle insulator 382, and a second conductor 384.

In a preferred embodiment, the lower insulator 376 and the middle insulator 382 together house the battery contact assembly 370 and, optionally, the PCB 378. The rearward facing side of the lower insulator 376 is disposed adjacent to the battery 331. The lower insulator 376 also includes mating features to receive and attach with the middle insulator 382 and the upper insulated retainer 374. Accordingly, the configuration of the lower insulator 376, as do other components, depends in part on the assembly features employed to mate the respective parts.

Figure 31:
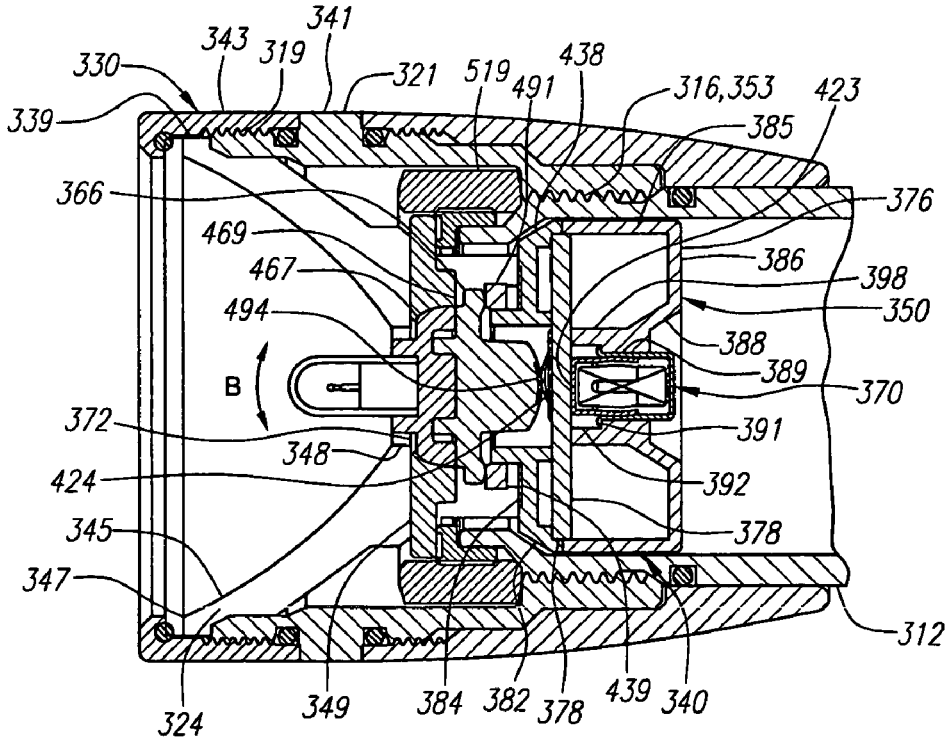
FIG. 31 is an enlarged cross-sectional view of the front end of the flashlight of FIG. 28 as taken through the plane indicated by 31-31.
Figure 34:
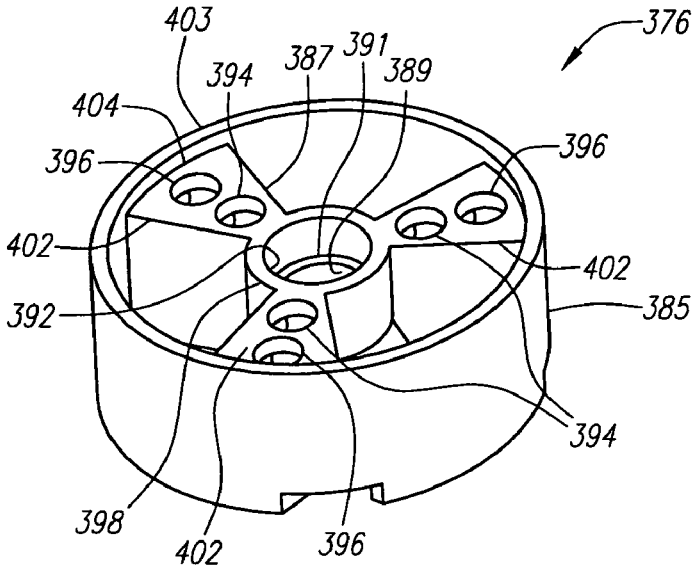
FIG. 34 is an enlarged perspective view from the forward end of the lower insulator.

Referring particularly to FIGS. 31 and 34, the lower insulator 376 includes a side wall 385 that defines a right circular cylinder. The diameter of the side wall 385 is dimensioned so that the lower insulator 376 may axially slide within the barrel 312 against the inner surface 314 without binding. At the same time, the diameter of the side wall 385 is sufficient to prevent significant side-to-side movement of the lower insulator 376 within the barrel. In addition, the side wall 385 is preferably of sufficient length to prevent the lower insulator 376 from tilting with respect to the barrel. As a result of the foregoing arrangement, the lower insulator 376 and barrel 312 will remain coaxial with respect to one another.

Further, the lower insulator 376 includes a base 386, an internal support 387, a recess 388, a central bore 389, a shoulder 391, a counterbore 392, inner bores 394 and outer bores 396.

The internal support 387 includes a generally cylindrical center 398 and three ribs 402. Each rib 402 extends radially outward from the cylindrical center 398 to the inside surface of side wall 385. The ribs 402 are 120 degrees from each other and include inner bores 394 and outer bores 396, which extend in the axial direction. In addition to defining the inner bores 394 and outer bores 396, the internal support 387 advantageously provides stiffness to the cylinder form defined by side wall 385 and contributes, among other things, to achieve the non-tilting, non-binding slidable relationship between the lower insulator 376 and the barrel 312.

Although the internal support 387 is shown as including a cylindrical center and three ribs, other suitable configurations to stiffen the side wall 385 and/or to contain the recess, central bore, counterbore and inner and outer bores may be employed. For example, the entire inner region of the lower insulator 376 may be filled solid. However, among other things, the illustrative embodiment of the lower insulator 376 shown reduces material waste and keeps the overall weight of the flashlight low.

Preferably, the inner bores 394 are configured for an interference fit with inner extensions 436 of the middle insulator 382. Similarly, the outer bores 396 are configured for an interference fit with extensions 456 of the upper insulated retainer 374. As described above, the bores 394 and 396 preferably include a hexagonal form to fit with a cylindrical form of the extensions 436 and 456, respectively.

Referring to FIG. 31, the recess 388, the central bore 389 and the counterbore 392 of the lower insulator 376 are preferably arranged coaxially and centrally about the cylindrical center 398. The counterbore 392 has a diameter greater than that of the central bore 389. The shoulder 391 defines the transition between the central bore 389 and the counterbore 392. In the illustrated embodiment, the recess 388 is a frustoconical cavity with the base facing rearward.

The base 386 defines the end of the lower insulator 376 and extends radially outward from the recess 388 to the side wall 385. The base 386 also advantageously contributes to the overall stiffness of the cylinder defined by side wall 385.

Referring to FIGS. 30 and 34, in a preferred embodiment, the ribs 402 of the internal support 387 extends axially from the base 386 short of the forward edge 403 of the side wall 385 thereby leaving a step 404 to receive the PCB 378. As will be described further, the middle insulator 382 may include a corresponding step for containing the PCB 378 therebetween.

Referring to FIGS. 30-33, the battery contact assembly 370 is slidably disposed within the central bore 389 of the lower insulator 376. The battery contact assembly is a spring biased conductor that provides an electrical path between the battery 331 to the lamp bulb electrode. The battery contact assembly 370 includes a lower receptacle 406, an upper receptacle 408 and a spring 409.

Figure 35:
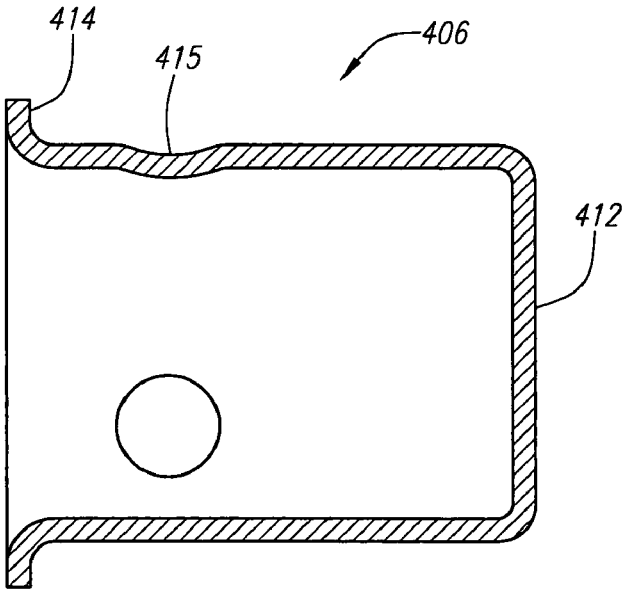
FIG. 35 is a side view of a lower receptacle.

Referring to FIG. 35, the lower receptacle 406 is an open-ended receptacle including a battery contact end 412, a flange 414 and optional dimples 415. The flange 414 depends radially outward from the open end of the lower receptacle 406. Each dimple 415 may be a depression in the wall of the receptacle that results in a local reduction in the inside diameter of the receptacle. The dimples may be equally spaced around the circumference of the lower receptacle 406 and located in an axial position toward the flange 414. The inside diameter of the receptacle defined by the dimples are sized to provide a slight interference fit with the upper receptacle. Further, the optional three dimples are equally spaced around the circumference of the lower receptacle 406.

The upper receptacle 408 may be an open-ended flangeless receptacle including a contact end 416 at the closed end of the receptacle. The spring 409 is sized to fit into the lower receptacle 406.

In assembly, the upper receptacle 408 is fitted into the lower receptacle 406 with the spring 409 contained therebetween. Sufficient pressure is required to overcome the slight interference between the upper receptacle 408 and the dimples 415 of the lower receptacle 406, and resistance from the spring 409. Once assembled, the slight interference fit between the upper receptacle 408 and the dimpled area provides an enhanced electrical connection between the upper and lower receptacle. This enhanced electrical connection is maintained even when relative axial movement between the upper and lower receptacle is experienced.

Referring to FIGS. 29-31, the battery contact assembly 370 is slidably disposed in the lower insulator 376 by sizing the lower receptacle 406 for a clearance fit with the central bore 389. The flange 414 bearing against the shoulder 391 of the lower insulators 376 limits the axial displacement of the lower receptacle 406 in the rearward facing direction. Preferably, the axial length of the lower receptacle 406 is sized so that the battery contact end 412 is adjacent to or slightly forward of the base 386 and remains within the envelope defined by the recess 388 of the lower insulator 376. The recess 388 is dimensioned to be deeper than the height of the center electrode 338 that extends beyond the end of the battery casing. Arranged this way, when the spring force of a tail cap spring 334 urges the battery casing to abut the base 386 of the lower insulator 376, the center electrode 338 of the battery engages with the battery contact 412 and lifts the flange 414 off the lower insulator shoulder 391. Concurrently, because the upper receptacle is axially restrained, as will be described in more detail, the spring 409 of the battery contact assembly 370 urges the lower receptacle 406 in the rearward direction against the battery's center electrode 338 to achieve a spring biased electrical connection with the battery 331. Such an arrangement provides a simple configuration that enhances electrical contact between components even when the flashlight is jarred or dropped, which may cause the battery 331 to suddenly move axially within the barrel 312. Further, because the spring 409 of the battery contact assembly 370 and the spring 334 of the tail cap assembly may absorb impact stresses due to, for example mishandling, the battery's center electrode and the components disposed forward of the battery, such as the optional PCB 378, are better protected.

Further, because the depth of the recess is greater than the distance center electrode 338 extends beyond the end of the battery casing, if batteries 331 are inserted backwards into the barrel 312 so that their case electrodes are pointing forward, an electrical circuit is not formed. When the batteries are inserted correctly, the center electrode of the forwardmost battery is urged into contact with, and compresses, the battery contact assembly 370. Such an arrangement immediately notifies the user of improper battery installation.

Figure 36:
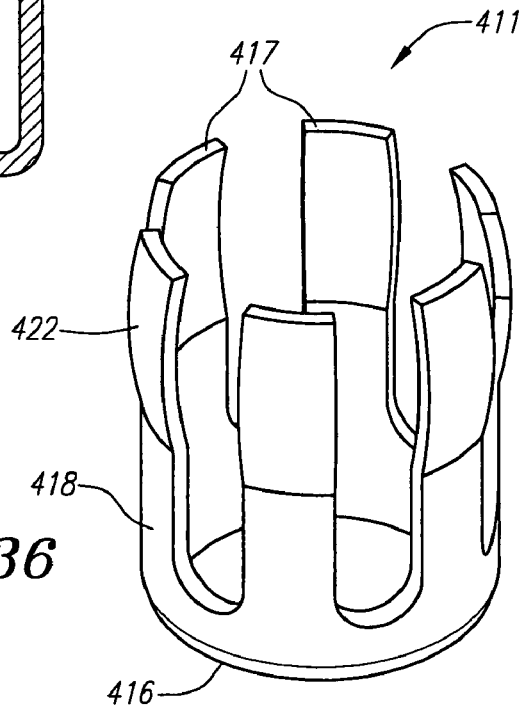
FIG. 36 is an enlarged perspective view of an upper receptacle.
Figure 37:
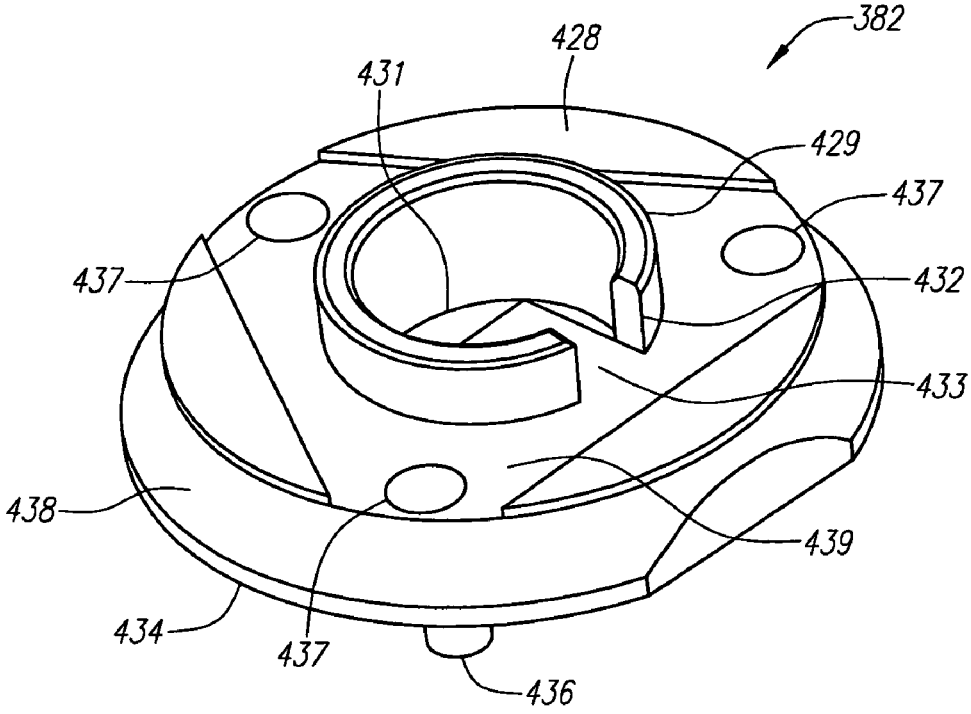
FIG. 37 is an enlarged perspective view of a middle insulator.
Figure 38:
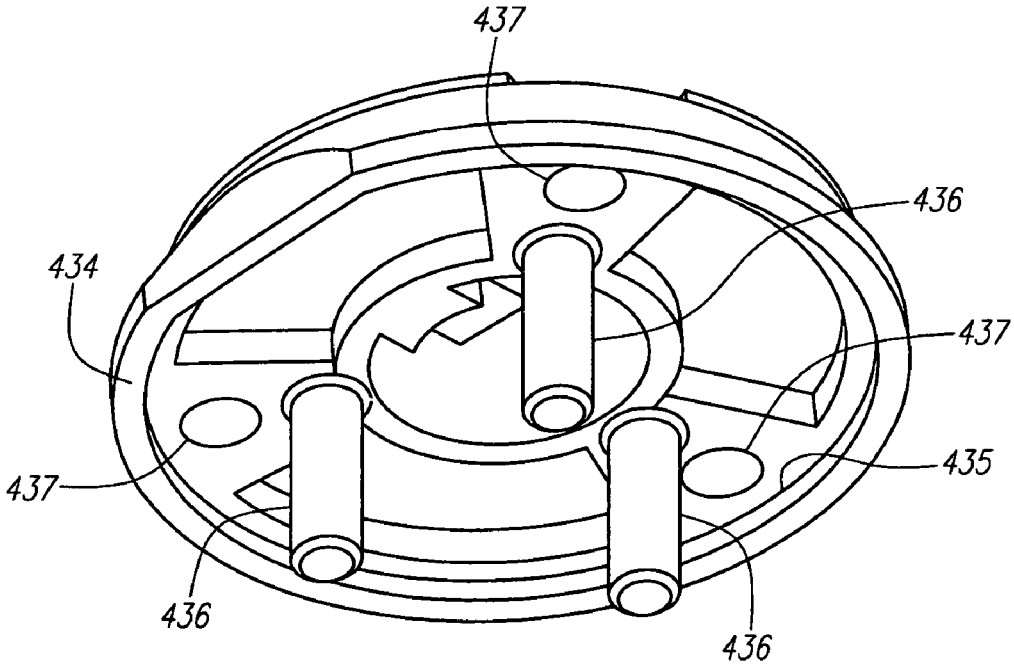
FIG. 38 is another enlarged perspective view of the middle insulator.
Figure 39:
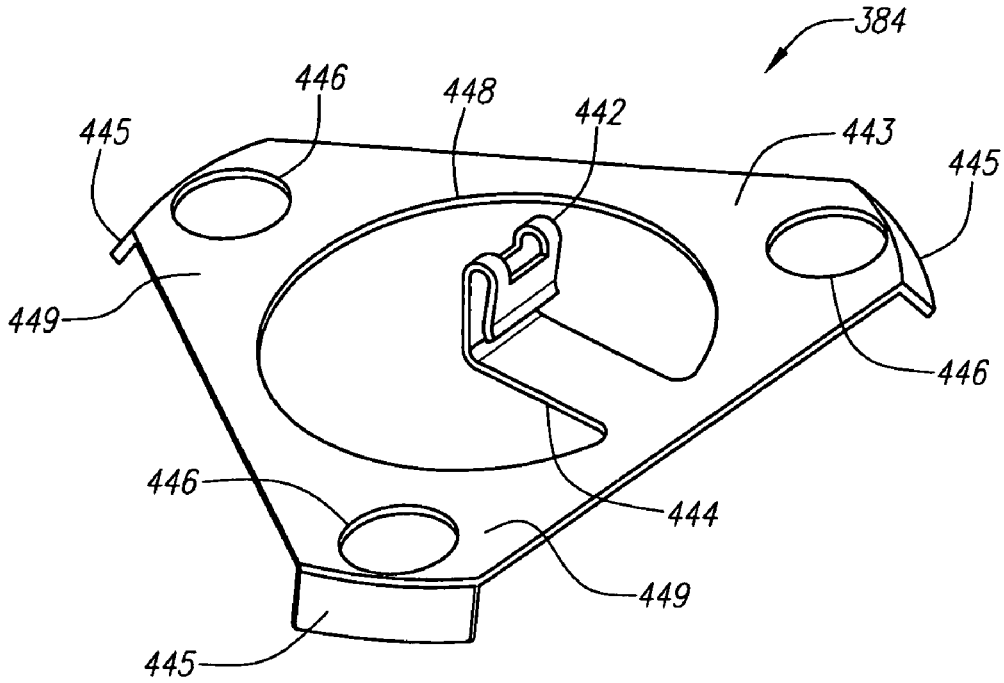
FIG. 39 is an enlarged perspective view of a second conductor.
Figure 40:
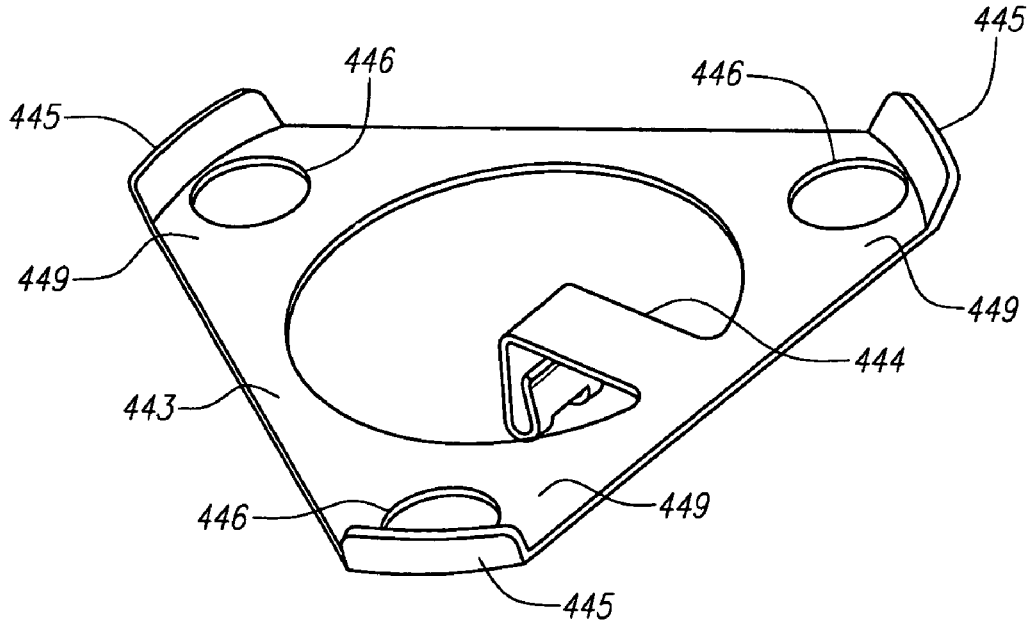
FIG. 40 is another enlarged perspective view of the second conductor.

Referring to FIG. 36, an alternate embodiment upper receptacle 411 is illustrated. The upper receptacle 411 is a scalloped receptacle including a contact end 416 and a plurality of fingers 417. The plurality of fingers 417 form a cylinder-like envelope with gaps interposed therebetween. Each finger 417 includes a straight segment 418 and a curved segment 422. The plurality of fingers 417 about the straight segments 418 define a diameter corresponding to the inside diameter of the lower receptacle 406. The outermost portions of the curved segments 422 define a diameter larger than the diameter defined by the straight segments 418 and that of the inside diameter of the lower receptacle 406.

Referring to FIGS. 30 and 31, a battery contact assembly including the alternate upper receptacle 411 is shown. The alternate upper receptacle 411 may be assembled with a lower receptacle 406 with or without the dimples 415. When the alternate upper receptacle 411 is fitted into the inside diameter of the lower receptacle 406 with the spring 409 contained therebetween, the fingers 417 flex radially inward to overcome the interference resistance offered by the inside diameter of the lower receptacle. Once assembled, the fingers 417 tend to push radially outward thereby advantageously providing an enhanced electrical connection between the upper and lower receptacles.

Referring to FIGS. 31-33, the PCB 378 rests in step 404 of the lower insulator 376. The PCB 378, among other things, may modulate the electrical energy flowing from the battery or batteries to the lamp bulb 359. The PCB 378 includes a bottom contact 423 on one side, a top contact 424 on the other side, a plurality of inner clearance holes 426, and a plurality of outer clearance holes 427. The contact end 416 of the upper receptacle 408, 411 electrically couples with the bottom contact 423 of the PCB. The top contact 424 of PCB 378 is preferably a curved and resilient spring conductor adapted to be compressible in the axial direction of the barrel 312 for electrically coupling with the first conductor 368. The PCB 378 includes three inner clearance holes 426 spaced 120 degrees from each other for receiving inner extensions 436 of the middle insulator 382. The PCB 378 includes three outer clearance holes 427 spaced 120 degrees apart from each other for receiving outer extensions 456 of the insulated retainer 374.

Referring to FIGS. 30-33 and 37-38, the middle insulator 382 mounts to the forward facing side of the lower insulator 376. The middle insulator 382, among other things, also restrains the PCB 378 and the battery contact assembly 370, and supports second conductor 384 for electrically coupling and decoupling with the barrel 312.

The middle insulator 382 may be one of many suitable configurations to support and interface with the adjacent components. In the illustrative embodiment shown in FIGS. 30-33 and 37-38, the middle insulator 382 includes a base 428, an incomplete hollow cylinder 429, an aperture 431, a cutout 432, a support tab 433, an outer perimeter wall 434, an undercut 435, a plurality of inner extensions 436, a plurality of outer clearance holes 437, a beveled surface 438 and an undercut 439.

The incomplete hollow cylinder 429 extends perpendicularly from the forward facing side of the base 428 and its inside diameter defines the aperture 431 which extends through the base 428. At the cutout 432 of the incomplete hollow cylinder 429, the support tab 429 extends radially inward and coplanar with the face of the undercut 439. The outer perimeter wall 434 is sized to abut the side wall 385 of the lower insulator 376. Preferably, the diameter defined by the outer perimeter wall 434 corresponds to the diameter defined by the side wall 385. The undercut 435 on the back side of the base 428 is sized to provide a corresponding step to the step 404 of the lower insulator 376 to contain the PCB 378 therebetween. The outer clearance holes are arranged to correspond with the outer bores 396 of the lower insulator 376. The undercut 439 has a shape corresponding to the perimeter of the mating component—the second conductor 384—and has a depth corresponding to the thickness of the second conductor 384. The beveled surface 438 extends radially between the perimeter of the forward end of the base 428 and the outer perimeter wall 434. The beveled surface 438 is preferably configured to receive the barrel contact 445 of the second conductor 384 and to engage with the taper 318 of the barrel 312. The beveled surface 438 may be beveled at a wide variety of angles. In the illustrative embodiment, an angle of approximately 30° with respect to the central axis of the barrel 312 is employed.

The inner extensions 436 secure the middle insulator 382 to the lower insulator 376. Inner extensions 436 extend perpendicularly from the rearward facing side of the base 428 and correspond to and are sized for an interference fit with the inner bores 394 of the lower insulator 376. Three inner extensions 436 are employed in the present embodiment of flashlight 300, with each extension being spaced 120 degrees from the other extensions to align with and pass through inner clearance holes 426 provided in the PCB 378 and to engage with the inner bores 394. The interference fit with the inner bore 394 may be sufficiently strong to secure the constituent components during normal use.

While the middle insulator 382 is mounted to the lower insulator 376 using inner extensions and bores, it will be appreciated by those skilled in the art that other suitable means of mounting may also be employed. For example, adhesives or ultrasonic welding may be used to secure and align the components together. Alternatively, alignment pins or slots may be used to align the constituent components. Further, an interference fit between the side wall 385 of the lower insulator 376 and the outer perimeter wall 434 of the middle insulator 382 may be used to secure the components together. However, use of inner extensions 436 as described above advantageously aligns and secures the constituent components in a simple and effective form.

Referring to FIGS. 31-33 and 39-40, the second conductor 384 receives the second electrode 358 of the lamp bulb 359 and provides an electrical conduction path to the barrel 312 when the front end assembly 340 switch is closed. The second conductor 384 is configured to fit into and rest in the undercut 439 of the middle insulator 382. In the illustrative embodiment, the second conductor 384 includes a second electrode-contact 442, a central body 443, a leg 444, a barrel contact 445, outer clearance holes 446, and a central opening 448.

The central opening 448 is sized to fit over the incomplete hollow cylinder 429 of the middle insulator 382. The leg 444, which extends radially inward from the central opening 448, is sized to fit through the cutout 432 of the incomplete hollow cylinder 429 and rest on support tab 433 of the middle insulator 382.

The second electrode contact 442 extends perpendicularly from the end of the leg 444 in the forward direction. The second electrode contact 442 is preferably offset from the center axis of the barrel 312. The second electrode contact 442 is adapted to frictionally receive and establish electrical connection with the second terminal electrode 358 of lamp bulb 359. The offset location of the second electrode contact 442 facilitates receiving the second electrode 358 of lamp bulb 359 while allowing the substantial point source of light positioned on the lamp filament 360 to be aligned to the axis of the reflector assembly 324.

The central body 443 of the second conductor 384 includes one or more arms 449 that extend radially outward. On each arm 449, a barrel contact 445 depends therefrom at an angle corresponding to the beveled surface 438 of the middle insulator 382. The outer clearance holes 446 of the second conductor 384 are disposed on the central body 443 to correspond with extensions of the upper insulated retainer 374.

The leg 444, the central opening 448, and the undercut 439 serve to align and orient the second conductor 384 to the middle insulator 382. As a result, the barrel contacts 445 are properly positioned to cup around and rest against the beveled surface 438 of the middle insulator 382; the second conductor's outer clearance holes 446 are aligned to the middle insulator outer clearance holes 437; and the second electrode contact 442 is aligned to fit into an offset slot 488 of the contact insulator 366.

Although the leg 444, the central opening 448, and the undercut 439 are employed in the illustrative embodiment to align and orient the second conductor 384 to the middle insulator 382, any or all of the three features need not be used for this purpose and other suitable and well known aligning schemes may be instead employed. For example, aligning pins, clips and other means may be used. However, the second conductor configuration 384 as described herein provides a manufacture friendly, material efficient design to provide an electrical conduction path from a generally central location to a radially outward location.

Further, although the second conductor 384 is illustrated as including three barrel contacts 445 spaced symmetrically 120° apart, more or less barrel contacts may be employed to practice the present invention.

Thus, the structure and the assembly of the front subassembly 350 has now been described. Absent further assembly, the front subassembly 350 disposed inside the barrel 312 is urged to move forward by the action of the spring 334 until barrel contacts 445 come into contact with taper 318 of the barrel 312. To minimize resistance and maximize contact area, the taper 318 of the barrel 312 is preferably angled at the same angle as the beveled surface 438 with respect to the central axis of the flashlight.

Referring to FIGS. 30-33 and 41-42 the upper insulated retainer 374, among other things, attaches to the lower insulator 376 and retains the movable components of the front end assembly 340. Further, the upper insulated retainer 374 limits axial movement of the front subassembly 350 in the rearward direction beyond a predetermined distance from the front end of the barrel 312. Upper insulated retainer 374 is partially disposed external to the front end of the barrel 312 where the front subassembly 350 is installed. Thus, the upper insulated retainer 374, among other things, keeps the front subassembly 350 from falling to the rear of barrel 312, and potentially out the tail end of the flashlight, in the absence of batteries 331 being installed in the flashlight 300.

In a preferred embodiment, the upper insulated retainer 374 comprises an annular body 451 having an outer edge 452, a center opening 453, a plurality of locking tabs 454, a plurality of extensions 456, spacers 458 and a raised center 459.

The forward facing side of the annular body 451 and the locking tabs 454 are coplanar to each other and, together, may bear against the back end abutment 349 of the reflector assembly 324 of the head assembly 330. Outer edge 461 of the locking tabs 454 may coincide with the outer edge 452 of the annular body 451. Side edges 462 of the locking tabs 454 are preferably parallel to yield a tab 454 having a constant width. Viewing from the rearward facing side of the upper insulated retainer 374, the locking tabs 454 are illustrated including a cap 464 and a relief 465. The relief 465 is disposed at the base of the locking tab and allows deflection of the tab. The cap 464 is a small raised area on the rearward facing side of the locking tab 454 for engaging with the radial ribs 518 of the actuator 364.

The rearward facing side of the annular body 451 includes the plurality of extensions 456 with spacers 458, and the raised center 459. The extensions 456 extend perpendicularly to the rearward facing side of the annular body 451. Three extensions 456 are employed in the present embodiment and are equally spaced from each other. The extensions 456 are each sized for an interference fit with the outer bores 396 of the lower insulator 376 to mount thereto. More or less extensions 456 may be employed to practice the invention.

In a preferred embodiment, the axial spacing between the movable parts of the front end assembly 340 is defined by spacers 458. In the illustrative embodiment, each spacer 458 is integral to the end of the extension 456 adjacent to the annular body 451. Preferably, the spacers 458 are each configured as a segment of a hollow cylinder having a center line coincident with the center line of the center opening 453. Each spacer 458 also includes a shoulder 463 that abuts against the second conductor 384 disposed on the front end of subassembly 350. Accordingly, the axial height of spacers 458 defines the axial spacing between the annular body 451 of the upper insulated retainer 374 and the front subassembly 350. The shoulder 463 further serves to secure the second conductor 384 against the undercut 439 of the middle insulator 382.

Also on the rearward facing side of the upper insulated retainer 374 is the raised center 459. The raised center 459 includes the rearward end of the center opening 453 and holder slots 466. The raised center 459 is a hollow cylinder having a constant outer diameter and an inside contour defined by the center opening 453.

Figure 41:
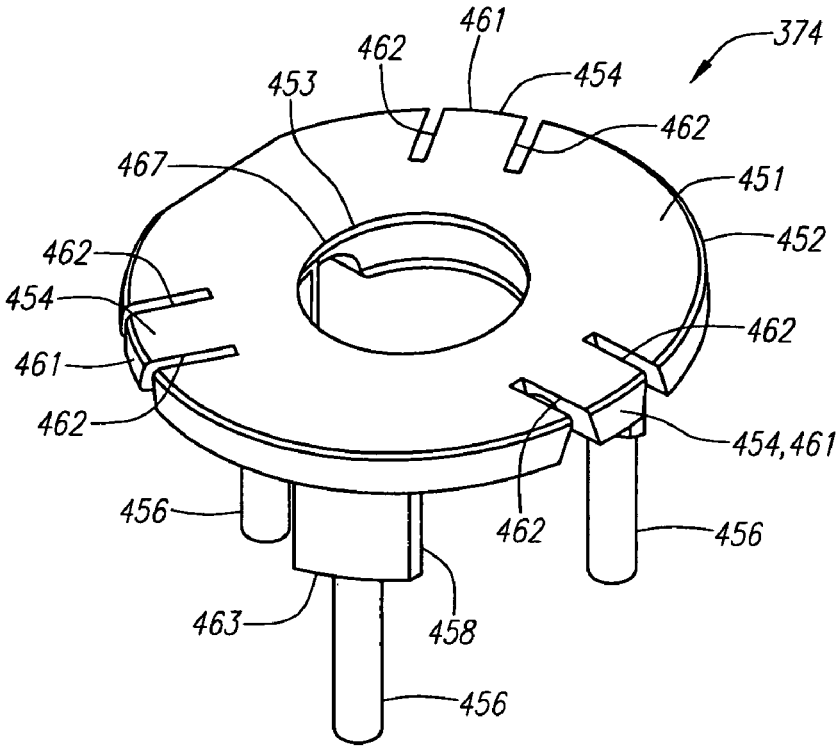
FIG. 41 is an enlarged perspective view of an upper insulated retainer.
Figure 42:
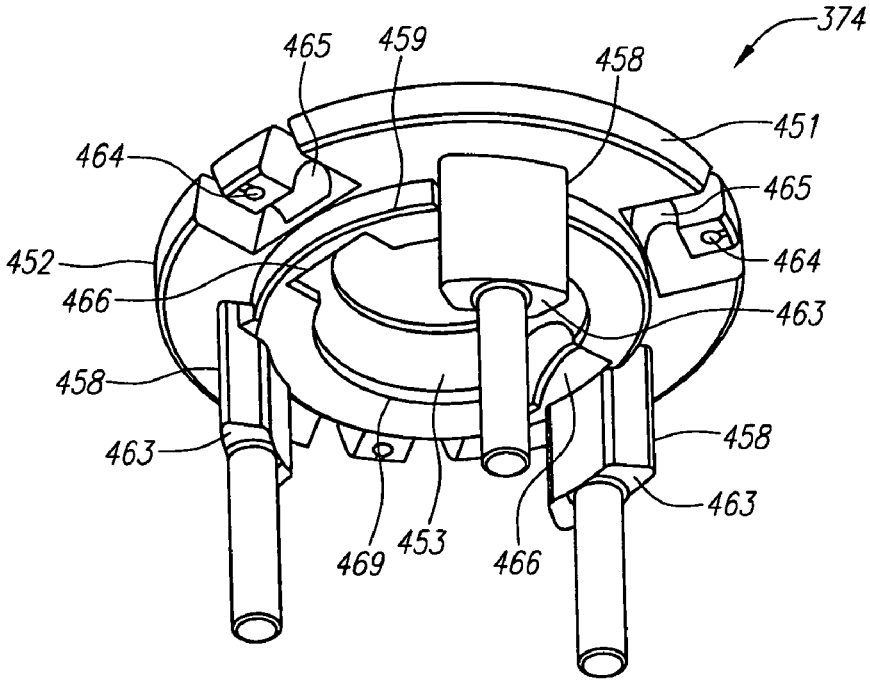
FIG. 42 is another enlarged perspective view of the upper insulated retainer.

In a preferred embodiment, the center opening 453 generally has a concave contoured surface and facilitates the movement of the movable lamp bulb holder 372. Referring to FIGS. 31, 41 and 42, the center opening 453 includes a first diameter 467 on the forward facing side of the annular body 451 that non-linearly increases in size as it extends to the rearward facing side of the annular body 451 to a second diameter 469. As will be described in more detail, the movable lamp bulb holder 372 includes a corresponding convex contour surface, which when contained within the center opening 453, facilitates motion of the movable lamp bulb holder 453 without binding.

The raised center 459 also includes holder slots 466. The holder slots 466 are configured to receive the holder tabs 476 of the movable lamp bulb holder 372 and facilitates rotation of the movable lamp bulb holder 372 about an axis of rotation defined by the holder tabs 476.

As best seen in FIG. 42, the holder slots 466 of the upper insulated retainer 374 are disposed on the raised center 459 opposite from each other and each extends radially outward from the center opening 453. In a preferred embodiment, the holder slots 466 have a semi-circle cross-section and have the open end facing the rearward facing side of the raised center 459.

Referring to FIGS. 30-33, 43A and 43B, the movable lamp bulb holder 372, among other things, holds the lamp bulb 359 and rotates relative to the axis of the reflector assembly 324. The movable lamp bulb holder 372 may include any configuration suitable to receive a lamp bulb and move in response to actuating pressure. In the illustrative embodiment shown in FIGS. 30, 31, 43A and 43B, for example, the movable lamp bulb holder 372 includes a body 471, a lamp receptacle 472, convex outer profile 474, a pair of holder tabs 476, slots 478 and a holder base 413.

The receptacle 472 is configured to receive the lamp bulb 359. The receptacle 472 includes a raised hollow cylinder 473 and lamp electrode apertures 475. The raised hollow cylinder 473 is sized to receive the lamp bulb 359 and provides lateral support thereto. The electrode apertures 475 are sized to receive the electrodes 357, 358 extending from the lamp bulb 359.

Although a cylinder/aperture-type receptacle 472 is described and illustrated herein, other suitable means known in the industry may be employed to receive or facilitate receiving the lamp bulb without deviating from the present invention. For example, a discontinuous cylinder, raised tabs or a counterbore may be used to provide lateral support. In fact, a cylinder is not needed to hold the lamp bulb 359—the apertures 475 can facilitate the electrodes to frictionally engage with electrode contacts that sufficiently holds the lamp bulb in place as shown in FIG. 30. Further, slots, clips or clamps may be employed to securely hold the lamp bulb.

The rearward facing side of the movable lamp bulb holder 372 includes the holder base 413 and a pair of mating slots 478 for mating with the contact insulator 366. In the illustrative embodiment, each mating slot 478 is a cavity configured as a partial segment of a hollow cylinder for mating with contact insulator 366.

Preferably, the body 471 has a convex outer profile 474 that corresponds to the concave contour of the center opening 453 of the upper insulated retainer 374. Accordingly, the first diameter 477 on the forward facing side of the body 471 increases non-linearly as it extends to the rearward facing side and ends at the-second diameter 479. Preferably, the non-linearity and the dimensions of the center opening 453 contour and the convex outer profile 474 are such that when the two components are assembled and caused to move relative to each other, no binding between the parts will be experienced. Arranged this way, the movable lamp bulb holder 372 is able to move about the cavity defined by the center opening 453 of upper insulated retainer 374.

In a preferred embodiment of the upper insulated retainer 374 and the movable lamp bulb holder 372, the non-linear contours of the mating parts have a 0.25 inch radius. However, any suitable profile and dimension may be employed to configure the inside feature of the center opening 453 and the convex outer profile 474 to achieve a relatively movable set of mating components. As will be appreciated by those skilled in the art, a mating/matching contour is not essential to facilitate movement of the movable lamp bulb holder 372 relative to the upper insulated retainer 374. All that is required is clearance between the parts as relative movement occurs. However, the configuration described provides clearance for relative movement and also serves to prevent the movable lamp bulb holder 372 from falling into the reflector assembly 324

The holder tabs 476 define an axis of rotation 481 of the movable lamp bulb holder 372. The holder tabs 476 are configured to rotatably mate with the holder slots 466 of the upper retainer 374. In a preferred embodiment, the holder tabs 476 have a semi-circle cross-section to provide a non-binding relative movement between the movable lamp bulb holder 372 and the upper insulated retainer 374. Although a semi-circle configuration is shown, those skilled in the art will appreciate that other suitable mating contours may be employed. For example, as the holder slot 466 is defined as having a semi-circle cross-section, the holder tabs 476 may have, among others, a semi-circular, a circular, or a hollow cylindrical cross section.

Alternatively, slots instead of tabs may define the axis of rotation 481 in the movable lamp bulb holder 372. In such a configuration, the upper insulated retainer 374 may include tabs that mate and correspond with the slots.

Referring to FIGS. 30-33, 44A and 44B, the contact insulator 366 mounts to the movable lamp bulb holder 372 and mechanically couples the movable lamp bulb holder 372 to an actuating source. In a preferred embodiment, the contact insulator 366 also houses the first conductor 368 and receives the electrode contact 442 of the second conductor 384. The contact insulator 366 includes a base 482, mating posts 483, a first follower arm 484, a second follower arm 485, a central extension 486, a through hole 487, a first slot 488 and a second slot 489.

The mating posts 483 extend generally perpendicularly from the forward facing side of the base 482 and are configured to mate with the pair of mating slots 478 of the movable lamp bulb holder 372 to assemble therewith. The base 482 butts against the holder base 413 of the movable lamp bulb holder 372 when the mating posts 483 are inserted into the mating slots 478. In a preferred embodiment each mating post 483 is a partial segment of a hollow cylinder correspondingly sized for an interference fit with the mating slot 478 of the movable lamp bulb holder 372. Suitable mating features that may be used to assemble the movable lamp bulb holder 372 and the contact insulator 366 include, among others, circular posts and bore, clips, or assembly using an adhesive, as well known in the art. However, the mating slots and posts configuration as illustrated herein provides a convenient way to secure and align the mating components.

The first and second follower arms 484, 485 depend from the base 482. The follower arms 484, 485 are disposed opposite each other and extends radially outward from the outer edge of the body 482. Further, when the contact insulator 366 is assembled with the movable lamp bulb holder 372, the follower arms 484, 485 are preferably disposed 90° from the two holder tabs 476. The follower arm optionally includes a curved shoe 491 on the rearward facing side. The curved shoe 491 may be integrally formed on the follower arm and has a raised circular arc segment as shown in FIG. 31.

The central extension 486 extends perpendicularly from the central region of the rearward facing side of the base 482. The central extension 486 is a supporting structure to electrically couple the lamp bulb 359 to the first conductor 368 and the second conductor 384.

Figure 44A:
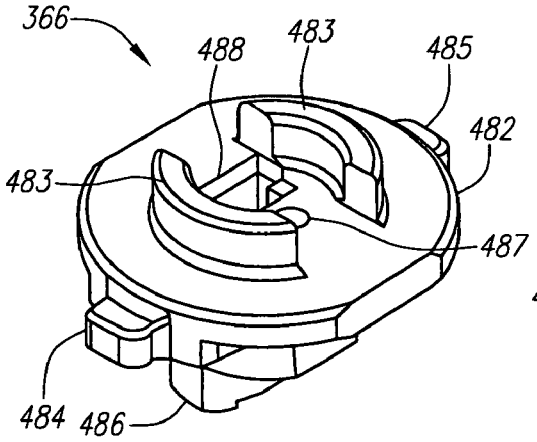
FIG. 44A is an enlarged perspective view of a contact insulator.
Figure 44B:
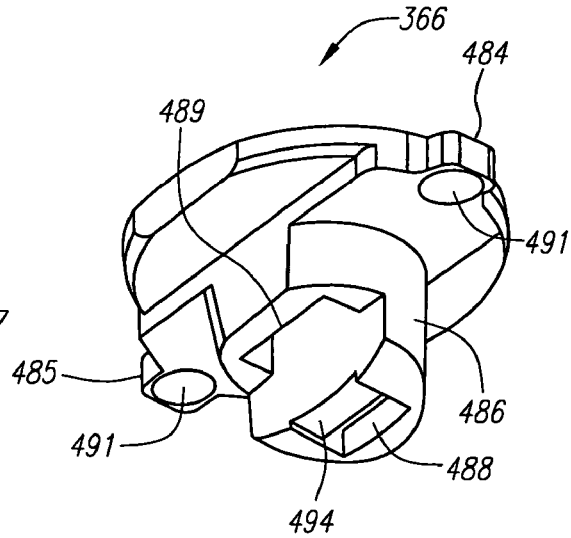
FIG. 44B is another enlarged perspective view of the contact insulator.
Figure 45:
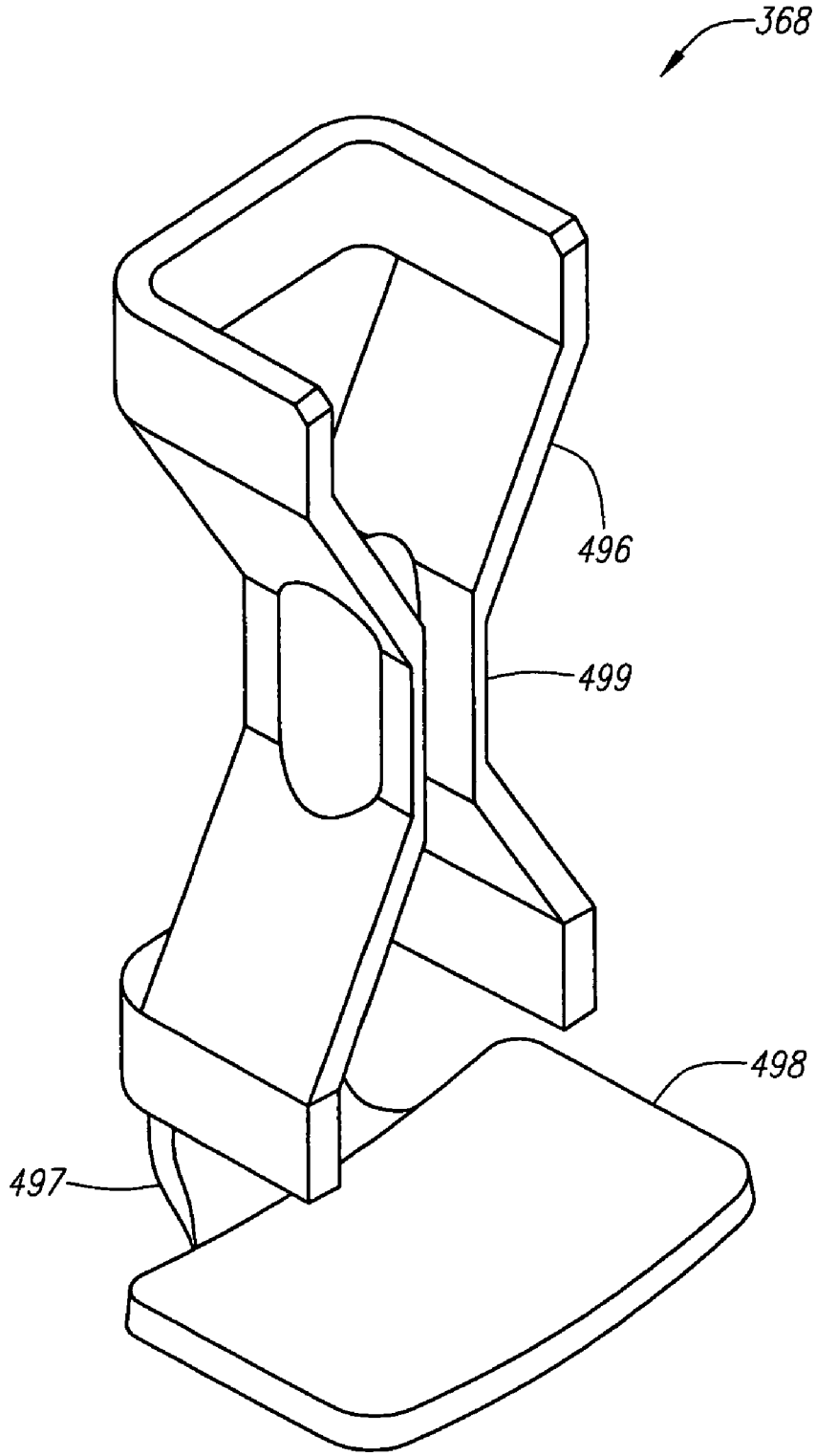
FIG. 45 is an enlarged perspective view of a first conductor.
Figure 46:
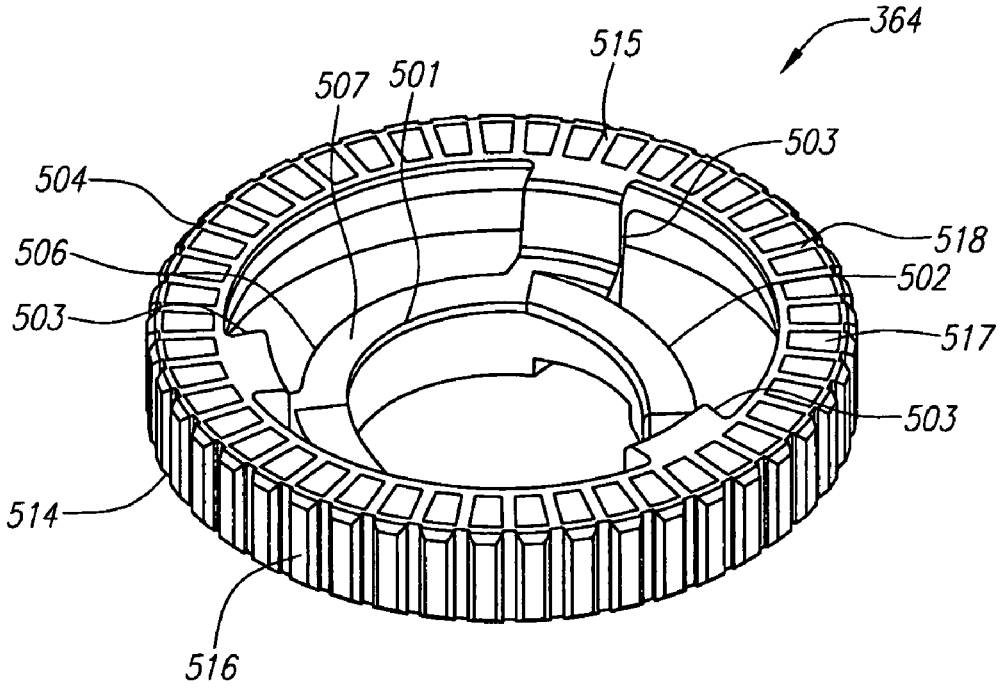
FIG. 46 is an enlarged perspective view of an actuator.
Figure 47:
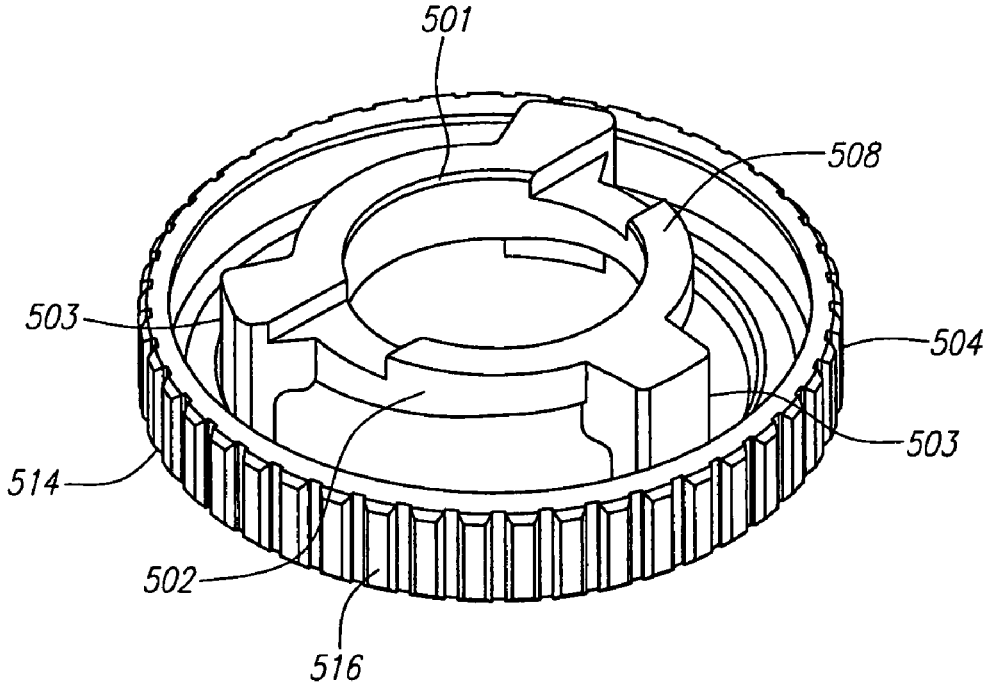
FIG. 47 is another enlarged perspective view of the actuator.

The first slot 488 is a through slot that extends axially from the rearward facing side of the central extension 486 to the forward facing side of the base 482. The first slot 488 is aligned with one of the electrode apertures 475 of the movable lamp bulb holder 372. Most clearly shown in FIG. 30, the first slot 488 includes a large cavity 492 biased to the forward facing side and a small cavity 493 biased to the rearward facing side. Referring to FIGS. 31 and 44B, a curved undercut 494 is disposed adjacent to and substantially perpendicular to the first slot 488 on the rearward facing side of the central extension 486. Preferably, the curved undercut matches the characteristic features of the lower contact 498 of the first conductor 368, as will be described in more detail.

Referring to FIGS. 30-33 and 45 the first conductor 368 is disposed in the first slot 488 and includes an electrode contact 496, an arm 497 and a lower contact 498. In a preferred embodiment, the electrode contact 496 is made from a sheet of a conductor material that is formed to an hour-glass shape having a neck 499. The narrow neck 499 in the hour-glass shape illustrates one way of frictionally receiving an electrode to establish an electrical connection. To facilitate the shaping/forming of the sheet of conductor material, relief cuts in the sheet may be employed. Extending from the electrode contact 496 is the arm 497 and the lower contact 498. In the illustrative embodiment, the lower contact 498 is rectangular in shape and conforms with the curved undercut 494 on the rearward facing side of the central extension 486.

The electrode contact 496 of the first conductor 368 is disposed in the large cavity 492 of the first slot 488. The arm 497 is generally disposed in the small cavity 493 and the lower contact 498 cups around the first slot exit and rests and conforms to the contour of the curved undercut 494. Preferably, the depth of the undercut 494 is less than the thickness of the lower contact 498 so that the lower contact 498 defines the outermost curved profile disposed on the rearward side of the contact insulator 366.

Based on the foregoing description of the movable lamp bulb holder 372, the first conductor 368 and the contact insulator 366, when the lamp bulb's first electrode 357 is installed into the receptacle 472 of the lamp bulb holder 372, the electrode extends through the electrode aperture 475 and into the first slot 488 of the contact insulator 366 whereat the electrode contact 496 of the first conductor 368 is disposed. The neck 499 of the electrode contact 496 is sized to frictionally receive and retain electrode 357 of the lamp bulb. The axial length of the lamp bulb electrode, the movable lamp bulb holder 372 and the contact insulator 366 is dimensioned such that the lower contact 498, which rests and conforms to the curved contour of the rearward facing end of the central extension 486, contacts the flexible top contact 424 of the PCB 378 to achieve electrical connection thereto.

The lower contact 498 of the first conductor 368 and the flexible top contact 424 of the PCB advantageously provides a relationship between the conductors such that even where there is movement or rotation of the movable lamp bulb holder 372, an electrical connection may be maintained between the lamp bulb electrode and the PCB as the contact follows the curvature of lower contact 398.

Referring to FIGS. 30 and 44B, the second slot 489 in the central extension 486 is a substantially blind slot that extends forward in the axial direction from the rearward facing side of the central extension 486. Preferably, the central extension 486 is positioned such that the exit edges of the first slot 488 and the second slot 489 are axially offset from the center line of the lower insulator 376. The second slot 489 is sized to receive the second electrode contact 442 of the second conductor 384, and extends in the axial direction and communicates with the through hole 487 extending from the forward facing side of the base 482. The through hole 487 and the first slot 488 are further aligned with one of the electrode apertures 475 of the movable lamp bulb holder 372.

Thus, when the lamp bulb's second electrode 358 is installed into the receptacle 472 of the lamp bulb holder 372, the electrode extends through the electrode aperture 475 and through the hole 487 of the contact insulator 366 and into the second electrode contact 442 disposed in the second slot 489. The second electrode contact 442 is adapted to frictionally receive and retain electrode 358 of the lamp bulb.

Advantageously, by arranging the first and second slots offset from the centerline of the lower insulator 376, once the front end assembly 340 is assembled, the lamp bulb may be substantially aligned to the barrel centerline. More particularly, by offsetting the first and second slots equidistant and on opposite sides of the barrel centerline, the point source of light positioned on the lamp bulb filament is in a better position to align with the reflector axis and the focal point.

Referring to FIGS. 30-33 and 46-47, actuator 364 is coupled to the first and second follower arms 484, 485 of the contact insulator 366 for moving the movable lamp bulb holder 372 and the lamp bulb 359.

In a preferred embodiment, the actuator 364 is in part interposed between the contact insulator 366 and the middle insulator 382. The actuator 364 includes a central clearance 501, a cam ring 502, radial supports 503 and actuator ring 504. The inside diameter of the cam ring 502 defines the central clearance 501. The central clearance is sized to provide access for the central extension 486 of the contact insulator 366 to reach and electrically couple with the top contact 424 of the PCB.

Figure 48A:
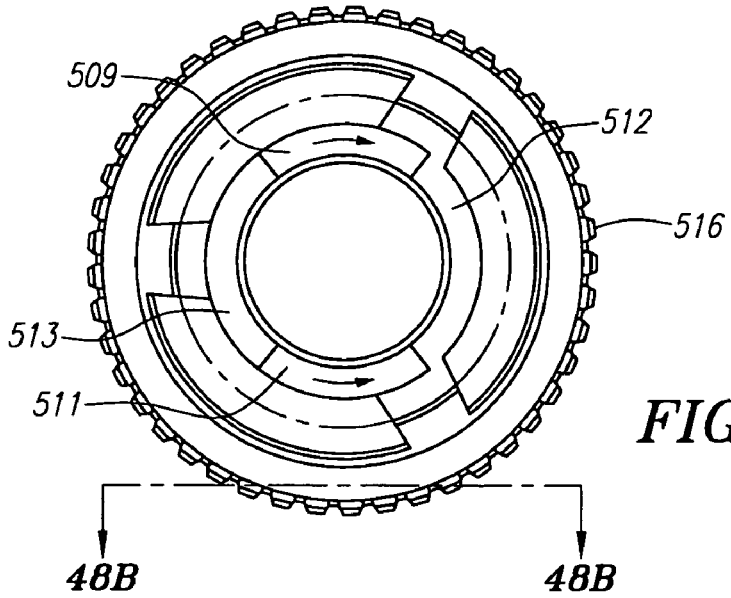
FIG. 48A is a plan view of the actuator.

The cam ring 502 is a face or barrel cam and includes a hollow cylinder 506, a forward end 507 and a rearward end 508. The diameter of the hollow cylinder 506 is sized such that the forward end 507 of the cam ring 502 slidably engages the first and second follower arms 484, 485 of the contact insulator 366. Optionally, the forward end 507 may support the follower arms 484, 485 at the curved shoe 491 location, if a curved shoe feature is present. The axial rise and fall of the forward end 507 in the circumferencial direction defines the rise, return and dwell of the follower arm. Referring to FIG. 48A, the first and second transition segments 509, 511 of the forward end 507 are preferably equal in configuration and symmetrically disposed opposite each other. The first and second transitions 509, 511 may extend 60°-90° around the circumference of the forward end 507 with a maximum rise or lift of 0.045-0.075 inch. In the embodiment shown, the first and second transitions 509, 511 each extends 75° around the circumference with a lift of 0.060 inch. Interposed between the transitions 509, 511 are high dwell 512 and low dwell 513.

The rearward end 508 is generally perpendicular to the centerline of the hollow cylinder 506. When the upper insulated retainer 374 is installed, the rearward end 508 of the actuator 364 abuts the second conductor 384.

Plurality of radial supports 503 fixedly connects the cam ring 502 and actuator ring 504 in a concentric arrangement. Each radial support 503 extends radially outward from the outer diameter of the cam ring 502 and connects to and inside feature of the actuator ring 504. The clearance between the supports allow the extensions of the upper insulator retainer 374 to pass through.

The actuator ring 504 includes a tubular ring 514 and a flange 515. The flange 515 depends radially inward from the forward end of the tubular ring 514. The tubular ring 514 includes axial ribs 516 on the outer surface for engaging with an alignment ring 519 (See FIG. 30). The axial ribs 516 are generally arranged parallel to the center line of the tubular ring 514. The number of ribs which may be employed for the purpose of engaging with the alignment ring 519 may vary. In the illustrative embodiment shown, there are forty-four ribs each with a height of 0.015 inch. The flange 515 includes a rack 517 on the forward facing side. The rack 517 includes radial ribs 518 and slots 505 interposed between the radial ribs 518. The rack 517 interfaces with the cap 464 of the locking tab 454 of the upper insulated retainer 374. As most clearly illustrated in FIG. 48B, the illustrative embodiment includes sixty ribs each with a height of 0.015 inch and each rib has a 40° taper on either side. The inside diameter of the tubular ring 514 is sized to fit over the front lip 317 of the barrel 312 and contributes to maintaining centerline alignment between the front end assembly 340 and the barrel centerline 312.

Referring to FIGS. 30 and 31, the alignment ring 519 is mechanically coupled to the actuating ring 504 and serves to radially extend the actuating ring 504 so that the user may advance the actuator 364. In this regard, the alignment ring 519 and the actuating ring 504 may be integral and be formed as a single component. The alignment ring 519 includes inside ribs and outside ribs. The inside ribs are oriented in the axial direction and correspond to and mate with the axial ribs 516 of the actuator ring 504. Configured this way, the inside ribs of the alignment ring bear against the axial ribs 516 and rotate the actuator 364 when the alignment ring 519 is rotated about its axis. The outside ribs of the alignment ribs are disposed on the outer diameter of the alignment ring 519 and provides a textured surface to enhance friction with the user when rotating the alignment ring 519.

Figure 49:
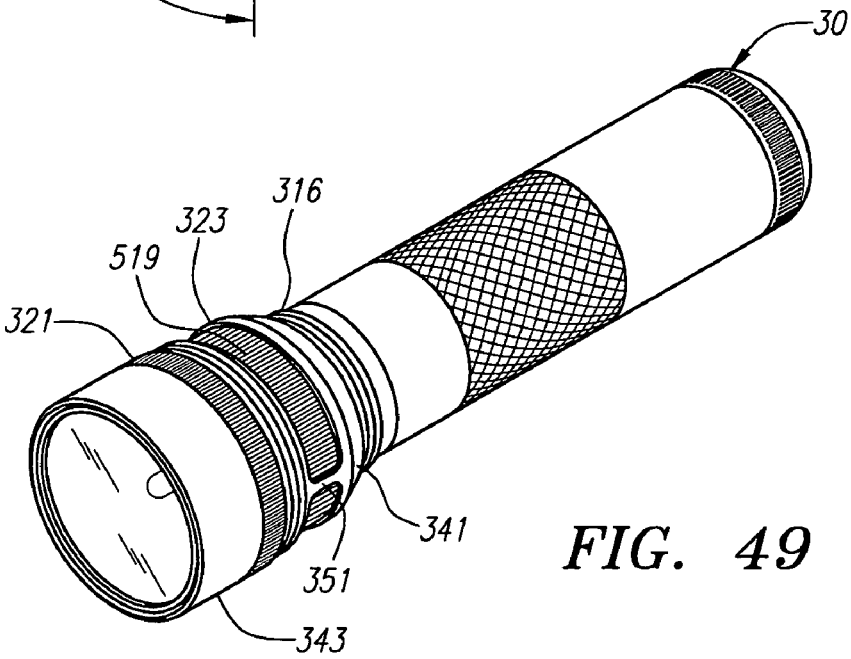
FIG. 49 is a perspective view of the flashlight of FIG. 28 with an outer sleeve of the head assembly removed.

Referring to FIGS. 30, 31 and 49, the head assembly 330 (shown in FIG. 49 without the sleeve 342) is disposed forward of the front end assembly 340, and is movably mounted to the barrel's threaded portion 316. The head assembly 330 of a preferred embodiment comprises a head 341, a face cap 343, a sleeve 342, a lens 355 and a reflector assembly 324.

The head 341 is configured, among other things, to have sufficient stiffness to rigidly retain the reflector assembly 324 and lens 355 against the face cap 343 on the forward end; movably mount to the barrel and support the sleeve 342 on the rearward end; and to provide access for the user to actuate the movable lamp bulb holder 372. In the illustrative embodiment, the head 341 includes front outer threads 319, a grip diameter 321, windows 323, back inner threads 353, and back outer threads 327.

On the front end of the head 341, front outer threads 319 are formed to mate with the threads of the face cap 343 to fixedly retain the lens 355 and the reflector assembly 324 therebetween. The reflector assembly 324, at its flange 339, is secured about the front end of the head 341 where it is rigidly held in place by the lens 355 which is in turn retained by the face cap 343 which is engaged with mating threads formed on the front outer threads 319 of the head 341. Arranged this way, the lens 355 and the reflector assembly 324 are securely retained and the axis of the reflector assembly 324 coincides with the axis of the head assembly 323 and the axis of the barrel 312 when the flashlight is fully assembled.

Referring to FIGS. 29 and 31, in a preferred embodiment, the reflector assembly 324 includes the flange 339, a reflector 345, a first open end 347 for emitting a beam of light at one end of the reflector, a second end 348 at the other end of the reflector, and an abutment 349. Preferably, the reflector 345 is an axisymmetrical and substantially parabolic reflective surface. The axis 325 of the reflector 345 may be defined by the first open end 347 and the second open end 348.

Referring to FIG. 31, the flange 339 of the reflector assembly 324 may be disposed towards the front end of the reflector 345, adjacent to the first open end 347, and may be configured to receive securing means to fixedly mount the reflector assembly 324 between the head 341 and the face cap 343. The abutment 349 is on the rearward facing end of reflector assembly 324 for bearing against the forward facing sides of the annular body 451 and the locking tabs 454 of the upper insulated retainer 374. The abutment 349 is substantially perpendicular to the axis of the reflector 345. The abutment 349 may, for example, comprise a concentrically formed ledge around the outer surface of the reflector assembly 324. Alternatively, abutment 349 may comprise a plurality of ledges formed in a series of ribs or fins provided on the exterior surface of reflector assembly 324.

The second end 348 of the reflector assembly 324 provides access for the lamp bulb to be disposed within the cavity defined by the reflector 345. In a preferred embodiment, the second end 348 is an opening generally disposed about the vertex of the parabola and is co-axial with the axis 325 of the reflector 345. The second end 348 is sized to receive the lamp bulb 359 and the receptacle 472 of the movable lamp bulb holder 372. In a preferred embodiment, the second end 348 is a circular opening, however, other suitable configurations that provide for the lamp bulb to be disposed within the cavity defined by the reflector 345 and that allows movement of the lamp bulb therein may be employed.

On the rearward facing end of the head 341, back inner threads 353 are formed to mate with threads 316 formed on the barrel 312 for movably mounting the head assembly 330 thereto. Back outer threads 327 are formed to mate with corresponding threads on the sleeve 342 for removably mounting the sleeve 342 to the head assembly 330.

Referring to FIG. 49, the mid section of the head 341 includes windows 323 for providing the flashlight user access to the alignment ring 519 for moving the movable lamp bulb holder 372. In a preferred embodiment, two windows are arranged opposite each other, with each window being a generally rectangular opening. The windows 323 are axially located to align with the position of the alignment ring 519 and properly sized to provide the user's, for example, thumb to advance the alignment ring 519.

Referring to FIGS. 30 and 31, the sleeve 342 protects the inner components of the flashlight from contamination by covering the windows 323 after the substantial point source of light aligning steps are taken. The sleeve 342 is generally a hollow cylinder having a tapered outside surface. The sleeve 342 includes threads formed on its inside surface to mate with the back outer threads 327 of the head 341. The mating threads location may be disposed at any location suitable to mate with the head 341. For example, as shown in FIGS. 30 and 31, the mating threads are disposed in the axial forward end of the sleeve 342. Alternatively, the mating threads may be disposed on the axial mid section of the sleeve 342, depending on the location of the back outer threads 327 of the head 341. The head 341 may also include surface texturing about its grip 321, such as for example ribs or machined knurling.

A sealing element, such as an O-ring, may be incorporated at the interface between the face cap 343 and the lens 355, the face cap 343 and the head 341, the sleeve 342 and the head 341, and sleeve 342 and the barrel 312 to provide a watertight seal.

The tail cap assembly 20 of flashlight 10 may also be used for flashlight 300. As described previously, the tail cap assembly 20 includes a spring member 334 that urges the batteries 331 forward. Referring to FIG. 29, when the tail cap assembly 20 is installed onto the barrel 312, the spring member 334 is disposed within the barrel 312 to form an electrical path between a case electrode 335 of an adjacent battery 331 and the tail cap 322. An electrical path is further formed between the tail cap 322 to the barrel 312 through the flange 351 and/or the external threads 332. The spring member 334 also urges the batteries 331 forward towards the front end assembly 340. As a result, a center electrode 337 of the rearmost battery 331 is in electrical contact with the case electrode of the forwardmost battery 331, and the center electrode 338 of the forwardmost battery 331 is urged into contact with the spring biased battery contact assembly 370 on the front end assembly 340.

The barrel 312, tail cap 322, head 341, face cap 343 and sleeve 342, forming all of the exterior surfaces of the flashlight 300 are manufactured from aircraft quality, heat treated aluminum, which is anodized for corrosion resistance. All interior electrical contact surfaces are preferably appropriately formed or machined to provide efficient electrical conduction. All insulating components are preferably made from polyester plastic or other suitable material for insulation and heat resistance. The reflector 345 is preferably provided with a computer-generated parabolic reflecting surface that is vacuum aluminum metallized to ensure high precision optics.

Front end assembly 340 is adapted to close the electrical path between the lamp bulb and batteries in response to axial movement of the head along the barrel and to open the electrical path in response to axial movement of the head in the opposite direction. It will be appreciated, however, that other types of switches that are commonly used in flashlights may also be employed with the other aspects of the invention described herein.

Referring to FIGS. 29-31, the electrical circuit of flashlight 300 according to the present embodiment of the invention will now be described. Electrical energy is conducted from the rearmost battery through its center contact which is in connection with the case electrode of the forwardmost battery 331. Electrical energy is then conducted from the forwardmost battery through its center electrode to the battery contact assembly 370 which is coupled to the PCB 378 which in turn is coupled to the first conductor 368 which is coupled to the first electrode 357 of the lamp bulb 359. After passing through the filament 360 of the lamp bulb 359, the electrical energy emerges through lamp electrode 358 which is coupled to the second conductor 384. When the head 341 of the head assembly 330 is sufficiently screwed onto the threaded portion 316 of the barrel 312, abutment 349 of the reflector assembly 324 bears against the forward facing side of the upper insulated retainer 374 and urges axial translation of the front end assembly 340 in a rearward direction. As the upper insulated retainer 374 is in a fixed axial relationship with the barrel contacts 445 of the second conductor 384, continuing to screw the head 341 onto the barrel 312 causes the barrel contacts 445 to translate rearwardly and creates a space between the barrel contacts 445 and the taper 318 of the barrel 312. The second conductor 384 is thus separated from contact with the barrel 312 as shown in FIG. 42 and the electrical circuit is opened.

Unscrewing the head 341 about the axis of the barrel 312 causes the head assembly 330, including the reflector assembly 324, to translate in the forward direction. The forward axial movement of the reflector assembly 324 enables the front end assembly 340 to be moved forward a like distance by the urging of the spring 334 disposed in the tail cap assembly 320 translating the batteries forward. Sufficient forward axial displacement will bring the barrel contacts 445 to be in contact with the taper 318 of the barrel 312, which closes the electrical circuit. Moreover, once the barrel contacts 445 contact the taper 318 of the barrel, the front end assembly 340, and the lamp bulb 359 held thereby, are prevented from translating forward any further. The battery urged forward by the spring 334 disposed in the tail cap assembly holds the front end assembly 340 against the taper 318 of the barrel 312.

In this manner the front end assembly 340 is adapted to close the electrical path to illuminate the lamp bulb in response to axial movement of the head assembly 330 along the barrel 312 and to open the electrical path in response to axial movement of the head assembly in the opposite direction.

However, the head assembly 330, and the reflector assembly 324 contained therein, may be rotated and translated still further while the front end assembly 340 remain in a fixed position. Thus, by continuing to translate the reflector assembly 324, relative shift in the position of the substantial point source of light with respect to the focal point 326 of the reflector 345 is effectuated. Thus, such an arrangement advantageously facilitates controllably translating the head assembly 330 for positioning the substantial point source of light axially along the axis of the reflector to yield a high intensity light to emanate through the lens 355. Further, such an arrangement to change the relative axial position of the substantial point source of light with respect to the reflector's focal point facilitates varying the dispersion of light emanating from the lamp bulb 359 through the lens 355.

Those skilled in the art will appreciate that the fidelity-in the translation of the head assembly, and therefore the axial positioning of the substantial point source of light, in the illustrative embodiment is governed by the type of threads that are employed on threads 316, 353 of the barrel 312 and head 341, respectively. However, other suitable translation means may be employed to practice the present invention.

An additional utilization of the flashlight 310 in accordance with the present invention is achieved by rotatably translating the head assembly 330 until the head assembly 330 is completely disengaged from the barrel 312. By placing the head assembly 330 upon a substantially horizontal surface such that the face cap 343 rests on the surface, the tail cap 322 of the flashlight may be inserted into the head to hold the barrel 312 in a substantially vertical alignment. Since the reflector 345 is located within the head assembly 330, the lamp bulb 359 will emit a substantially spherical or candle-like illumination, thereby providing an ambient light level.

In use as a means for moving the light source in a substantially lateral direction, the front end assembly 340 facilitates aligning the substantial point source of light with the reflector axis 325.

The fully assembled flashlight 300 has the lamp bulb 359 held in the movable lamp bulb holder 372 and extended through the opening 347 of the reflector assembly 324. Preferably during the point source of light alignment process, the flashlight 300 is turned on so that the user is able to see the shape of the light beam emanating from the lens 355 by, for example, projecting the light against a flat surface. The user may disengage the sleeve 342 from the head 341 by relatively rotating the respective parts before or after the flashlight 300 is turned on. Once the sleeve 342 is free from the head 341, the sleeve 342 may be moved out of the way by sliding it in the rearward direction over the outer surface of the barrel 312. With the sleeve 342 disengaged from the head 341, the user has access to the alignment ring 519 for moving the substantial point source of light relative to the reflector axis as shown in FIG. 49.

The alignment ring 519 is accessible to the user through windows 323 on the head 341. While viewing the light beam shape projected on the flat surface, the user advances or rotates the alignment ring about the central axis of the flashlight 300. The axial ribs on the alignment ring 519 advantageously provides friction between the alignment ring 519 and the user's finger or thumb to ease advancing or rotating the alignment ring 519.

As inside diameter of the alignment ring 519 is mechanically coupled to the axial ribs 516 of the actuator ring 504, advancing the alignment ring 519 advances the actuator 364. Because the radial supports 503 of the actuator 364 are disposed between spacers 458 of the upper insulated retainer 374, the rotation of the actuator 364 is limited to the circumferential clearance between the spacers. In the illustrative embodiment, the actuator 364, once assembled, has a rotational range of approximately 60°. Those skilled in the art may readily appreciate that the rotational range may be increased or decreased.

For the purpose of describing the operation of the front end assembly 340, "zero-tilt" shall mean the condition wherein the front face of the body 471 of the movable lamp bulb holder 372 is substantially perpendicular to the reflector axis. Accordingly, the zero-tilt condition is achieved when the first and second follower arms 484, 485 each rests on the cam ring 502 at a location 180° apart that has the same axial height. Such a location is at the circumferential mid point of the first and second transition segments 509, 511. Thus, starting from the zero-tilt position, when the cam ring 502 is advanced by rotating the actuator ring 504 in one direction, the first follower arm 484 travels up the ramp of the first transition segment 509 while the second follower arm 485 travels down the ramp of the second transition segment 511 by an equal amount. The movable lamp bulb holder 372, fixedly installed onto the contact insulator 366 and operatively coupled to the cam ring 502, will then rotate about the axis of rotation 481 in one direction and move off zero-tilt. Consequently, the substantial point source of light positioned on the lamp bulb filament will be caused to displace in an arcuate path in a substantially perpendicular direction relative to the reflector axis.

Subsequently, when the cam ring 502 is advanced in the opposite direction, the first follower arm 484 travels down the ramp of the first transition segment 509 while the second follower arm 485 travels up the ramp of the second transition segment 511 by an equal amount. The movable lamp bulb holder 372 will then rotate about the axis of rotation 481 in the opposing direction and, eventually return to zero-tilt. Advancing the cam ring 502 further will move the movable lamp bulb holder 372 beyond the zero-tilt position. In this way, the substantial point source of light positioned on the lamp bulb filament will displace in an arcuate path in a substantially perpendicular direction relative to the reflector axis in the opposing direction.

Figure 43A:
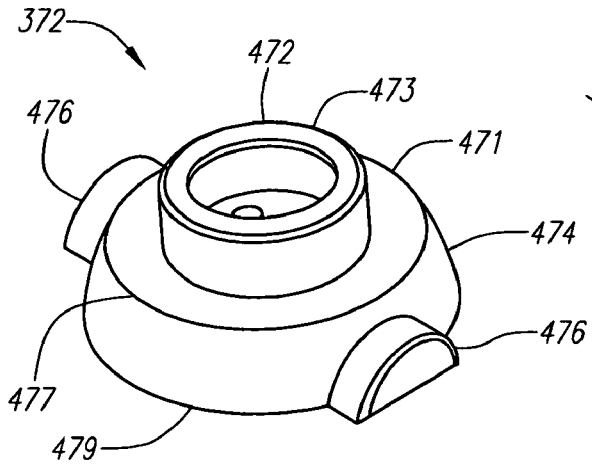
FIG. 43A is an enlarged perspective view of a movable lamp bulb holder.
Figure 43B:
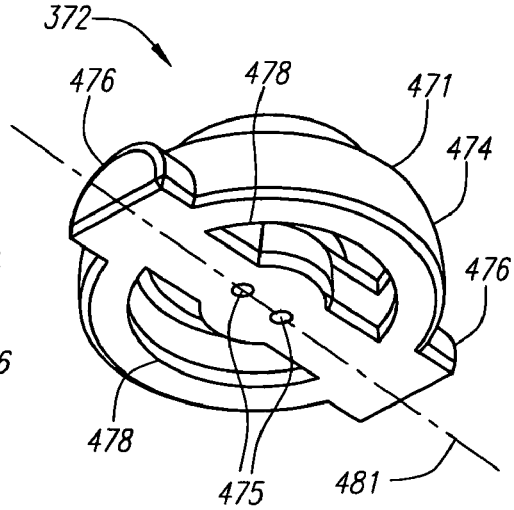
FIG. 43B is another enlarged perspective view of the movable lamp bulb holder.

In a preferred embodiment, the electrodes 357, 358 extending from the lamp bulb are aligned to the axis of rotation 481 of the movable lamp bulb holder 372 so that the longitudinal direction of the filament 360 is substantially parallel to the axis of rotation 481. This may be accomplished by positioning the electrode apertures 475 of the movable lamp bulb holder 372 receiving the lamp bulb electrodes 357, 358 to extend through the axis of rotation 481 defined by the holder tabs 476 as shown in FIG. 43B. Accordingly, when the movable lamp bulb holder 372 is rotated about the axis of rotation 481, the filament 360 will be caused to move in its transverse direction, as shown by the arrow B in FIG. 31. Advantageously, such an arrangement facilitates aligning the substantial point source of light positioned on the lamp bulb filament with the reflector axis.

Those skilled in the art will appreciate that the rise of the transition segments on the cam ring, the position of the follower areas, the position of the holder axis and the axial distance between the holder axis to the filament, among other things, contribute to the range of point source of light displacement. Various combinations of these parameters may be employed to achieve the desired point source of light displacement without departing from the present invention. Preferably the range the substantial point source of light about zero-tilt is ±0.020-080; ±0.040-060; or ±0.050 inches; and the range of angular tilt is ±2°-10°; ±4°-8°; or ±6.5°.

In the illustrative flashlight 300 described above, the holder base 413 of the movable bulb holder 372 can be viewed as the actuation interface because the actuating pressure from the cam driven contact insulator 366 is transmitted through the holder base 413. Viewed another way, as the contact insulator 366 moves together with the movable bulb holder 372, the first follower arm 485, the second follower arm 485 or the curved shoe 491 may be viewed as the actuation interface.

While a barrel-type cam with a two arm follower system is disclosed in the illustrative embodiment of front end assembly 340, other suitable means of moving the substantial point source of light relative to the reflector axis may also be employed without departing from the present invention. For example, rotating the movable lamp bulb holder 372 may alternately be achieved by extending an actuating member that is coaxial with the axis of rotation 481 of the lamp bulb holder 372. Rotating the coaxial actuating member may rotate the lamp bulb holder 372 about its axis 481 and consequently move the substantial point source of light relative to the reflector.

Alternately, an actuating member may extend from the movable lamp bulb holder 472 perpendicular to the axis of rotation 481. In this arrangement, the lamp bulb holder 372 may be caused to rotate about its axis of rotation 481 and move the point source of light relative to the reflector by moving the end of the actuating member up or down.

Still further, a plate cam may be employed to move the lamp bulb. In such a configuration, only a single follower arm would be required. By actuating the plate cam, the movable lamp bulb holder 372 and the lamp bulb may be rotated about the axis of rotation 481. Thus, various combinations may be employed to actuate the movable lamp bulb holder. The embodiment represented in flashlight 300 illustrates one possible combination of parts that effectively moves the substantial point source of light relative to the reflector axis.

The function and the benefit of the locking tabs 154 of the upper insulated retainer 374 will now be described. After the actuator ring 504 has been advanced and the substantial point source of light has been moved to the desired location, the user will eventually turn the flashlight off. The locking tabs 454 and the rack 517 on the forward side of the actuator ring 504 serve to maintain the point source of light alignment after the alignment steps and also when the flashlight is turned off.

Figure 48B:
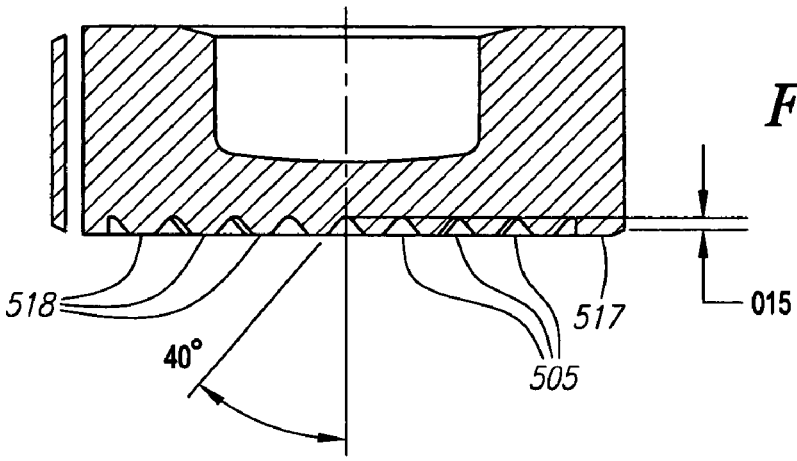
FIG. 48B is an enlarged cross-sectional view of the actuator of FIG. 48A as taken through the plane indicated by 48B-48B.

Referring to FIGS. 42 and 48B, the cap 464 of the locking tab 454 of the upper insulated retainer 374 is at least partially disposed in the slot 505 between the radial ribs 518 of the actuator ring 504. When the flashlight is on, the abutment 349 of the reflector assembly 324 is not bearing on the forward facing side of the locking tabs 454. Thus, when the actuator ring 504 is advanced to move the substantial point source of light, the locking tab 344 may deflect forward and the cap 464 can ride over the radial ribs 518 when the user advances the actuator. The taper on either side of the ribs 518 advantageously allows the cap 464 to transition from one slot to the next slot. Once the user has aligned the substantial point source of light to a position to his/her satisfaction, the locking tabs 454 advantageously remain in one of the slots 504 thereby preventing the actuator from randomly advancing during normal use of the flashlight.

Subsequently, when the flashlight is turned off, the head assembly 330 is translated rearward and the abutment of the reflector assembly 324 is urged against the front end assembly 340 until the barrel contact 445 lifts off the taper 318 of the barrel. Hence, when the flashlight is turned off, the reflector assembly 324 bears against the locking tabs 454 and prevents the tabs from deflecting forward. Accordingly, the caps 464 are rigidly held between the radial ribs 518 and the actuator ring 504 is restrained from advancing. In this way, the point source of light position is advantageously maintained even when the flashlight is turned off and less future alignment is needed. Although three locking tabs are illustrated in a preferred embodiment, less or more tabs may be employed to practice the present invention.

In the front end assembly 340 configuration where the PCB 378 is not employed, the curved contour of the contact end 416 of the upper receptacle 408 and the spring 409 provides a similarly effective and advantageous contact combination as described above.

Further, although a certain lamp bulb is illustrated in the figures, any suitable substantial point source of light device may be used with the teaching according to the present invention. The means to secure and to make electrical connections to other suitable substantial point source of light devices should be known to those skilled in the art. Also, the teaching according to the present invention may be used with an arc lamp, LED, or other light emitting devices to improve the quality of light produced therefrom.

Various embodiments of improved high quality flashlights and their respective components have been presented in the foregoing disclosure. While preferred embodiments of the herein invention have been described, numerous modifications, alterations, alternate embodiments, and alternate materials may be contemplated by those skilled in the art and may be utilized in accomplishing the various aspects of the present invention. For example, while the front end assembly includes an aspect for moving the substantial point source of light as well as an aspect for turning the flashlight on and off, use of the point source of light aspect of the present invention may be employed together or independently from any other aspects disclosed herein. It is envisioned that all such alternate embodiments are considered to be within the scope of the present invention as described by the appended claims.

What is claimed is:

1. A lighting device comprising:

a barrel containing a plurality of batteries, wherein said batteries are arranged end-to-end;

a light source held in a movable holder;

a variable length conductor that axially contracts or expands in response to pressure from said plurality of batteries interposed between and electrically coupling said light source and said plurality of batteries, wherein said variable length conductor maintains electrical coupling of said batteries to said light source while said movable holder movies said light source in a direction substantially perpendicular relative to a principle axis of a reflector.

2. A lighting device of claim 1 further including a head mounted to one end of said barrel, wherein said variable length conductor selectively electrically couples or de-couples said light source and said plurality of batteries in response to rotation of said head.

3. A lighting device of claim 1, wherein said variable length conductor includes a first receptacle, a second receptacle and a spring member interposed therebetween.

4. A lighting device of claim 1, wherein said holder is configured to move said light source substantially laterally relative to an axis of a reflector.

5. A lighting device comprising:

a plurality of batteries, wherein said batteries are arranged end-to-end;

light source held in a movable holder, wherein said holder includes a substantially spherical housing, wherein said spherical housing moves within a spherical envelope;

a switch interposed between said plurality of batteries and said holder, wherein said switch includes a spring-biased conductor configured to electrically couple said plurality of batteries to said light source, wherein said spring-biased conductor maintains electrical couple with said plurality of batteries when said plurality of batteries moves relative to said switch.

6. A lighting device of claim 5 further including a barrel containing said batteries arranged end-to-end.

7. A lighting device of claim 5, wherein said holder moves said light source by rotating about an axis not coincident with a reflector axis.

8. A lighting device of claim 5, wherein said holder includes a receiver for holding said light source, wherein said movable holder is adapted to move said light source substantially laterally relative to a reflector axis.

9. A lighting device comprising:

a plurality of batteries, wherein said batteries are arranged end-to-end;

a light source held in a movable holder, wherein said holder includes a substantially spherical housing wherein said spherical housing moves within a spherical envelope;

a switch interposed between said plurality of batteries and said holder, wherein said switch includes a spring-biased conductor configured to electrically couple said plurality of batteries to said light source, wherein said spring-biased conductor maintains electrical couple with said plurality of batteries when said plurality of batteries moves relative to said switch, wherein said spring-biased conductor includes a first receptacle, a second receptacle, and a spring member interposed therebetween.

10. A flashlight comprising:

a barrel containing a battery;

a reflector disposed on one end of said barrel, wherein said reflector includes a first open end configured to emit a light beam, a second end and a reflector axis extending therebetween;

a light source held in a movable holder, wherein said movable holder holds said light source in a position between said first open end and said second end of said reflector, wherein said movable holder is configured to move said light source in a direction substantially perpendicular relative to said reflector axis;

a variable length conductor electrically coupling said battery to said light source, wherein said variable length conductor maintains electrical coupling of said battery to said light source while said movable holder moves said light source in a direction substantially perpendicular relative to said reflector axis.

11. A flashlight of claim 10, wherein said movable holder includes a spherical housing and moves said light source in a direction substantially perpendicular relative to said reflector axis to align said light source with said reflector axis.

12. A flashlight of claim 10, wherein said movable holder includes a spherical housing, wherein said spherical housing moves within a spherical envelope.

13. A flashlight of claim 10, wherein said movable holder is externally accessible by a user to move said light source.

14. A flashlight of claim 10, wherein said movable holder is externally operable by a user to move said light source.

15. A flashlight of claim 10 further including an actuating member, wherein said actuating member is operatively connected to said movable holder to move said light source.

16. A flashlight comprising:

a barrel containing a battery;

a reflector disposed on one end of said barrel, wherein said reflector includes a first open end configured to emit a light beam, a second end and a reflector axis extending therebetween;

a light source held in a movable holder, wherein said movable holder holds said light source in a position between said first open end and said second end of said reflector, wherein said movable holder is configured to move said light source in a direction substantially perpendicular relative to said reflector axis;

a variable length conductor electrically coupling said battery to said light source, wherein said variable length conductor maintains electrical coupling of said battery to said light source while said movable holder moves said light source in a direction substantially perpendicular relative to said reflector axis, wherein said variable length conductor includes a first receptacle, a second receptacle, and a spring member interposed therebetween.

17. A flashlight of claim 16 further including a circuit board, wherein said second receptacle of said variable length conductor is electrically coupled to said circuit board.

18. A flashlight of claim 17, wherein said circuit board includes electronics to control energy flowing from said battery to said light source.

19. A flashlight of claim 18, wherein said variable length conductor includes a first receptacle and a spring member, wherein said first receptacle has an end shaped with at least part of a spherical profile, wherein said spring member arranged to urge said at least part of a spherical profile of said first receptacle against said spherical housing of said movable holder.

* * * * *

UNITED STATES PATENT AND TRADEMARK OFFICE

CERTIFICATE OF CORRECTION

PATENT NO. : 7,344,269 B2
APPLICATION NO. : 11/378803
DATED : March 18, 2008
INVENTOR(S) : Anthony Maglica It is certified that error appears in the above-identified patent and that said Letters Patent is hereby corrected as shown below:

Column 41,
Line 10, to change “light source” to read -- a light source --

Signed and Sealed this

Fourth Day of November, 2008

JON W. DUDAS
*Director of the United States Patent and Trademark Office*